US009950224B2

(12) United States Patent
Willett et al.

(10) Patent No.: US 9,950,224 B2
(45) **Date of Patent: *Apr. 24, 2018**

(54) AERODYNAMIC GOLF CLUB HEAD

(71) Applicant: TAYLOR MADE GOLF COMPANY, INC, Carlsbad, CA (US)

(72) Inventors: Kraig Alan Willett, Fallbrook, CA (US); Jeffrey J. Albertsen, Plano, TX (US); Michael Scott Burnett, McKinney, TX (US)

(73) Assignee: TAYLOR MADE GOLF COMPANY, INC, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/456,630

(22) Filed: Mar. 13, 2017

(65) Prior Publication Data

US 2017/0182382 A1 Jun. 29, 2017

Related U.S. Application Data

(63) Continuation of application No. 15/002,471, filed on Jan. 21, 2016, now Pat. No. 9,623,295, which is a continuation of application No. 14/488,354, filed on Sep. 17, 2014, now Pat. No. 9,259,628, which is a continuation of application No. 13/718,107, filed on Dec. 18, 2012, now Pat. No. 8,858,359, which is a continuation-in-part of application No. 13/683,299, filed on Nov. 21, 2012, now Pat. No. 8,540,586, which is a continuation of application No. 13/305,978, filed on Nov. 29, 2011, which is a (Continued)

(51) Int. Cl.
*A63B 53/04* (2015.01)

(52) U.S. Cl.
CPC .. *A63B 53/0466* (2013.01); *A63B 2053/0408* (2013.01); *A63B 2053/0412* (2013.01); *A63B 2053/0437* (2013.01)

(58) Field of Classification Search
CPC ..... A63B 53/0466
See application file for complete search history.

(56) References Cited

U.S. PATENT DOCUMENTS 2,083,189 A 6/1937 Crooker
3,085,804 A 4/1963 Pieper
(Continued)

FOREIGN PATENT DOCUMENTS

EP 0446935 9/1991
JP H06190088 7/1994
(Continued)

OTHER PUBLICATIONS

International Searching Authority (USPTO), International Search Report and Written Opinion for International Application No. PCT/US 09/49742, dated Aug. 27, 2009, 11 pages.
(Continued)

*Primary Examiner* — Michael Dennis
(74) *Attorney, Agent, or Firm* — Gallagher & Dawsey Co., LPA; David J. Dawsey; Michael J. Gallagher

(57) ABSTRACT

An aerodynamic golf club head with a low center of gravity and producing reduced aerodynamic drag forces. The club head has crown section attributes that impart beneficial aerodynamic properties.

20 Claims, 34 Drawing Sheets

Related U.S. Application Data continuation of application No. 12/409,998, filed on Mar. 24, 2009, now Pat. No. 8,088,021, which is a continuation-in-part of application No. 12/367,839, filed on Feb. 9, 2009, now Pat. No. 8,083,609.

(60) Provisional application No. 61/080,892, filed on Jul. 15, 2008, provisional application No. 61/101,919, filed on Oct. 1, 2008.

(56) References Cited

U.S. PATENT DOCUMENTS

| | | | | |
|---|---|---|---|---|
| 3,166,320 | A | 1/1965 | Onions | |
| 3,266,805 | A | 8/1966 | Bulla | |
| 3,468,544 | A | 9/1969 | Antonious | |
| 3,893,672 | A | 7/1975 | Schonher | |
| 3,985,363 | A | 10/1976 | Jepson et al. | |
| 3,997,170 | A | 12/1976 | Goldberg | |
| 4,065,133 | A | 12/1977 | Gordos | |
| 4,077,633 | A | 3/1978 | Studen | |
| 4,139,196 | A | 2/1979 | Riley | |
| 4,147,349 | A | 4/1979 | Jeghers | |
| 4,165,076 | A | 8/1979 | Cella | |
| 4,193,601 | A | 3/1980 | Reid, Jr. et al. | |
| D256,709 | S | 9/1980 | Reid, Jr. et al. | |
| 4,247,105 | A | 1/1981 | Jeghers | |
| D265,112 | S | 6/1982 | Lyons | |
| 4,431,192 | A | 2/1984 | Stuff, Jr. | |
| 4,432,549 | A | 2/1984 | Zebelean | |
| 4,471,961 | A | 9/1984 | Masghati et al. | |
| 4,527,799 | A | 7/1985 | Solheim | |
| 4,592,552 | A | 6/1986 | Garber | |
| 4,754,974 | A | 7/1988 | Kobayashi | |
| 4,787,636 | A | 11/1988 | Honma | |
| 4,881,739 | A | 11/1989 | Garcia | |
| 4,895,367 | A | 1/1990 | Kajita et al. | |
| 4,919,428 | A | 4/1990 | Perkins | |
| 5,000,454 | A | 3/1991 | Soda | |
| 5,054,784 | A | 10/1991 | Collins | |
| 5,092,599 | A | 3/1992 | Okumoto et al. | |
| 5,116,054 | A | 5/1992 | Johnson | |
| 5,190,289 | A | 3/1993 | Nagai et al. | |
| 5,193,810 | A | 3/1993 | Antonious | |
| 5,221,086 | A | 6/1993 | Antonious | |
| 5,255,919 | A | 10/1993 | Johnson | |
| 5,301,944 | A | 4/1994 | Koehler | |
| 5,318,297 | A | 6/1994 | Davis et al. | |
| D349,543 | S | 8/1994 | MacDougall | |
| 5,340,106 | A | 8/1994 | Ravaris | |
| 5,435,558 | A | 7/1995 | Iriarte | |
| 5,482,280 | A | 1/1996 | Yamawaki | |
| 5,511,786 | A | 4/1996 | Antonious | |
| 5,558,332 | A | 9/1996 | Cook | |
| D375,130 | S | 10/1996 | Hlinka et al. | |
| D378,770 | S | 4/1997 | Hlinka et al. | |
| 5,632,695 | A | 5/1997 | Hlinka et al. | |
| 5,695,412 | A | 12/1997 | Cook | |
| 5,700,208 | A | 12/1997 | Nelms | |
| 5,759,114 | A | 6/1998 | Bluto et al. | |
| 5,785,608 | A | 7/1998 | Collins | |
| 5,797,807 | A | 8/1998 | Moore | |
| RE35,931 | E | 10/1998 | Schroder et al. | |
| D401,650 | S | 11/1998 | Burrows | |
| 5,851,160 | A | 12/1998 | Rugge et al. | |
| 5,876,293 | A | 3/1999 | Musty | |
| 5,885,166 | A | 3/1999 | Shiraishi | |
| 5,890,971 | A | 4/1999 | Shiraishi | |
| 5,935,020 | A | 8/1999 | Stites et al. | |
| 5,954,595 | A | 9/1999 | Antonious | |
| 6,001,029 | A | 12/1999 | Kobayashi | |
| 6,033,319 | A | 3/2000 | Farrar | |
| 6,074,308 | A | 6/2000 | Domas | |
| 6,083,115 | A | 7/2000 | King | |
| 6,093,113 | A | 7/2000 | Mertens | |
| 6,123,627 | A | 9/2000 | Antonious | |
| 6,139,445 | A | 10/2000 | Werner et al. | |
| 6,168,537 | B1 | 1/2001 | Ezawa | |
| 6,344,002 | B1 | 2/2002 | Kajita | |
| 6,402,639 | B1 * | 6/2002 | Iwata | A63B 53/0466 473/330 |
| 6,458,042 | B1 | 10/2002 | Chen | |
| 6,464,598 | B1 | 10/2002 | Miller | |
| 6,530,847 | B1 | 3/2003 | Antonious | |
| D482,420 | S | 11/2003 | Burrows | |
| 6,723,002 | B1 | 4/2004 | Barlow | |
| 6,773,359 | B1 | 8/2004 | Lee | |
| 6,776,723 | B2 | 8/2004 | Bliss et al. | |
| D501,903 | S | 2/2005 | Tanaka | |
| 6,855,068 | B2 | 2/2005 | Antonious | |
| 6,939,247 | B1 | 9/2005 | Schweigert et al. | |
| D515,643 | S | 2/2006 | Ritz | |
| 6,994,636 | B2 | 2/2006 | Hocknell et al. | |
| 7,004,849 | B2 | 2/2006 | Cameron | |
| 7,025,695 | B2 | 4/2006 | Mitsuba | |
| D522,601 | S | 6/2006 | Schweigert | |
| 7,163,470 | B2 | 1/2007 | Galloway et al. | |
| 7,166,038 | B2 | 1/2007 | Williams et al. | |
| 7,169,058 | B1 | 1/2007 | Fagan | |
| D537,495 | S | 2/2007 | Schweigert | |
| D543,600 | S | 5/2007 | Oldknow | |
| D544,939 | S | 6/2007 | Radcliffe et al. | |
| D549,792 | S | 8/2007 | Parise | |
| D552,198 | S | 10/2007 | Schweigert | |
| D554,720 | S | 11/2007 | Barez et al. | |
| 7,294,064 | B2 | 11/2007 | Tsurumaki et al. | |
| D564,611 | S | 3/2008 | Llewellyn | |
| 7,390,266 | B2 | 6/2008 | Gwon | |
| D589,103 | S | 3/2009 | Kohno | |
| 7,674,187 | B2 | 3/2010 | Cackett et al. | |
| 7,674,189 | B2 | 3/2010 | Beach et al. | |
| 7,731,603 | B2 | 6/2010 | Beach et al. | |
| D622,338 | S | 8/2010 | Kohno | |
| D622,795 | S | 8/2010 | Furutate | |
| 7,766,765 | B2 | 8/2010 | Oyama | |
| 7,771,291 | B1 | 8/2010 | Willett et al. | |
| 7,927,229 | B2 | 4/2011 | Jertson et al. | |
| 8,012,038 | B1 | 9/2011 | Beach et al. | |
| 8,012,039 | B2 | 9/2011 | Greaney et al. | |
| 8,083,609 | B2 | 12/2011 | Burnett et al. | |
| 8,088,021 | B2 | 1/2012 | Albertsen et al. | |
| 8,133,135 | B2 | 3/2012 | Stites et al. | |
| 8,187,115 | B2 | 5/2012 | Bennett et al. | |
| D686,679 | S | 7/2013 | Greensmith et al. | |
| 8,496,544 | B2 | 7/2013 | Curtis et al. | |
| 8,523,705 | B2 | 9/2013 | Breier et al. | |
| 8,529,368 | B2 | 9/2013 | Rice et al. | |
| D692,077 | S | 10/2013 | Greensmith et al. | |
| D696,366 | S | 12/2013 | Milo et al. | |
| D696,367 | S | 12/2013 | Taylor et al. | |
| D697,152 | S | 1/2014 | Harbert et al. | |
| 8,663,029 | B2 | 3/2014 | Beach et al. | |
| 9,044,653 | B2 | 6/2015 | Wahl et al. | |
| 2002/0183130 | A1 | 12/2002 | Pacinella | |
| 2002/0183134 | A1 | 12/2002 | Allen et al. | |
| 2003/0114239 | A1 | 6/2003 | Mase | |
| 2003/0220154 | A1 | 11/2003 | Anelli | |
| 2004/0097299 | A1 * | 5/2004 | Soracco | A63B 53/0466 473/342 |
| 2004/0157678 | A1 | 8/2004 | Kohno | |
| 2004/0162156 | A1 | 8/2004 | Kohno | |
| 2004/0192463 | A1 | 9/2004 | Tsurumaki et al. | |
| 2005/0009622 | A1 | 1/2005 | Antonious | |
| 2005/0059508 | A1 | 3/2005 | Burnett et al. | |
| 2006/0009305 | A1 | 1/2006 | Lindsay | |
| 2006/0094535 | A1 | 5/2006 | Cameron | |
| 2006/0116218 | A1 | 6/2006 | Burnett et al. | |
| 2006/0258481 | A1 | 11/2006 | Oyama | |
| 2006/0281581 | A1 | 12/2006 | Yamamoto | |
| 2007/0105657 | A1 | 5/2007 | Hirano | |
| 2007/0275792 | A1 | 11/2007 | Horacek et al. | |
| 2008/0039234 | A1 | 2/2008 | Williams et al. | |
| 2008/0132356 | A1 | 6/2008 | Chao et al. | |
| 2008/0146374 | A1 | 6/2008 | Beach et al. | |
| 2009/0124411 | A1 | 5/2009 | Rae et al. | |

(56) References Cited

U.S. PATENT DOCUMENTS

| | | | |
|---|---|---|---|
| 2009/0137338 | A1 | 5/2009 | Kajita |
| 2009/0149275 | A1 | 6/2009 | Rae et al. |
| 2009/0170632 | A1 | 7/2009 | Beach et al. |
| 2009/0191980 | A1 | 7/2009 | Greaney et al. |
| 2010/0016095 | A1 | 1/2010 | Burnett et al. |
| 2011/0014992 | A1 | 1/2011 | Morrissey |
| 2012/0071267 | A1 | 3/2012 | Burnett et al. |
| 2012/0071268 | A1 | 3/2012 | Albertsen et al. |
| 2012/0172146 | A1 | 7/2012 | Greaney et al. |
| 2012/0316007 | A1 | 12/2012 | Burnett et al. |
| 2013/0123040 | A1 | 5/2013 | Willett et al. |
| 2014/0256461 | A1 | 9/2014 | Beach et al. |

FOREIGN PATENT DOCUMENTS

| | | |
|---|---|---|
| JP | H10263118 | 10/1998 |
| JP | H11114102 | 4/1999 |
| JP | H11155982 | 6/1999 |
| JP | 2002-052099 | 2/2002 |
| JP | 2002136625 | 5/2002 |
| JP | 2003135632 | 5/2003 |
| JP | 2003210621 | 7/2003 |
| JP | 2003524487 | 8/2003 |
| JP | 2003320061 | 11/2003 |
| JP | 2004174224 | 6/2004 |
| JP | 2004232397 | 8/2004 |
| JP | 2004261451 | 9/2004 |
| JP | 2004265992 | 9/2004 |
| JP | 2004271516 | 9/2004 |
| JP | 2004313762 | 11/2004 |
| JP | 2004351054 | 12/2004 |
| JP | 2004351173 | 12/2004 |
| JP | 2005073736 | 3/2005 |
| JP | 2005111172 | 4/2005 |
| JP | 2005137494 | 6/2005 |
| JP | 2005137788 | 6/2005 |
| WO | 2005009543 | 2/2005 |

OTHER PUBLICATIONS

Excerpts from Golf Digest; magazine; Feb. 2004; Article entitled: "The Hot List", cover page from magazine and article on pp. 82-88.

Excerpts from Golf Digest; magazine; Feb. 2005; Article entitled: "The Hot List", cover page from magazine and article on pp. 119-130. (Part 1).

Excerpts from Golf Digest; magazine; Feb. 2005; Article entitled: "The Hot List", article on pp. 131-143. (Part 2).

Excerpts from Golf Digest; magazine; Feb. 2006; Article entitled: "The Hot List", cover page from magazine and article on pp. 122-132. (Part 1).

Excerpts from Golf Digest; magazine; Feb. 2006; Article entitled: "The Hot List", article on pp. 133-143. (Part 2).

Excerpts from Golf Digest; magazine; Feb. 2007; Article entitled: "The Hot List", cover page from magazine and article on pp. 130-151.

Excerpts from Golf Digest; magazine; Feb. 2008; Article entitled: "The Hot List", cover page from magazine and article on pp. 114-139.

Excerpts from Golf Digest; magazine; Feb. 2009; Article entitled: "The Hot List", cover page from magazine and article on pp. 101-127.

International Searching Authority (USPTO), International Search Report and Written Opinion for International Application No. PCT/US2009/049418, dated Aug. 26, 2009, 10 pages.

Declaration.

"Cleveland HiBore Driver Review," http://thesandtrip.com , 7 pages, May 19, 2006.

"Invalidity Search Report for Japanese Registered Patent No. 4,128,970," 4pg. (dated Nov. 29, 2013.).

* cited by examiner

AERODYNAMIC GOLF CLUB HEAD

CROSS-REFERENCE TO RELATED APPLICATIONS

This application is a continuation of U.S. patent application Ser. No. 15/002,471, filed on Jan. 21, 2016, which is a continuation of U.S. patent application Ser. No 14/488,354, filed on Sep. 17, 2014 (now U.S. Pat. No. 9,259,628), which is a continuation of U.S. patent application Ser. No. 13/718,107, filed on Dec. 18, 2012 (now U.S. Pat. No. 8,858,359), which is a continuation-in-part of U.S. patent application Ser. No. 13/683,299, filed on Nov. 21, 2012 (now U.S. Pat. No. 8,540,586), which is a continuation application of U.S. patent application Ser. No. 13/305,978, filed on Nov. 29, 2011, which is a continuation application of U.S. patent application Ser. No. 12/409,998, filed on Mar. 24, 2009 (now U.S. Pat. No. 8,088,021), which is a continuation-in-part of U.S. patent application Ser. No. 12/367,839, filed on Feb. 9, 2009 (now U.S. Pat. No. 8,083,609), which claims the benefit of U.S. provisional patent application Ser. No. 61/080,892, filed on Jul. 15, 2008, and U.S. provisional patent application Ser. No. 61/101,919, filed on Oct. 1, 2008, all of which are incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to sports equipment; particularly, to a high volume aerodynamic golf club head.

BACKGROUND OF THE INVENTION

Modern high volume golf club heads, namely drivers, are being designed with little, if any, attention paid to the aerodynamics of the golf club head. This stems in large part from the fact that in the past the aerodynamics of golf club heads were studied and it was found that the aerodynamics of the club head had only minimal impact on the performance of the golf club.

The drivers of today have club head volumes that are often double the volume of the most advanced club heads from just a decade ago. In fact, virtually all modern drivers have club head volumes of at least 400 cc, with a majority having volumes right at the present USGA mandated limit of 460 cc. Still, golf club designers pay little attention to the aerodynamics of these large golf clubs; often instead focusing solely on increasing the club head's resistance to twisting during off-center shots.

The modern race to design golf club heads that greatly resist twisting, meaning that the club heads have large moments of inertia, has led to club heads having very long front-to-back dimensions. The front-to-back dimension of a golf club head, often annotated the FB dimension, is measured from the leading edge of the club face to the furthest back portion of the club head. Currently, in addition to the USGA limit on the club head volume, the USGA limits the front-to-back dimension (FB) to 5 inches and the moment of inertia about a vertical axis passing through the club head's center of gravity (CG), referred to as MOIy, to 5900 g*cm$^2$. One of skill in the art will know the meaning of "center of gravity," referred to herein as CG, from an entry level course on mechanics. With respect to wood-type golf clubs, which are generally hollow and/or having non-uniform density, the CG is often thought of as the intersection of all the balance points of the club head. In other words, if you balance the head on the face and then on the sole, the intersection of the two imaginary lines passing straight through the balance points would define the point referred to as the CG.

Until just recently the majority of drivers had what is commonly referred to as a "traditional shape" and a 460 cc club head volume. These large volume traditional shape drivers had front-to-back dimensions (FB) of approximately 4.0 inches to 4.3 inches, generally achieving an MOIy in the range of 4000-4600 g*cm$^2$. As golf club designers strove to increase MOIy as much as possible, the FB dimension of drivers started entering the range of 4.3 inches to 5.0 inches. The graph of FIG. 1 shows the FB dimension and MOIy of 83 different club head designs and nicely illustrates that high MOIy values come with large FB dimensions.

While increasing the FB dimension to achieve higher MOIy values is logical, significant adverse effects have been observed in these large FB dimension clubs. One significant adverse effect is a dramatic reduction in club head speed, which appears to have gone unnoticed by many in the industry. The graph of FIG. 2 illustrates player test data with drivers having an FB dimension greater than 3.6 inches. The graph illustrates considerably lower club head speeds for large FB dimension drivers when compared to the club head speeds of drivers having FB dimensions less than 4.4 inches. In fact, a club head speed of 104.6 mph was achieved when swinging a driver having a FB dimension of less than 3.8 inches, while the swing speed dropped over 3% to 101.5 mph when swinging a driver with a FB dimension of slightly less than 4.8 inches.

This significant decrease in club head speed is the result of the increase in aerodynamic drag forces associated with large FB dimension golf club heads. Data obtained during extensive wind tunnel testing shows a strong correlation between club head FB dimension and the aerodynamic drag measured at several critical orientations. First, orientation one is identified in FIG. 11 with a flow arrow labeled as "Air Flow—90° " and is referred to in the graphs of the figures as "lie 90 degree orientation." This orientation can be thought of as the club head resting on the ground plane (GP) with the shaft axis (SA) at the club head's design lie angle, as seen in FIG. 8. Then a 100 mph wind is directed parallel to the ground plane (GP) directly at the club face (200), as illustrated by the flow arrow labeled "Air Flow—90°" in FIG. 11.

Secondly, orientation two is identified in FIG. 11 with a flow arrow labeled as "Air Flow—60°" and is referred to in the graphs of the figures as "lie 60 degree orientation." This orientation can be thought of as the club head resting on the ground plane (GP) with the shaft axis (SA) at the club head's design lie angle, as seen in FIG. 8. Then a 100 mph wind is wind is oriented thirty degrees from a vertical plane normal to the face (200) with the wind originating from the heel (116) side of the club head, as illustrated by the flow arrow labeled "Air Flow—60°" in FIG. 11.

Thirdly, orientation three is identified in FIG. 12 with a flow arrow labeled as "Air Flow—Vert.—0°" and is referred to in the graphs of the figures as "vertical 0 degree orientation." This orientation can be thought of as the club head being oriented upside down with the shaft axis (SA) vertical while being exposed to a horizontal 100 mph wind directed at the heel (116), as illustrated by the flow arrow labeled "Air Flow—Vert.—0°" in FIG. 12. Thus, the air flow is parallel to the vertical plane created by the shaft axis (SA) seen in FIG. 11, blowing from the heel (116) to the toe (118) but with the club head oriented as seen in FIG. 12.

Now referring back to orientation one, namely the orientation identified in FIG. 11 with a flow arrow labeled as "Air Flow—90°." Normalized aerodynamic drag data has been gathered for six different club heads and is illustrated in the graph of FIG. 5. At this point it is important to understand that all of the aerodynamic drag forces mentioned herein, unless otherwise stated, are aerodynamic drag forces normalized to a 120 mph airstream velocity. Thus, the illustrated aerodynamic drag force values are the actual measured drag force at the indicated airstream velocity multiplied by the square of the reference velocity, which is 120 mph, then divided by the square of the actual airstream velocity. Therefore, the normalized aerodynamic drag force plotted in FIG. 5 is the actual measured drag force when subjected to a 100 mph wind at the specified orientation, multiplied by the square of the 120 mph reference velocity, and then divided by the square of the 100 mph actual airstream velocity.

Still referencing FIG. 5, the normalized aerodynamic drag force increases non-linearly from a low of 1.2 lbf with a short 3.8 inch FB dimension club head to a high of 2.65 lbf for a club head having a FB dimension of almost 4.8 inches. The increase in normalized aerodynamic drag force is in excess of 120% as the FB dimension increases slightly less than one inch, contributing to the significant decrease in club head speed previously discussed.

The results are much the same in orientation two, namely the orientation identified in FIG. 11 with a flow arrow labeled as "Air Flow—60°." Again, normalized aerodynamic drag data has been gathered for six different club heads and is illustrated in the graph of FIG. 4. The normalized aerodynamic drag force increases non-linearly from a low of approximately 1.1 lbf with a short 3.8 inch FB dimension club head to a high of approximately 1.9 lbf for a club head having a FB dimension of almost 4.8 inches. The increase in normalized aerodynamic drag force is almost 73% as the FB dimension increases slightly less than one inch, also contributing to the significant decrease in club head speed previously discussed.

Again, the results are much the same in orientation three, namely the orientation identified in FIG. 12 with a flow arrow labeled as "Air Flow—Vert.—0°." Again, normalized aerodynamic drag data has been gathered for several different club heads and is illustrated in the graph of FIG. 3. The normalized aerodynamic drag force increases non-linearly from a low of approximately 1.15 lbf with a short 3.8 inch FB dimension club head to a high of approximately 2.05 lbf for a club head having a FB dimension of almost 4.8 inches. The increase in normalized aerodynamic drag force is in excess of 78% as the FB dimension increases slightly less than one inch, also contributing to the significant decrease in club head speed previously discussed.

Further, the graph of FIG. 6 correlates the player test club head speed data of FIG. 2 with the maximum normalized aerodynamic drag force for each club head from FIG. 3, 4, or 5. Thus, FIG. 6 shows that the club head speed drops from 104.6 mph, when the maximum normalized aerodynamic drag force is only 1.2 lbf, down to 101.5 mph, when the maximum normalized aerodynamic drag force is 2.65 lbf.

The drop in club head speed just described has a significant impact on the speed at which the golf ball leaves the club face after impact and thus the distance that the golf ball travels. In fact, for a club head speed of approximately 100 mph, each 1 mph reduction in club head speed results in approximately a 1% loss in distance. The present golf club head has identified these relationships, the reason for the drop in club head speed associated with long FB dimension clubs, and several ways to reduce the aerodynamic drag force of golf club heads.

SUMMARY OF THE INVENTION

The claimed aerodynamic golf club head having a large projected area of the face portion ($A_f$) and large drop contour area (CA) has recognized that the poor aerodynamic performance of large FB dimension drivers is not due solely to the large FB dimension; rather, in an effort to create large FB dimension drivers with a high MOIy value and low center of gravity (CG) dimension, golf club designers have generally created clubs that have very poor aerodynamic shaping. Several problems are the lack of proper shaping to account for airflow reattachment in the crown area trailing the face, the lack of proper shaping to promote airflow attachment after is passes the highest point on the crown, and the lack of proper trailing edge design. In addition, current driver designs have failed to obtain improved aerodynamic performance for golf club head designs that include a large projected area of the face portion ($A_f$).

The present aerodynamic golf club head having a large projected area of the face portion ($A_f$) and large drop contour area (CA) solves these issues and results in a high volume aerodynamic golf club head having a relatively large FB dimension with beneficial moment of inertia values, while also obtaining superior aerodynamic properties unseen by other large volume, large FB dimension, high MOI golf club heads. The golf club head obtains superior aerodynamic performance through the use of unique club head shapes and the incorporation of crown section having a drop contour area (CA) that is sufficiently large in relation to the projected area of the face portion ($A_f$) of the golf club head.

The club head has a large projected area of the face portion ($A_f$) and a crown having a large drop contour area (CA). The drop contour area (CA) is an area defined by the intersection of the crown with a plane that is offset toward the ground plane from the crown apex. In several embodiments, the relationship between the projected area of the face portion ($A_f$) and the drop contour area (CA) is defined in part by linear boundary equation. The relatively large drop contour area (CA) for a given relatively large projected area of the face portion ($A_f$) aids in keeping airflow attached to the club head once it flows past the crown apex thereby resulting in reduced aerodynamic drag forces and producing higher club head speeds.

BRIEF DESCRIPTION OF THE DRAWINGS

Without limiting the scope of the present aerodynamic golf club head as claimed below and referring now to the drawings and figures:

Figure 1:
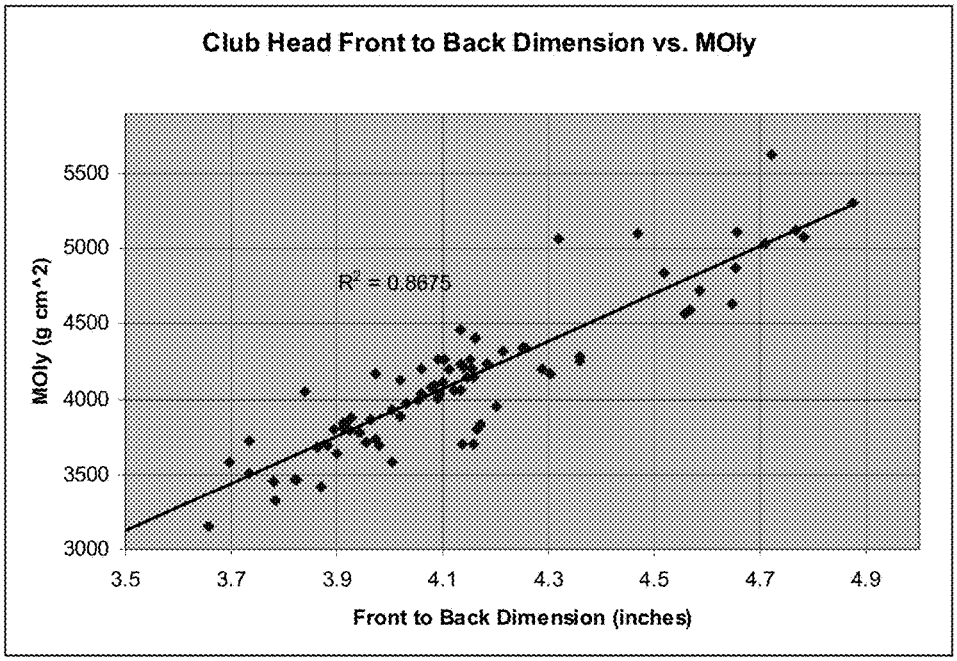
FIG. 1 shows a graph of FB dimensions versus MOIy.
Figure 2:
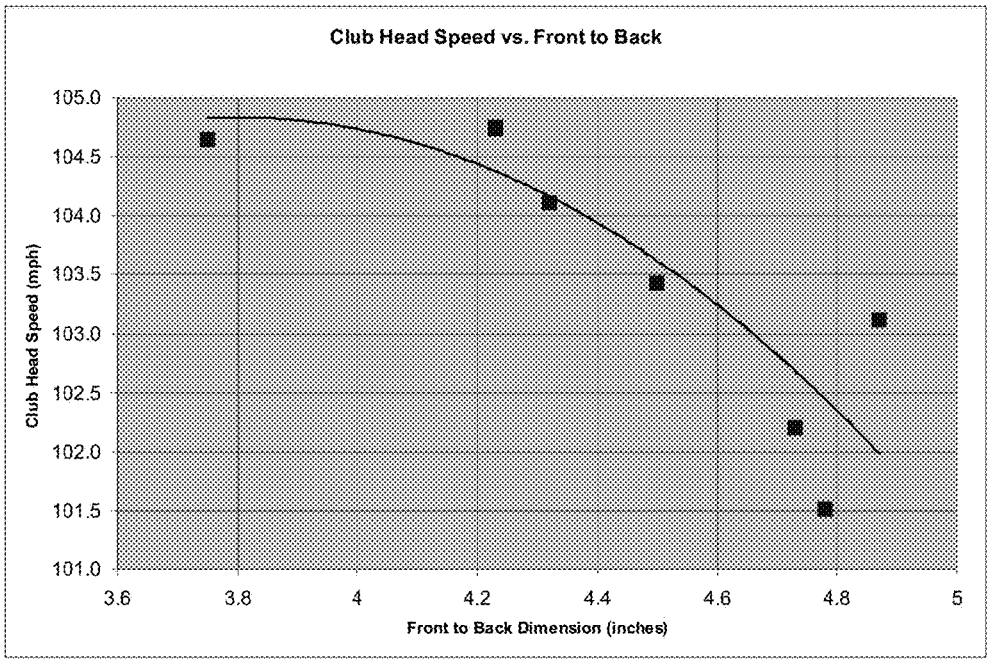
FIG. 2 shows a graph of FB dimensions versus club head speed.
Figure 3:
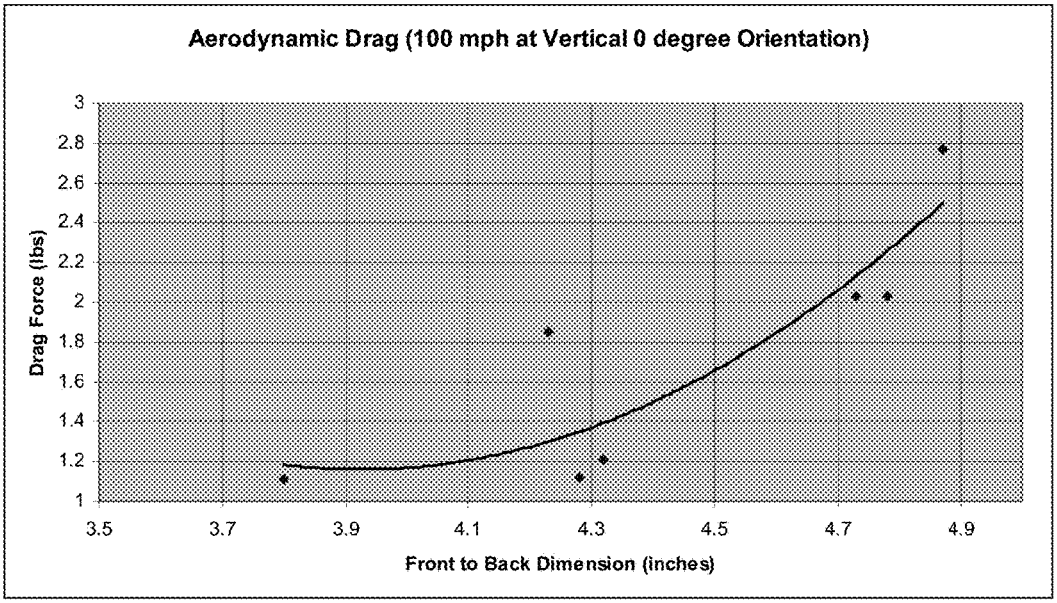
FIG. 3 shows a graph of FB dimensions versus club head normalized aerodynamic drag force.
Figure 4:
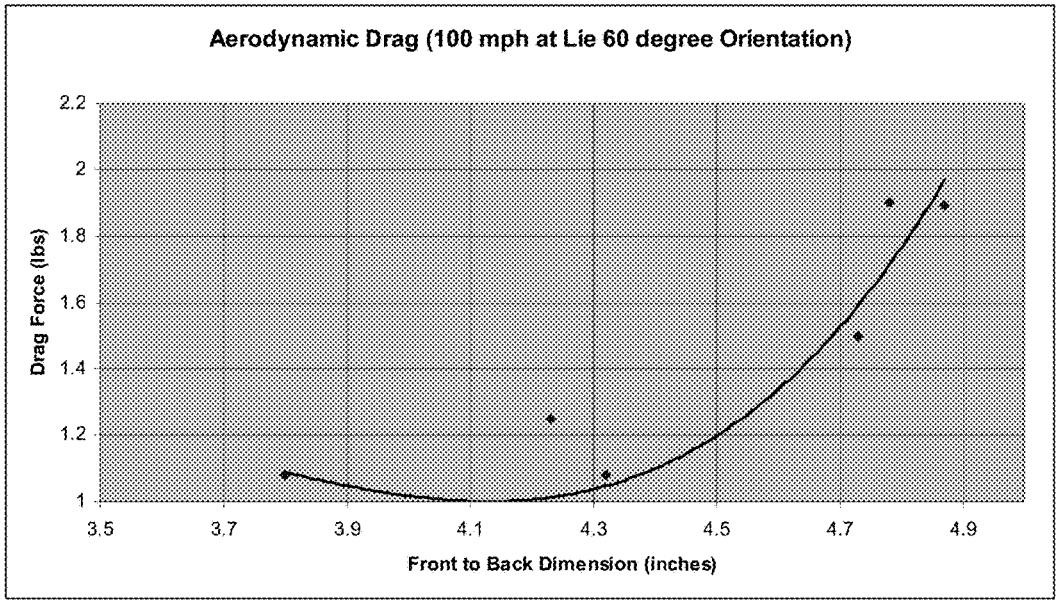
FIG. 4 shows a graph of FB dimensions versus club head normalized aerodynamic drag to force.
Figure 5:
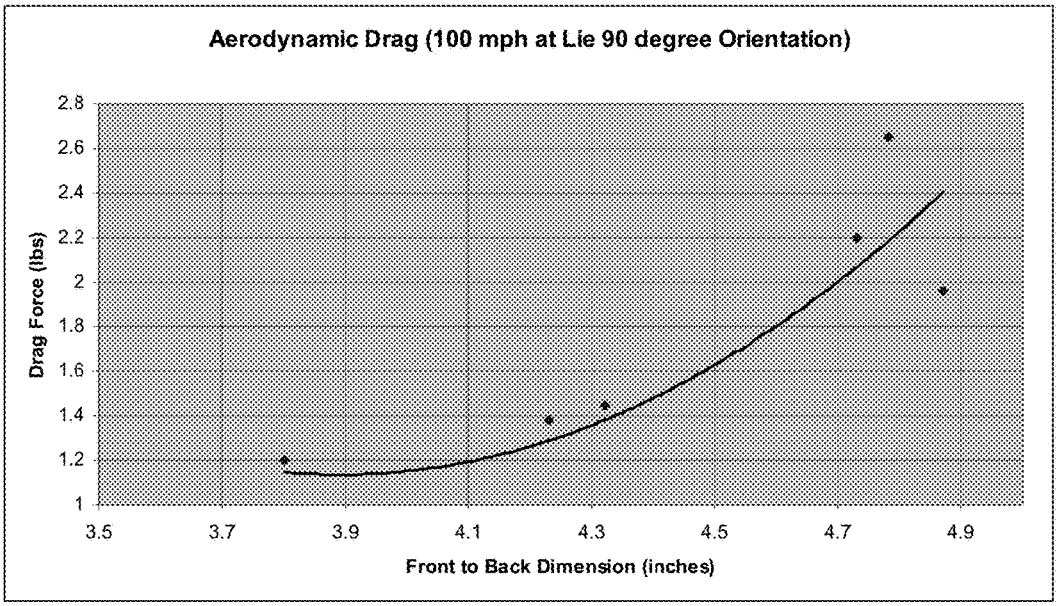
FIG. 5 shows a graph of FB dimensions versus club head normalized aerodynamic drag force.
Figure 6:
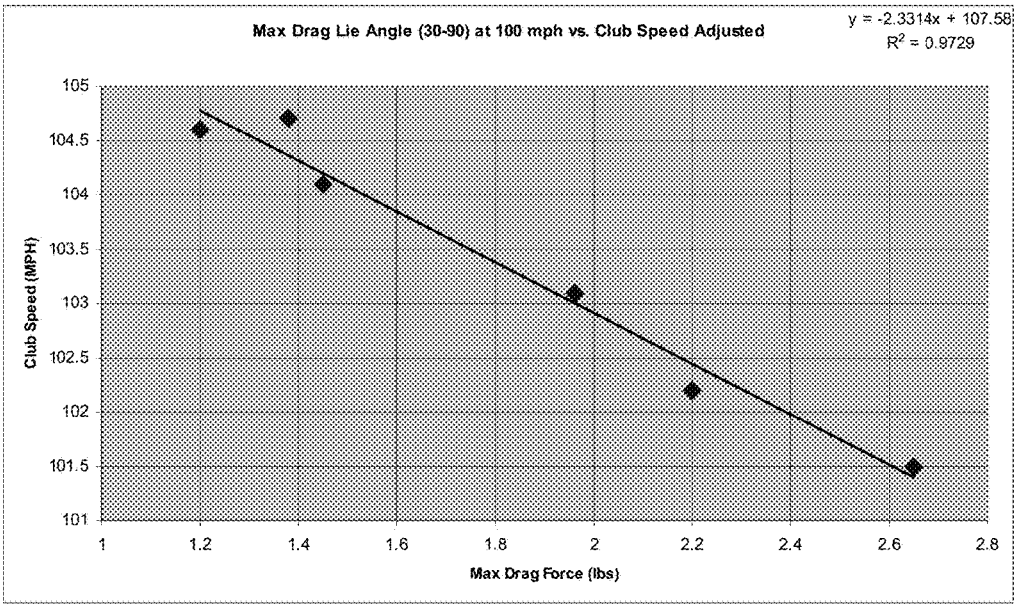
FIG. 6 shows a graph of club head normalized aerodynamic drag force versus club head speed.

These drawings are provided to assist in the understanding of the exemplary embodiments of the high volume aerodynamic golf club head as described in more detail below and should not be construed as unduly limiting the present golf club head. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The claimed high volume aerodynamic golf club head (100) enables a significant advance in the state of the art. The preferred embodiments of the club head (100) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the club head (100), and is not intended to represent the only form in which the club head (100) may be constructed or utilized. The description sets forth the designs, functions, means, and methods of implementing the club head (100) in connection with the illustrated embodiments. It is to be understood, however, that the same or equivalent functions and features may be accomplished by different embodiments that are also intended to be encompassed within the spirit and scope of the club head (100).

The present high volume aerodynamic golf club head (100) has recognized that the poor aerodynamic performance of large FB dimension drivers is not due solely to the large FB dimension; rather, in an effort to create large FB dimension drivers with a high MOIy value and low center of gravity (CG) dimension, golf club designers have generally created clubs that have very poor aerodynamic shaping. The main problems are the significantly flat surfaces on the body, the lack of proper shaping to account for airflow reattachment in the crown area trailing the face, and the lack of proper trailing edge design. In addition, current large FB dimension driver designs have ignored, or even tried to maximize in some cases, the frontal cross sectional area of the golf club head which increases the aerodynamic drag force. The present aerodynamic golf club head (100) solves these issues and results in a high volume aerodynamic golf club head (100) having a large FB dimension and a high MOIy.

The present high volume aerodynamic golf club head (100) has a volume of at least 400 cc. It is characterized by a face-on normalized aerodynamic drag force of less than 1.5 lbf when exposed to a 100 mph wind parallel to the ground plane (GP) when the high volume aerodynamic golf club head (100) is positioned in a design orientation and the wind is oriented at the front (112) of the high volume aerodynamic golf club head (100), as previously described with respect to FIG. 11 and the flow arrow labeled "air flow—90°." As explained in the "Background" section, but worthy of repeating in this section, all of the aerodynamic drag forces mentioned herein, unless otherwise stated, are aerodynamic drag forces normalized to a 120 mph airstream velocity. Thus, the above mentioned normalized aerodynamic drag force of less than 1.5 lbf when exposed to a 100 mph wind is the actual measured drag force at the indicated 100 mph airstream velocity multiplied by the square of the reference velocity, which is 120 mph, then divided by the square of the actual airstream velocity, which is 100 mph.

Figure 7:
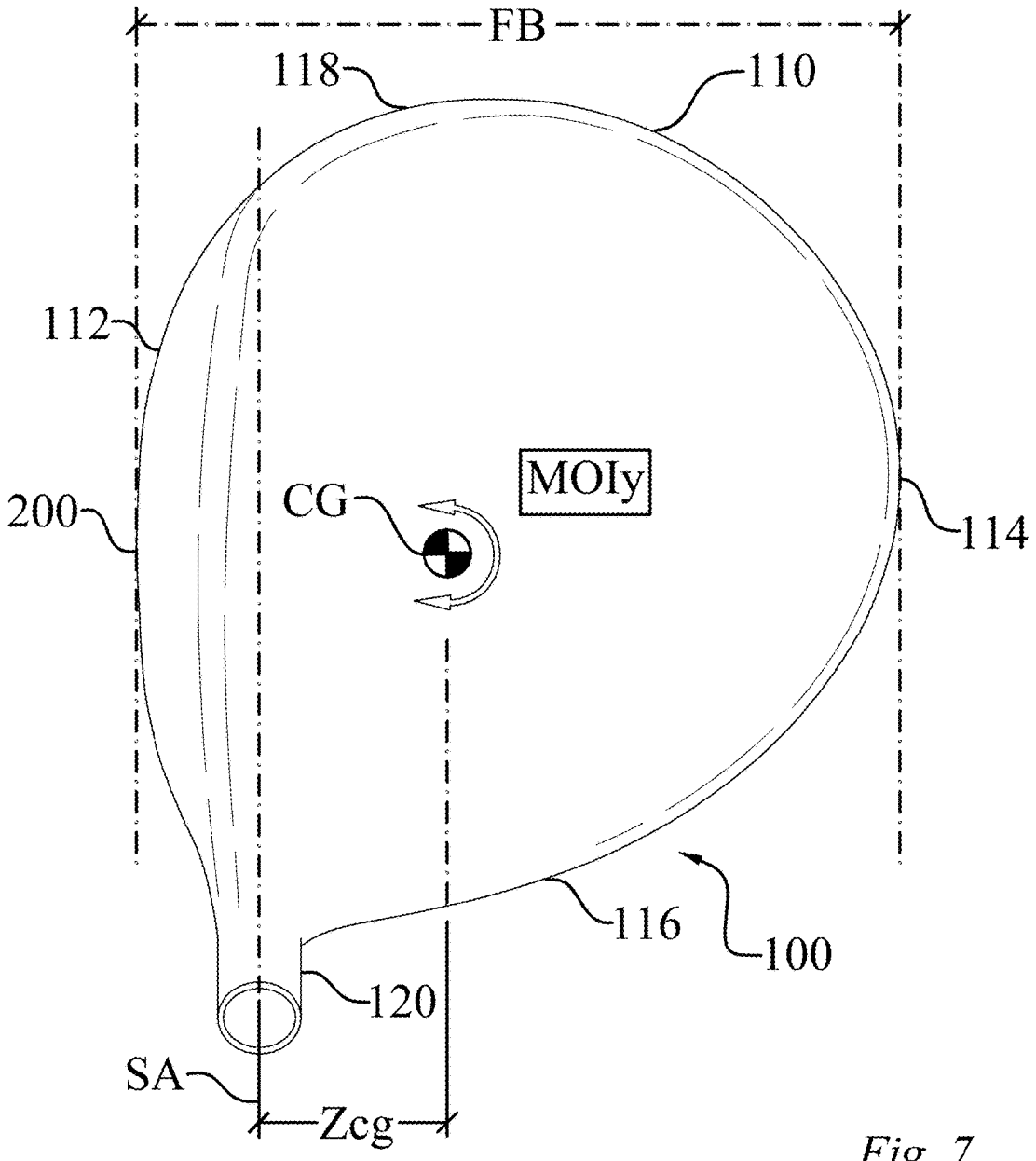
FIG. 7 shows a top plan view of a high volume aerodynamic golf club head, not to scale.
Figure 8:
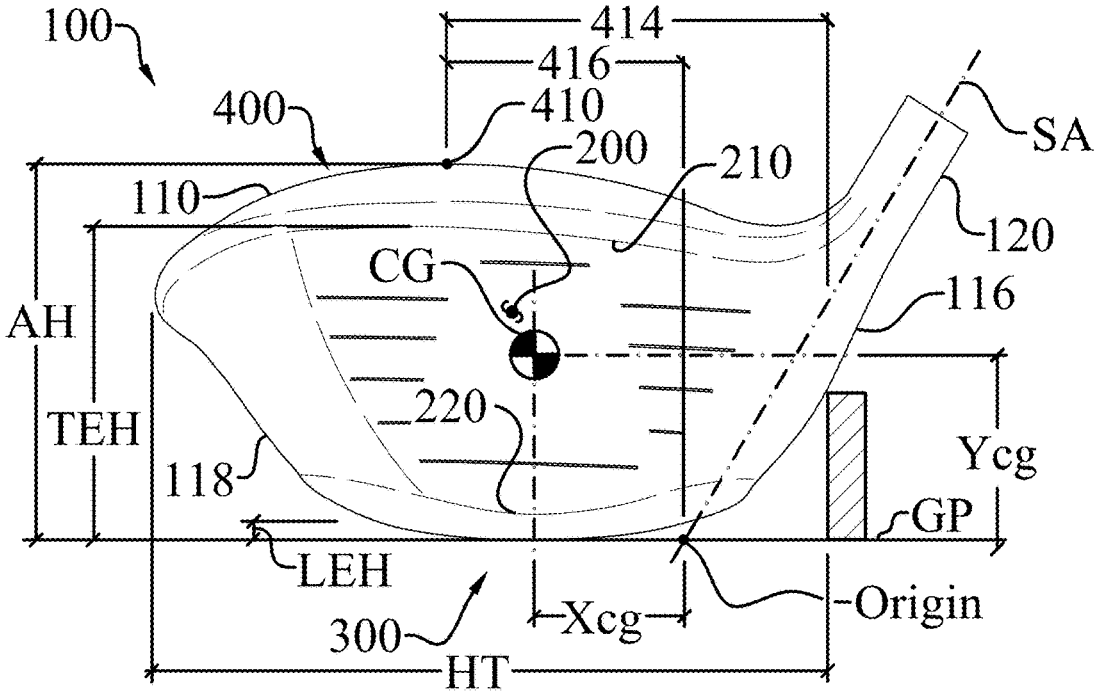
FIG. 8 shows a front elevation view of a high volume aerodynamic golf club head, not to scale.
Figure 9:
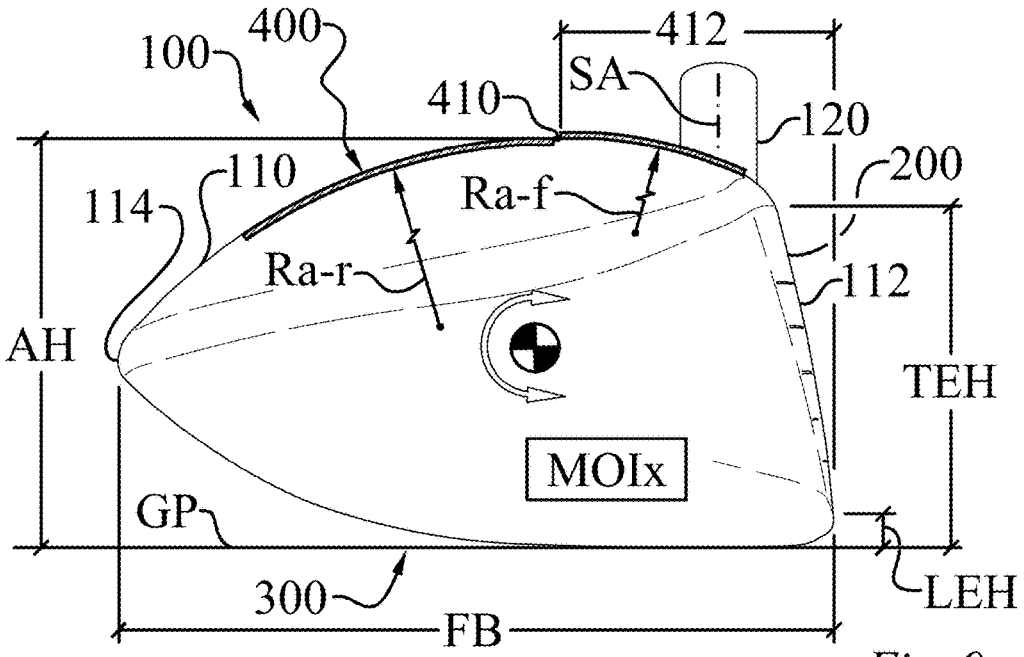
FIG. 9 shows a toe side elevation view of a high volume aerodynamic golf club head, not to scale.

With general reference to FIGS. 7-9, the high volume aerodynamic golf club head (100) includes a hollow body (110) having a face (200), a sole section (300), and a crown section (400). The hollow body (110) may be further defined as having a front (112), a back (114), a heel (116), and a toe (118). Further, the hollow body (110) has a front-to-back dimension (FB) of at least 4.4 inches, as previously defined and illustrated in FIG. 7.

The relatively large FB dimension of the present high volume aerodynamic golf club head (100) aids in obtaining beneficial moment of inertia values while also obtaining superior aerodynamic properties unseen by other large volume, large FB dimension, high MOI golf club heads. Specifically, an embodiment of the high volume aerodynamic golf club head (100) obtains a first moment of inertia (MOIy) about a vertical axis through a center of gravity (CG) of the golf club head (100), illustrated in FIG. 7, that is at least 4000 g*cm$^2$. MOIy is the moment of inertia of the golf club head (100) that resists opening and closing moments induced by ball strikes towards the toe side or heel side of the face. Further, this embodiment obtains a second moment of inertia (MOIx) about a horizontal axis through the center of gravity (CG), as seen in FIG. 9, that is at least 2000 g*cm$^2$. MOIx is the moment of inertia of the golf club head (100) that resists lofting and delofting moments induced by ball strikes high or low on the face (200).

Figure 10:
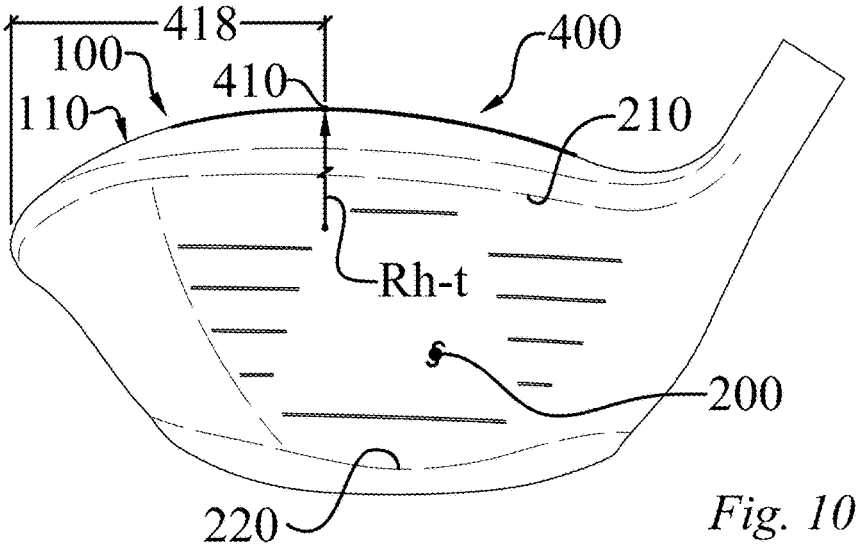
FIG. 10 shows a front elevation view of a high volume aerodynamic golf club head, not to scale.

The golf club head (100) obtains superior aerodynamic performance through the use of unique club head shapes. Referring now to FIG. 8, the crown section (400) has a crown apex (410) located an apex height (AH) above a ground plane (GP). The apex height (AH), as well as the location of the crown apex (410), play important roles in obtaining desirable airflow reattachment as close to the face (200) as possible, as well as improving the airflow attachment to the crown section (400). With reference now to FIGS. 9 and 10, the crown section (400) has three distinct radii that improve the aerodynamic performance of the present club head (100). First, as seen in FIG. 9, a portion of the crown section (400) between the crown apex (410) and the front (112) has an apex-to-front radius of curvature (Ra-f) that is less than 3 inches. The apex-to-front radius of curvature (Ra-f) is measured in a vertical plane that is perpendicular to a vertical plane passing through the shaft axis (SA), and the apex-to-front radius of curvature (Ra-f) is further measured at the point on the crown section (400) between the crown apex (410) and the front (112) that has the smallest the radius of curvature. In one particular embodiment, at least fifty percent of the vertical plane cross sections taken perpendicular to a vertical plane passing through the shaft axis (SA), which intersect a portion of a face top edge (210), are characterized by an apex-to-front radius of curvature (Ra-f) of less than 3 inches. In still a further embodiment, at least ninety percent of the vertical plane cross sections taken perpendicular to a vertical plane passing through the shaft axis (SA), which intersect a portion of the face top edge (210), are characterized by an apex-to-front radius of curvature (Ra-f) of less than 3 inches. In yet another embodiment, at least fifty percent of the vertical plane cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches. Still further, another embodiment has at least fifty percent of the vertical plane cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches.

The center of the face (200) shall be determined in accordance with the USGA "Procedure for Measuring the Flexibility of a Golf Clubhead," Revision 2.0, Mar. 25, 2005, which is incorporated herein by reference. This USGA procedure identifies a process for determining the impact location on the face of a golf club that is to be tested, also referred therein as the face center. The USGA procedure utilizes a template that is placed on the face of the golf club to determine the face center.

Secondly, a portion of the crown section (400) between the crown apex (410) and the back (114) of the hollow body (110) has an apex-to-rear radius of curvature (Ra-r) that is less than 3.75 inches. The apex-to-rear radius of curvature (Ra-r) is also measured in a vertical plane that is perpendicular to a vertical plane passing through the shaft axis (SA), and the apex-to-rear radius of curvature (Ra-r) is further measured at the point on the crown section (400) between the crown apex (410) and the back (114) that has the smallest the radius of curvature. In one particular embodiment, at least fifty percent of the vertical plane cross sections taken perpendicular to a vertical plane passing through the shaft axis (SA), which intersect a portion of the face top edge (210), are characterized by an apex-to-rear radius of curvature (Ra-r) of less than 3.75 inches. In still a further embodiment, at least ninety percent of the vertical plane cross sections taken perpendicular to a vertical plane passing through the shaft axis (SA), which intersect a portion of the face top edge (210), are characterized by an apex-to-rear radius of curvature (Ra-r) of less than 3.75 inches. In yet another embodiment, one hundred percent of the vertical plane cross sections taken perpendicular to a vertical plane passing through the shaft axis (SA), which intersect a portion of the face top edge (210) between the center of the face (200) and the toeward most point on the face (200), are characterized by an apex-to-rear radius of curvature (Ra-r) of less than 3.75 inches.

Lastly, as seen in FIG. 10, a portion of the crown section (400) has a heel-to-toe radius of curvature (Rh-t) at the crown apex (410) in a direction parallel to the vertical plane created by the shaft axis (SA) that is less than 4 inches. In a further embodiment, at least ninety percent of the crown section (400) located between the most heelward point on the face (200) and the most toeward point on the face (200) has a heel-to-toe radius of curvature (Rh-t) at the crown apex (410) in a direction parallel to the vertical plane created by the shaft axis (SA) that is less than 4 inches. A further embodiment has one hundred percent of the crown section (400) located between the most heelward point on the face (200) and the most toeward point on the face (200) exhibiting a heel-to-toe radius of curvature (Rh-t), at the crown apex (410) in a direction parallel to the vertical plane created by the shaft axis (SA), that is less than 4 inches.

Such small radii of curvature exhibited in the embodiments described herein have traditionally been avoided in the design of high volume golf club heads, especially in the design of high volume golf club heads having FB dimensions of 4.4 inches and greater. However, it is these tight radii produce a bulbous crown section (400) that facilitates airflow reattachment as close to the face (200) as possible, thereby resulting in reduced aerodynamic drag forces and facilitating higher club head speeds.

Conventional high volume large MOIy golf club heads having large FB dimensions, such as those seen in USPN D544939 and USPN D543600, have relatively flat crown sections that often never extend above the face. While these designs appear as though they should cut through the air, the opposite is often true with such shapes achieving poor airflow reattachment characteristics and increased aerodynamic drag forces. The present club head (100) has recognized the significance of proper club head shaping to account for rapid airflow reattachment in the crown section (400) trailing the face (200), which is quite the opposite of the flat steeply sloped crown sections of many prior art large FB dimension club heads.

With reference now to FIG. 10, the face (200) has a top edge (210) and a lower edge (220). Further, as seen in FIGS. 8 and 9, the top edge (210) has a top edge height (TEH) that is the elevation of the top edge (210) above the ground plane (GP). Similarly, the lower edge (220) has a lower edge height (LEH) that is the elevation of the lower edge (220) above the ground plane (GP). The highest point along the top edge (210) produces a maximum top edge height (TEH) that is at least 2 inches. Similarly, the lowest point along the lower edge (220) is a minimum lower edge height (LEH).

Figure 26A:
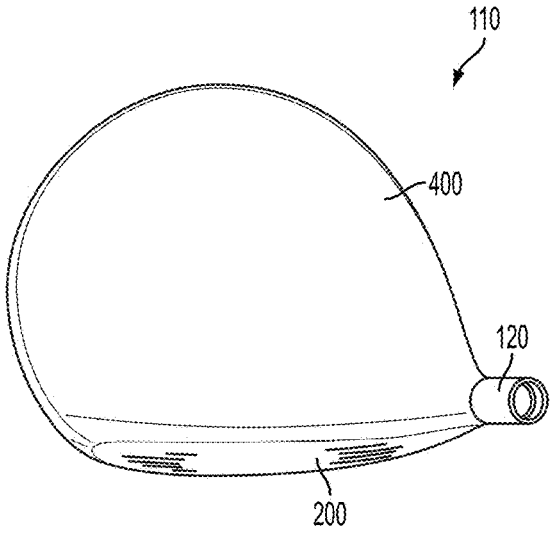
FIGS. 26A-C show respective orthogonal views depicting a high volume aerodynamic golf club head having a face and depicting a manner in which the face transitions into the contour of the body of the club head, not to scale.
Figure 26B:
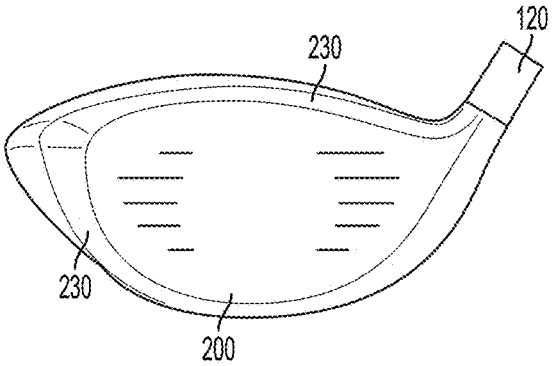
Figure 26C:
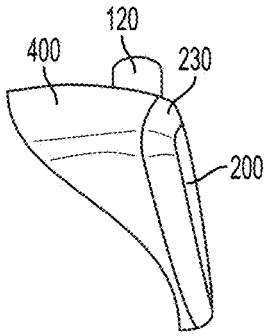

The top edge (210) and lower edge (220) are identifiable as curves that mark a transition from the curvature of the face (200) to adjoining regions of the club head (100), such as the crown section (400), the sole section (300), or a transition region (230) between the face (200) and the crown section (400) or sole section (300) (see, e.g., FIGS. 26B-C). To identify the top edge (210) and lower edge (220) on an actual golf club head, a three-dimensional scanned image of the club head (100) may be analyzed and a best fit approximation of the roll curvature in a plane containing the crown apex (410) may be determined for the face (200) based upon the location of all scanned points that are within 22 mm above and below the face center. Within a given vertical plane that is normal to the face (200), the top edge (210) is then identified in the scanned data as the lowermost point above the face center at which the scanned data deviates by more than a threshold amount (e.g., 0.1 mm) from the best fit roll curvature, and the lower edge (220) is identified as the uppermost point below the face center at which the scanned data deviates by more than the threshold amount from the best fit roll curvature.

One of many significant advances of this embodiment of the present club head (100) is the design of an apex ratio that encourages airflow reattachment on the crown section (400) of the golf club head (100) as close to the face (200) as possible. In other words, the sooner that airflow reattachment is achieved, the better the aerodynamic performance and the smaller the aerodynamic drag force. The apex ratio is the ratio of apex height (AH) to the maximum top edge height (TEH). As previously explained, in many large FB dimension golf club heads the apex height (AH) is no more than the top edge height (TEH). In this embodiment, the apex ratio is at least 1.13, thereby encouraging airflow reattachment as soon as possible.

Figure 13:
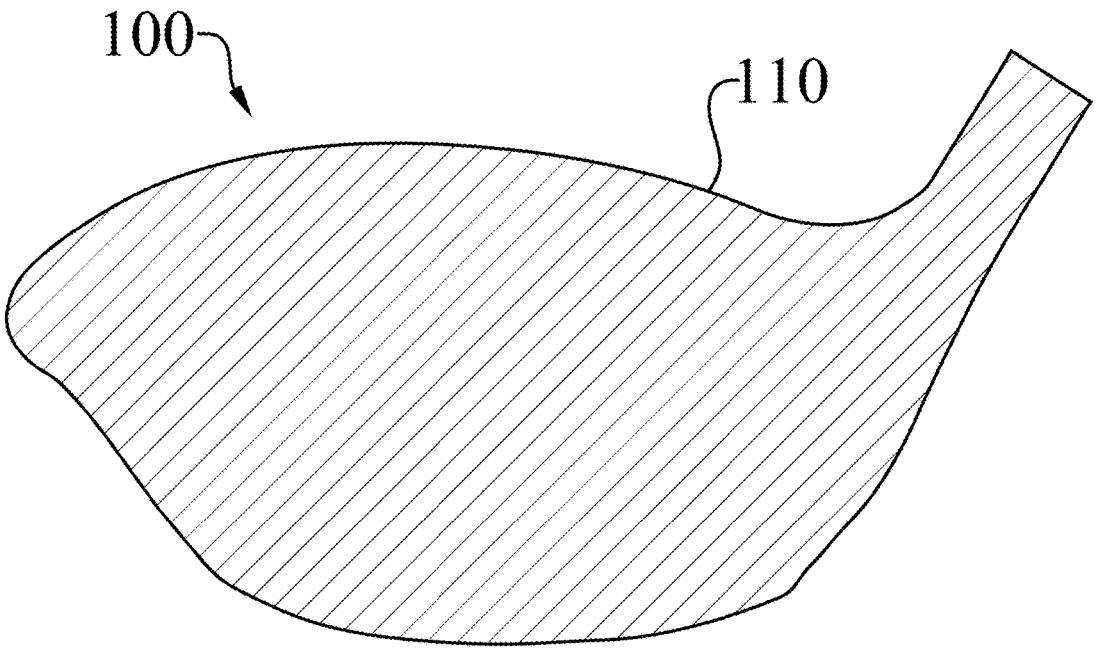
FIG. 13 shows a front elevation view of a high volume aerodynamic golf club head, not to scale.

Still further, this embodiment of the club head (100) has a frontal cross sectional area that is less than 11 square inches. The frontal cross sectional area is the single plane area measured in a vertical plane bounded by the outline of the golf club head (100) when it is resting on the ground plane (GP) at the design lie angle and viewed from directly in front of the face (200). The frontal cross sectional area is illustrated by the cross-hatched area of FIG. 13. It will be apparent to those skilled in the art that the "frontal cross sectional area" described here and illustrated in FIG. 13 is a different parameter from the "projected area of the face portion" ($A_f$) described and defined below in reference to FIGS. 26-31.

Figure 11:
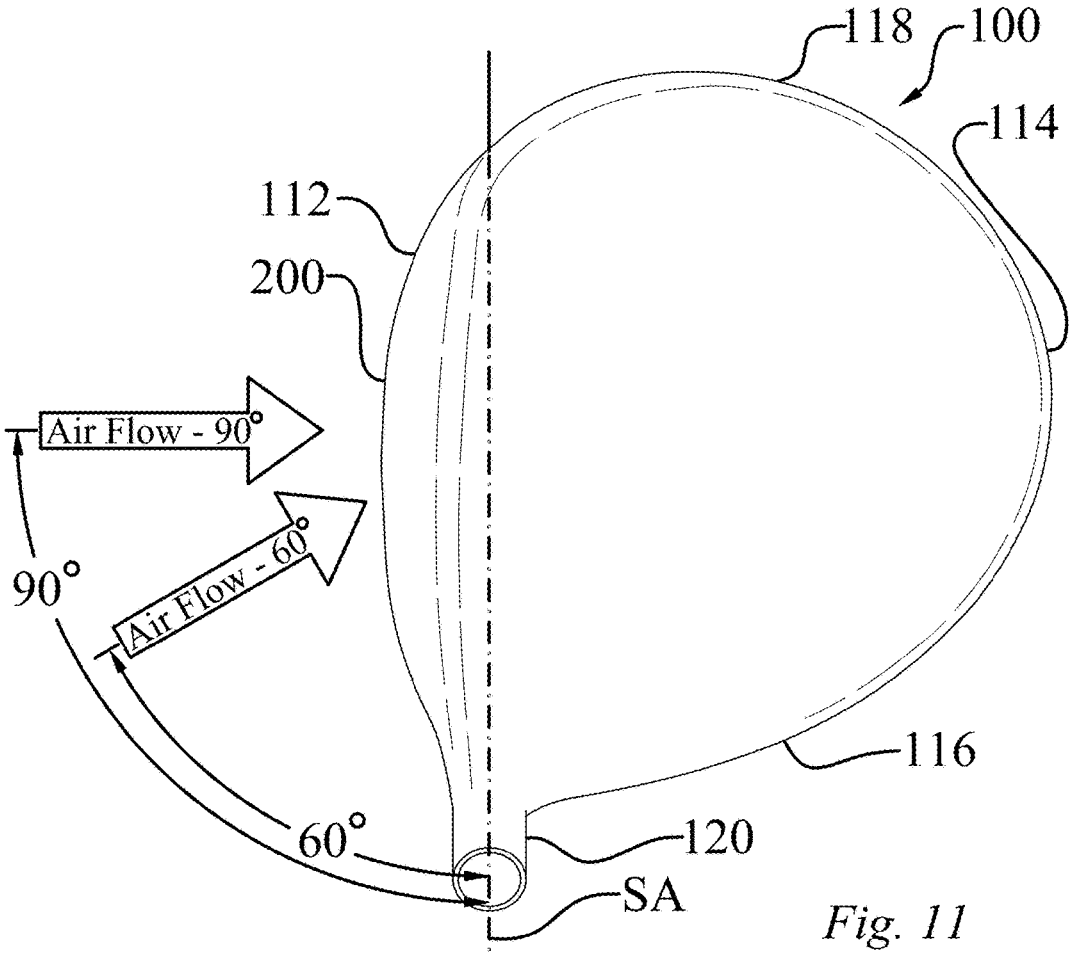
FIG. 11 shows a top plan view of a high volume aerodynamic golf club head, not to scale.

In a further embodiment, a second aerodynamic drag force is introduced, namely the 30 degree offset aerodynamic drag force, as previously explained with reference to FIG. 11. In this embodiment the 30 degree offset normalized aerodynamic drag force is less than 1.3 lbf when exposed to a 100 mph wind parallel to the ground plane (GP) when the high volume aerodynamic golf club head (100) is positioned in a design orientation and the wind is oriented thirty degrees from a vertical plane normal to the face (200) with the wind originating from the heel (116) side of the high volume aerodynamic golf club head (100). In addition to having the face-on normalized aerodynamic drag force less than 1.5 lbf, introducing a 30 degree offset normalized aerodynamic drag force of less than 1.3 lbf further reduces the drop in club head speed associated with large volume, large FB dimension golf club heads.

Figure 12:
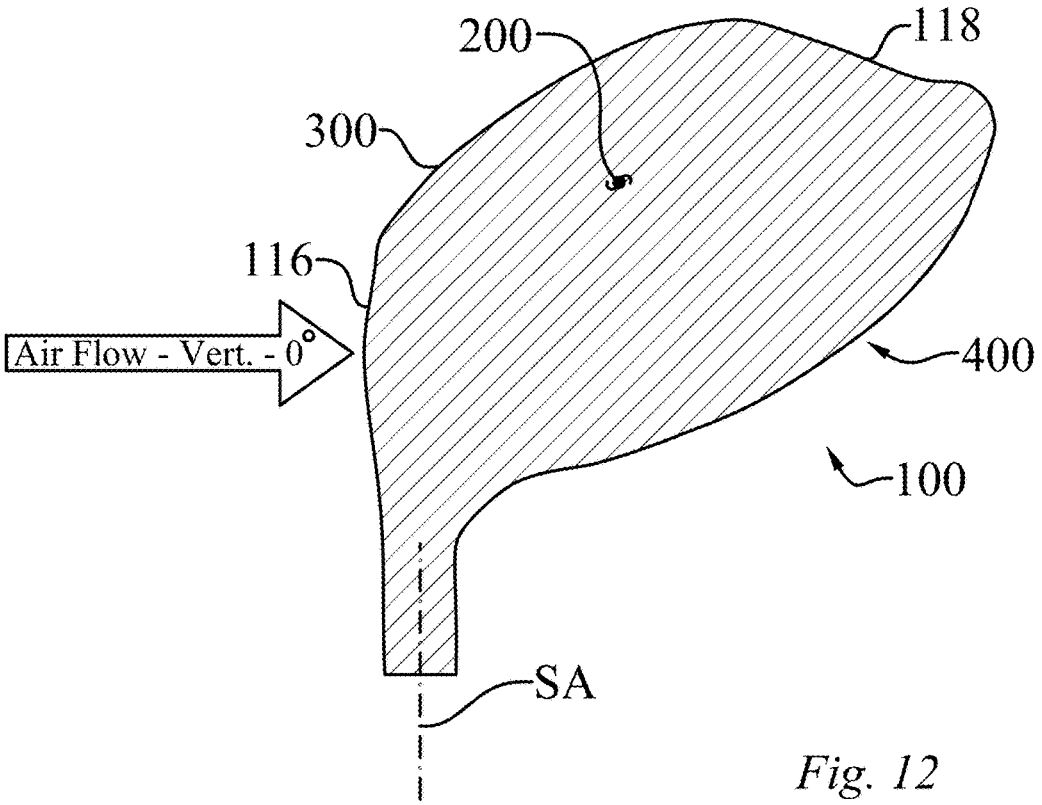
FIG. 12 shows a rotated front elevation view of a high volume aerodynamic golf club head with a vertical shaft axis orientation, not to scale.

Yet another embodiment introduces a third aerodynamic drag force, namely the heel normalized aerodynamic drag force, as previously explained with reference to FIG. 12. In this particular embodiment, the heel normalized aerodynamic drag force is less than 1.9 lbf when exposed to a horizontal 100 mph wind directed at the heel (116) with the body (110) oriented to have a vertical shaft axis (SA). In addition to having the face-on normalized aerodynamic drag force of less than 1.5 lbf and the 30 degree offset normalized aerodynamic drag force of less than 1.3 lbf, having a heel normalized aerodynamic drag force of less than 1.9 lbf further reduces the drop in club head speed associated with large volume, large FB dimension golf club heads.

A still further embodiment has recognized that having the apex-to-front radius of curvature (Ra-f) at least 25% less than the apex-to-rear radius of curvature (Ra-r) produces a particularly aerodynamic golf club head (100) further assisting in airflow reattachment and preferred airflow attachment over the crown section (400). Yet another embodiment further encourages quick airflow reattachment by incorporating an apex ratio of the apex height (AH) to the maximum top edge height (TEH) that is at least 1.2. This concept is taken even further in yet another embodiment in which the apex ratio of the apex height (AH) to the maximum top edge height (TEH) is at least 1.25. Again, these large apex ratios produce a bulbous crown section (400) that facilitates airflow reattachment as close to the face (200) as possible, thereby resulting in reduced aerodynamic drag forces and resulting in higher club head speeds.

Reducing aerodynamic drag by encouraging airflow reattachment, or conversely discouraging extended lengths of airflow separation, may be further obtained in yet another embodiment in which the apex-to-front radius of curvature (Ra-f) is less than the apex-to-rear radius of curvature (Ra-r), and the apex-to-rear radius of curvature (Ra-r) is less than the heel-to-toe radius of curvature (Rh-t). Such a shape is contrary to conventional high volume, long FB dimension golf club heads, yet produces a particularly aerodynamic shape.

Taking this embodiment a step further in another embodiment, a high volume aerodynamic golf club head (100) having the apex-to-front radius of curvature (Ra-f) less than 2.85 inches and the heel-to-toe radius of curvature (Rh-t) less than 3.85 inches produces a reduced face-on aerodynamic drag force. Another embodiment focuses on the playability of the high volume aerodynamic golf club head (100) by having a maximum top edge height (TEH) that is at least 2 inches, thereby ensuring that the face area is not reduced to an unforgiving level. Even further, another embodiment incorporates a maximum top edge height (TEH) that is at least 2.15 inches, further instilling confidence in the golfer that they are not swinging a golf club head (100) with a small striking face (200).

The foregoing embodiments may be utilized having even larger FB dimensions. For example, the previously described aerodynamic attributes may be incorporated into an embodiment having a front-to-back dimension (FB) that is at least 4.6 inches, or even further a front-to-back dimension (FB) that is at least 4.75 inches. These embodiments allow the high volume aerodynamic golf club head (100) to obtain even higher MOIy values without reducing club head speed due to excessive aerodynamic drag forces.

Yet a further embodiment balances all of the radii of curvature requirements to obtain a high volume aerodynamic golf club head (100) while minimizing the risk of an unnatural appearing golf club head by ensuring that less than 10% of the club head volume is above the elevation of the maximum top edge height (TEH). A further embodiment accomplishes the goals herein with a golf club head (100) having between 5% to 10% of the club head volume located above the elevation of the maximum top edge height (TEH). This range achieves the desired crown apex (410) and radii of curvature to ensure desirable aerodynamic drag while maintaining an aesthetically pleasing look of the golf club head (100).

The location of the crown apex (410) is dictated to a degree by the apex-to-front radius of curvature (Ra-f); however, yet a further embodiment identifies that the crown apex (410) should be behind the forwardmost point on the face (200) a distance that is a crown apex setback dimension (412), seen in FIG. 9, which is greater than 10% of the FB dimension and less than 70% of the FB dimension, thereby further reducing the period of airflow separation and resulting in desirable airflow over the crown section (400). One particular embodiment within this range incorporates a crown apex setback dimension (412) that is less than 1.75 inches. An even further embodiment balances playability with the volume shift toward the face (200) inherent in the present club head (100) by positioning the performance mass to produce a center of gravity (CG) further away from the forwardmost point on the face (200) than the crown apex setback dimension (412).

Additionally, the heel-to-toe location of the crown apex (410) also plays a significant role in the aerodynamic drag force. The location of the crown apex (410) in the heel-to-toe direction is identified by the crown apex ht dimension (414), as seen in FIG. 8. This figure also introduces a heel-to-toe (HT) dimension which is measured in accordance with USGA rules. The location of the crown apex (410) is dictated to a degree by the heel-to-toe radius of curvature (Rh-t); however, yet a further embodiment identifies that the crown apex (410) location should result in a crown apex ht dimension (414) that is greater than 30% of the HT dimension and less than 70% of the HT dimension, thereby aiding in reducing the period of airflow separation. In an even further embodiment, the crown apex (410) is located in the heel-to-toe direction between the center of gravity (CG) and the toe (118).

The present high volume aerodynamic golf club head (100) has a club head volume of at least 400 cc. Further embodiments incorporate the various features of the above described embodiments and increase the club head volume to at least 440 cc, or even further to the current USGA limit of 460 cc. However, one skilled in the art will appreciate that the specified radii and aerodynamic drag requirements are not limited to these club head sizes and apply to even larger club head volumes. Likewise, a heel-to-toe (HT) dimension of the present club head (100), as seen in FIG. 8, is greater than the FB dimension, as measured in accordance with USGA rules.

As one skilled in the art understands, the hollow body (110) has a center of gravity (CG). The location of the center of gravity (CG) is described with reference to an origin point, seen in FIG. 8. The origin point is the point at which a shaft axis (SA) with intersects with a horizontal ground plane (GP). The hollow body (110) has a bore having a center that defines the shaft axis (SA). The bore is present in club heads having traditional hosels, as well as hosel-less club heads. The center of gravity (CG) is located vertically toward the crown section (400) from the origin point a distance Ycg in a direction orthogonal to the ground plane (GP), as seen in FIG. 8. Further, the center of gravity (CG) is located horizontally from the origin point toward the toe (118) a distance Xcg that is parallel to a vertical plane defined by the shaft axis (SA) and parallel to the ground plane (GP). Lastly, the center of gravity (CG) is located a distance Zcg, seen in FIG. 14, from the origin point toward the back (114) in a direction orthogonal to the vertical direction used to measure Ycg and orthogonal to the horizontal direction used to measure Xcg.

Figure 16:
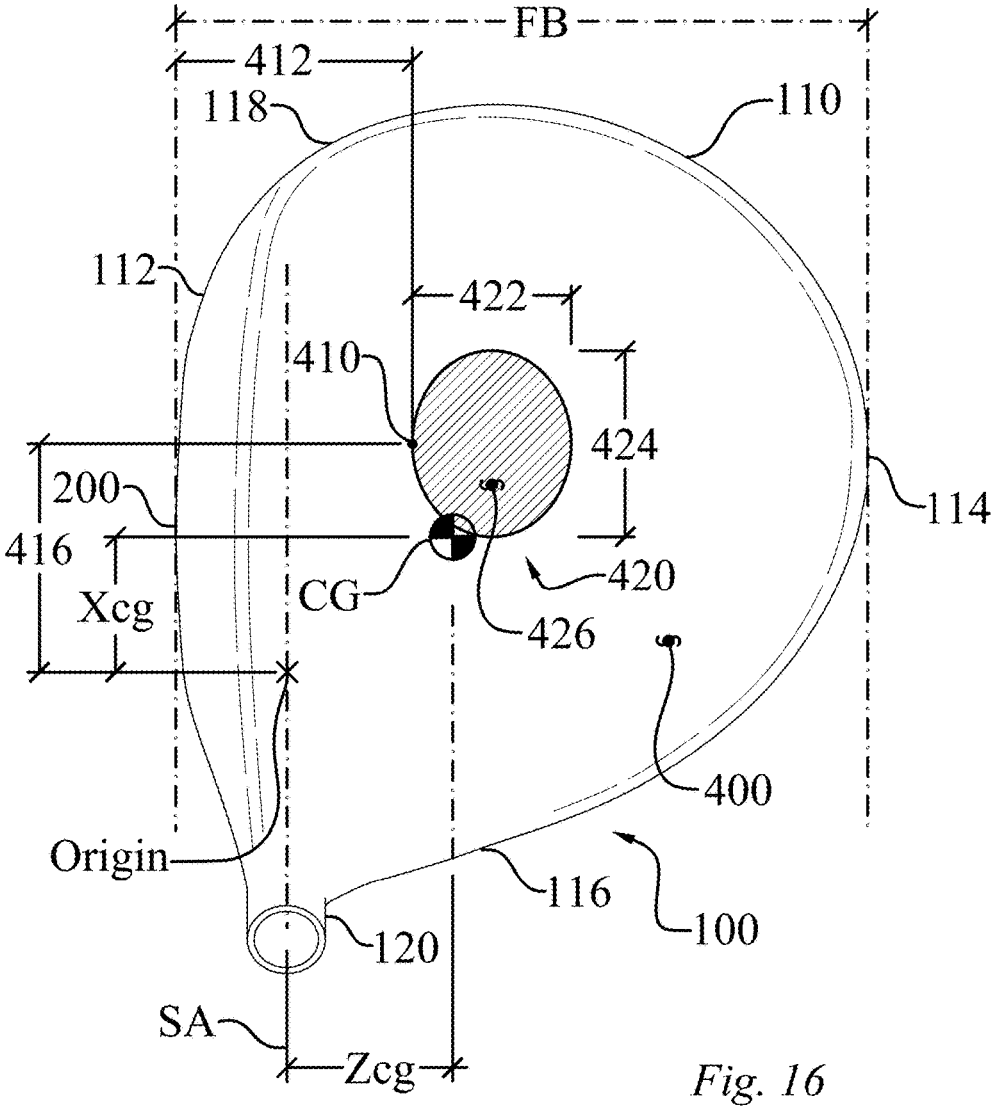
FIG. 16 shows a top plan view of a high volume aerodynamic golf club head having a post apex attachment promoting region, not to scale.
Figure 17:
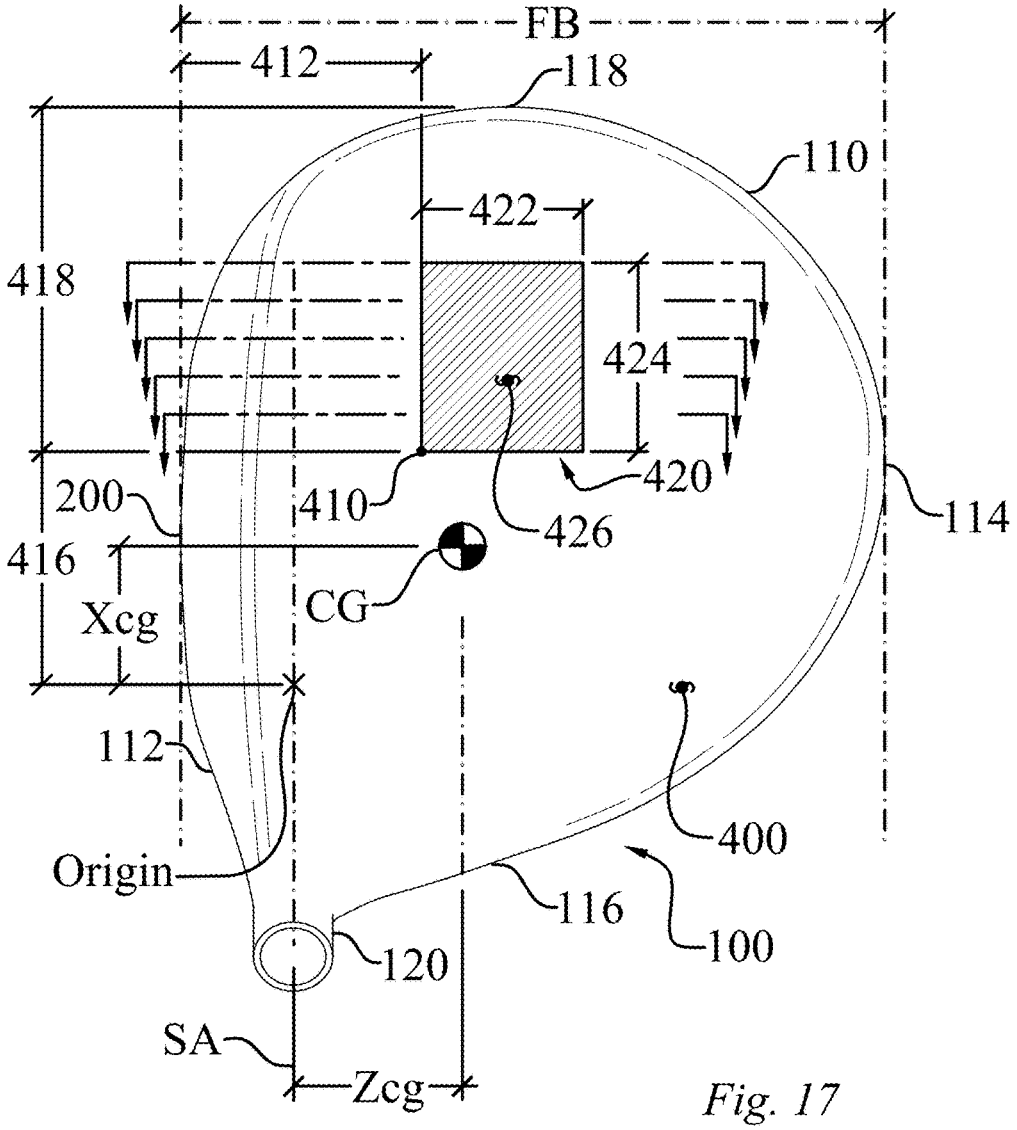
FIG. 17 shows a top plan view of a high volume aerodynamic golf club head having a post apex attachment promoting region, not to scale.
Figure 18:
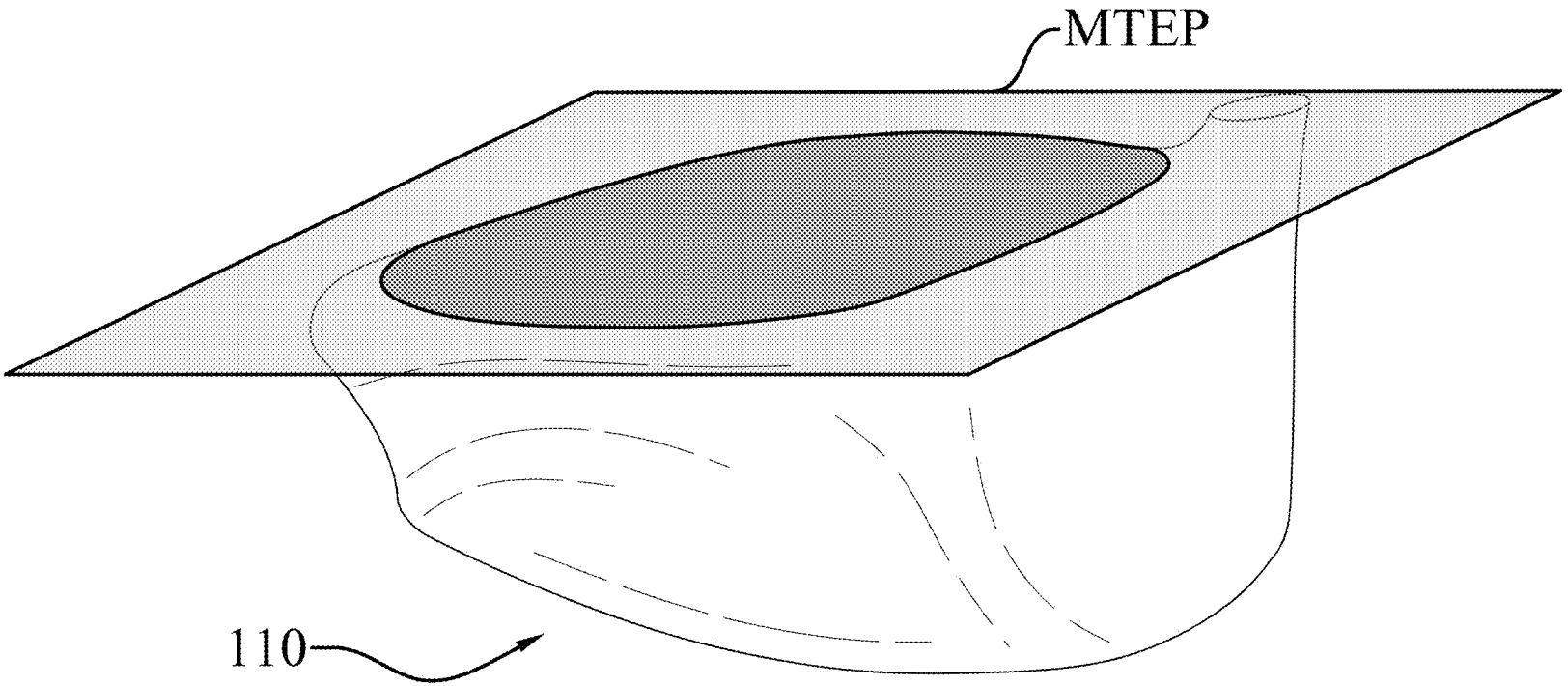
FIG. 18 shows a partial isometric view of a high volume aerodynamic golf club head having a post apex attachment promoting region intersected by the maximum top edge plane, not to scale.
Figure 19:
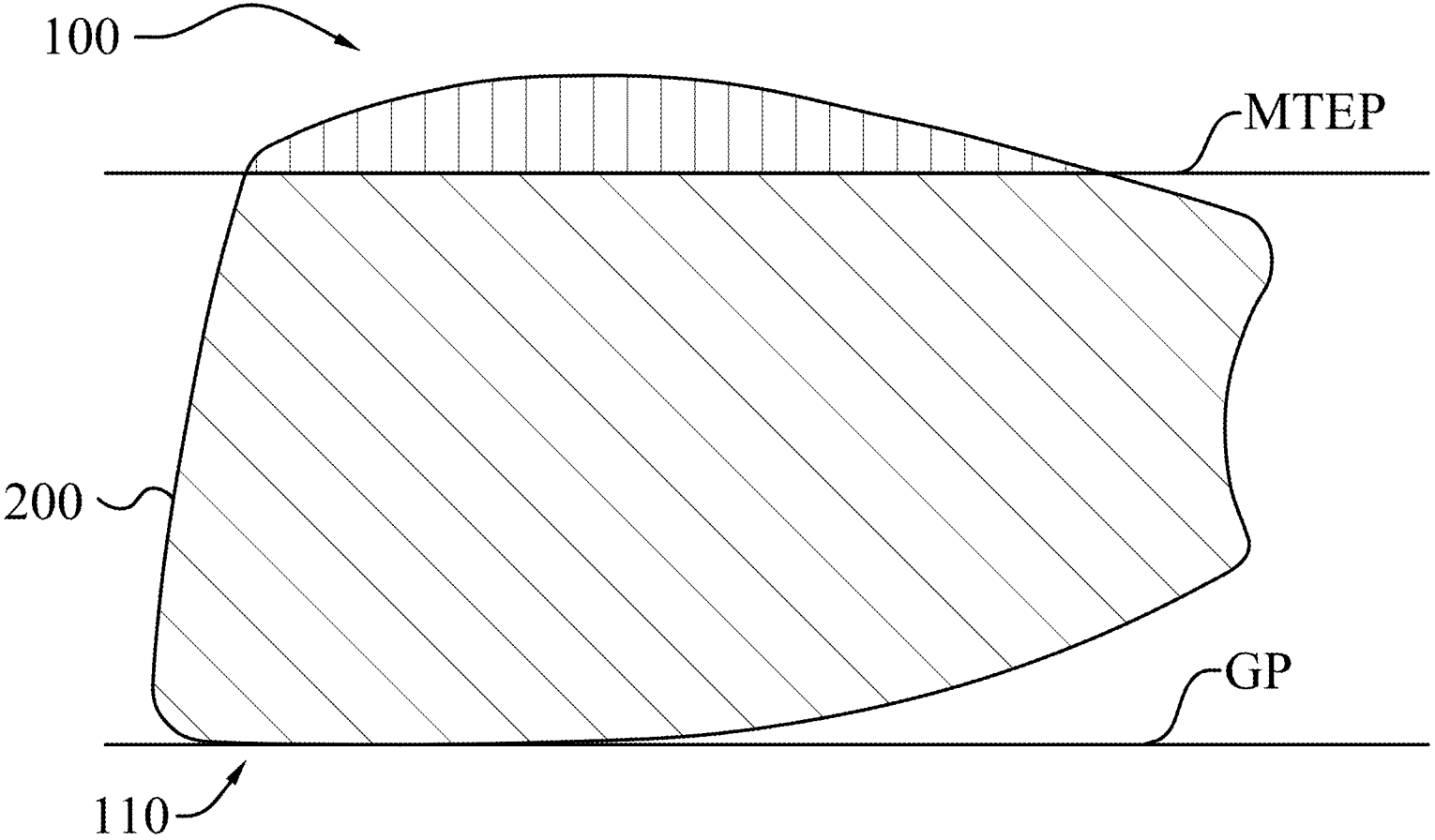
FIG. 19 shows a cross-sectional view taken through a center of the face of a high volume aerodynamic golf club head having a post apex attachment promoting region, not to scale.
Figure 20:
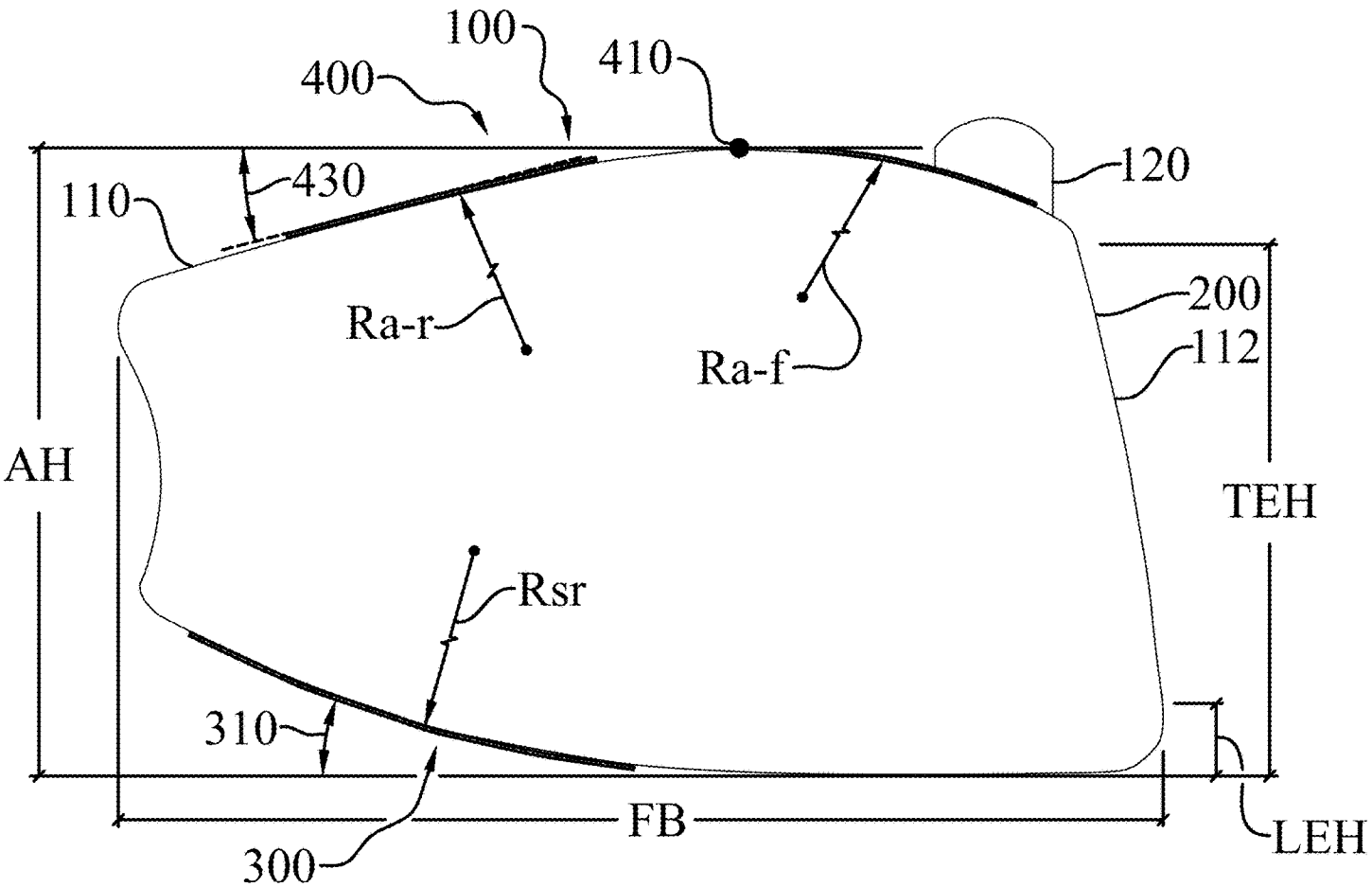
FIG. 20 shows a cross-sectional view taken through a center of the face of a high volume aerodynamic golf club head having a post apex attachment promoting region, not to scale.
Figure 21:
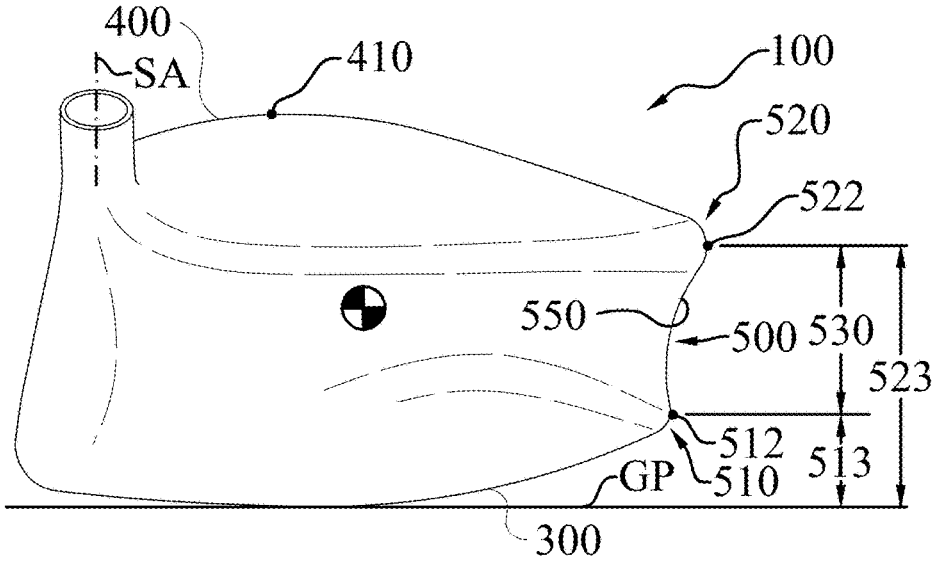
FIG. 21 shows a heel-side elevation view of a high volume aerodynamic golf club head having a post apex attachment promoting region, not to scale.
Figure 22:
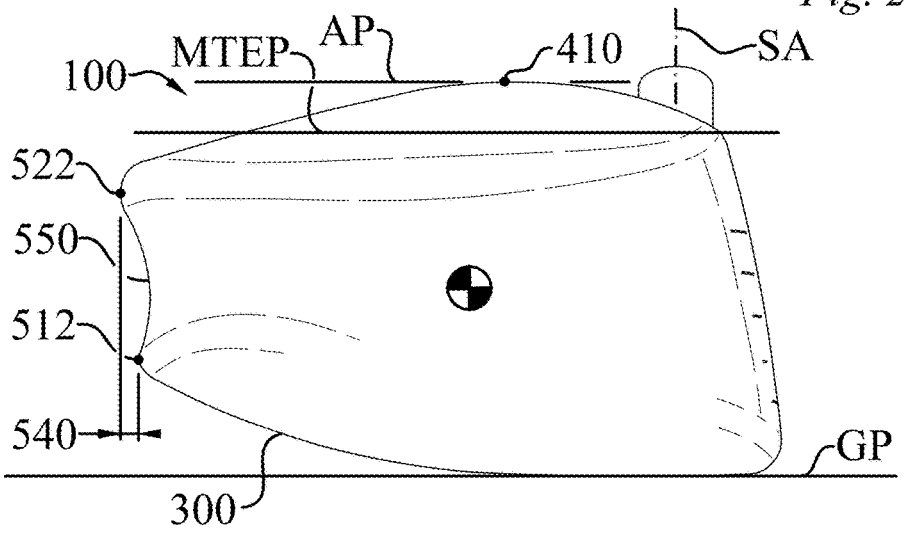
FIG. 22 shows a toe-side elevation view of a high volume aerodynamic golf club head having a post apex attachment promoting region, not to scale.

Several more embodiments, seen in FIGS. 14-25, incorporate a post apex attachment promoting region (420) on the surface of the crown section (400) at an elevation above a maximum top edge plane (MTEP), illustrated in FIGS. 18, 19, and 22, wherein the post apex attachment promoting region (420) begins at the crown apex (410) and extends toward the back (114) of the club head (100). The incorporation of this post apex attachment promoting region (420) creates a high volume aerodynamic golf club head having a post apex attachment promoting region (100) as seen in several embodiments in FIGS. 14-25. The post apex attachment promoting region (420) is a relatively flat portion of the crown section (400) that is behind the crown apex (410), yet above the maximum top edge plane (MTEP), and aids in keeping airflow attached to the club head (100) once it flows past the crown apex (410).

Figure 14:
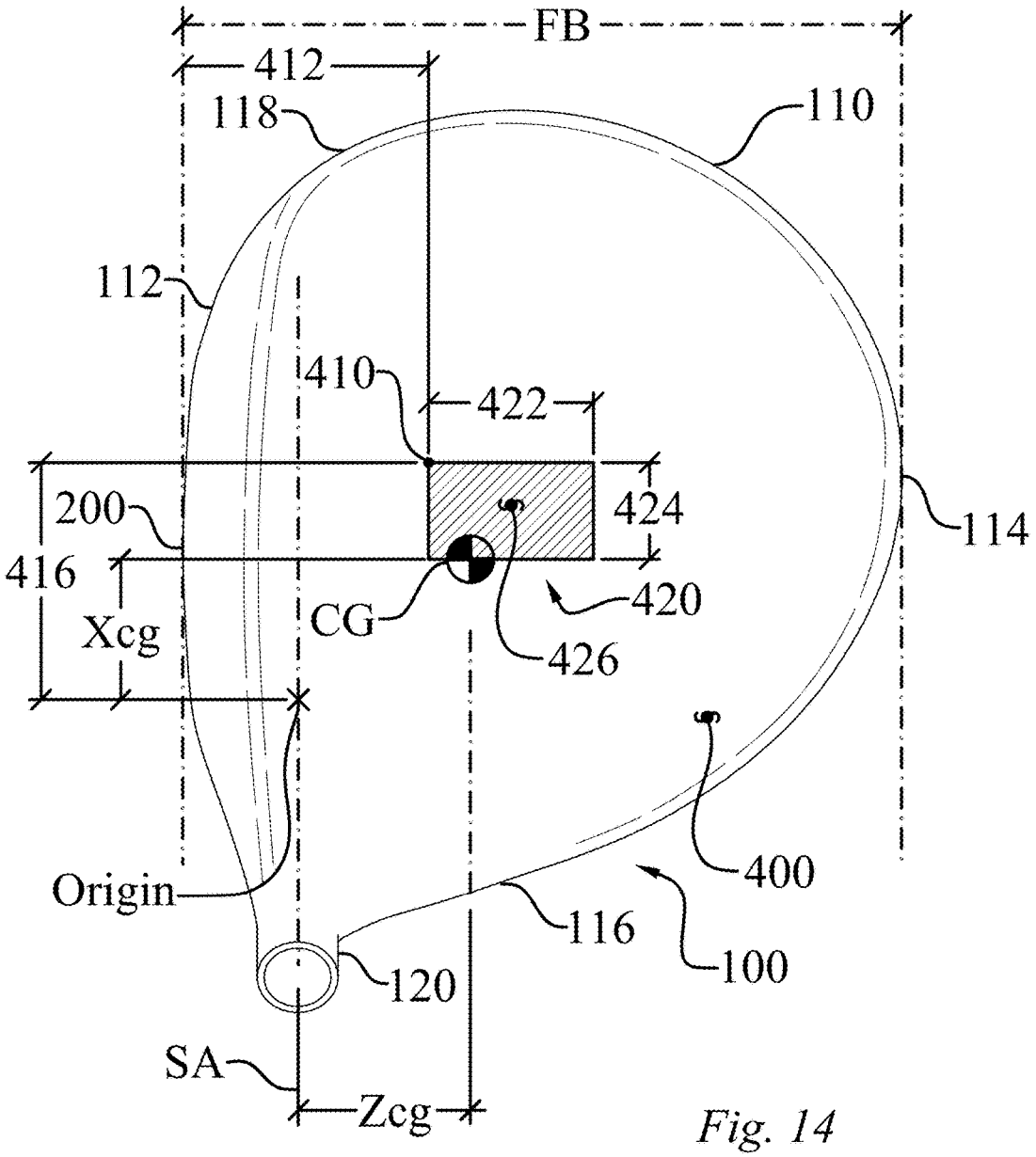
FIG. 14 shows a top plan view of a high volume aerodynamic golf club head having a post apex attachment promoting region, not to scale.

As with the prior embodiments, the embodiments containing the post apex attachment promoting region (420) include a maximum top edge height (TEH) of at least 2 inches and an apex ratio of the apex height (AH) to the maximum top edge height (TEH) of at least 1.13. As seen in FIG. 14, the crown apex (410) is located a distance from the origin point toward the toe (118) a crown apex x-dimension (416) distance that is parallel to the vertical plane defined by the shaft axis (SA) and parallel to the ground plane (GP).

In this particular embodiment, the crown section (400) includes a post apex attachment promoting region (420) on the surface of the crown section (400). Many of the previously described embodiments incorporate characteristics of the crown section (400) located between the crown apex (410) and the face (200) that promote airflow attachment to the club head (100) thereby reducing aerodynamic drag. The post apex attachment promoting region (420) is also aimed at reducing aerodynamic drag by encouraging the airflow passing over the crown section (400) to stay attached to the club head (100); however, the post apex attachment promoting region (420) is located between the crown apex (410) and the back (114) of the club head (100), while also being above the maximum top edge height (TEH), and thus above the maximum top edge plane (MTEP).

Many conventional high volume, large MOIy golf club heads having large FB dimensions have crown sections that often never extend above the face. Further, these prior clubs often have crown sections that aggressively slope down to the sole section. While these designs appear as though they should cut through the air, the opposite is often true with such shapes achieving poor airflow reattachment characteristics and increased aerodynamic drag forces. The present club head (100) has recognized the significance of proper club head shaping to account for rapid airflow reattachment in the crown section (400) trailing the face (200) via the apex ratio, as well as encouraging the to airflow remain attached to the club head (100) behind the crown apex (410) via the apex ratio and the post apex attachment promoting region (420).

With reference to FIG. 14, the post apex attachment promoting region (420) includes an attachment promoting region length (422) measured along the surface of the crown section (400) and orthogonal to the vertical plane defined by the shaft axis (SA). The attachment promoting region length (422) is at least as great as fifty percent of the crown apex setback dimension (412). The post apex attachment promoting region (420) also has an apex promoting region width (424) measured along the surface of the crown section (400) in a direction parallel to the vertical plane defined by the shaft axis (SA). The attachment promoting region width (424) is at least as great as the difference between the crown apex x-dimension (416) and the distance Xcg. The relationship of the attachment promoting region length (422) to the crown apex setback dimension (412) recognizes the natural desire of the airflow to separate from the club head (100) as it passes over the crown apex (410). Similarly, the relationship of the attachment promoting region width (424) to the difference between the crown apex x-dimension (416) and the distance Xcg recognizes the natural desire of the airflow to separate from the club head (100) as it passes over the crown apex (410) in a direction other than directly from the face (200) to the back (114). Incorporating a post apex attachment promoting region (420) that has the claimed length (422) and width (424) establishes the amount of the club head (100) that is above the maximum top edge plane (MTEP) and behind the crown apex (410). In the past many golf club heads sough to minimize, or eliminate, the amount of club head (100) that is above the maximum top edge plane (MTEP)

While the post apex attachment promoting region (420) has both a length (422) and a width (424), the post apex attachment promoting region (420) need not be rectangular in nature. For instance, FIG. 16 illustrates an elliptical post apex attachment promoting region (420) having both a length (422) and a width (424), which may be thought of as a major axis and a minor axis. Thus, the post apex attachment promoting region (420) may be in the shape of any polygon or curved object including, but not limited to, triangles (equilateral, scalene, isosceles, right, acute, obtuse, etc.), quadrilaterals (trapezoid, parallelogram, rectangle, square, rhombus, kite), polygons, circles, ellipses, and ovals. The post apex attachment promoting region (420) is simply an area on the surface of the crown section (400) possessing the claimed attributes, and one skilled in the art will recognize that it will blend into the rest of the crown section (400) and may be indistinguishable by the naked eye.

Like the previous embodiments having aerodynamic characteristics in front of the crown apex (410), the present embodiment incorporating the post apex attachment promoting region (420) located behind the crown apex (410) also has a face-on normalized aerodynamic drag force of less than 1.5 lbf when exposed to a 100 mph wind parallel to the ground plane (GP) when the high volume aerodynamic golf club head having a post apex attachment promoting region (100) is positioned in a design orientation and the wind is oriented at the front (112) of the high volume aerodynamic golf club head having a post apex attachment promoting region (100), as previously explained in detail.

In a further embodiment, a second aerodynamic drag force is introduced, namely the 30 degree offset aerodynamic drag force, as previously explained with reference to FIG. 11. In this embodiment the 30 degree offset normalized aerodynamic drag force is less than 1.3 lbf when exposed to a 100 mph wind parallel to the ground plane (GP) when the high volume aerodynamic golf club head having a post apex attachment promoting region (100) is positioned in a design orientation and the wind is oriented thirty degrees from a vertical plane normal to the face (200) with the wind originating from the heel (116) side of the high volume aerodynamic golf club head having a post apex attachment promoting region (100). In addition to having the face-on normalized aerodynamic drag force less than 1.5 lbf, introducing a 30 degree offset normalized aerodynamic drag force of less than 1.3 lbf further reduces the drop in club head speed associated with large volume, large FB dimension golf club heads.

Yet another embodiment introduces a third aerodynamic drag force, namely the heel normalized aerodynamic drag force, as previously explained with reference to FIG. 12. In this particular embodiment, the heel normalized aerodynamic drag force is less than 1.9 lbf when exposed to a horizontal 100 mph wind directed at the heel (116) with the body (110) oriented to have a vertical shaft axis (SA). In addition to having the face-on normalized aerodynamic drag force of less than 1.5 lbf and the 30 degree offset normalized aerodynamic drag force of less than 1.3 lbf, having a heel normalized aerodynamic drag force of less than 1.9 lbf further reduces the drop in club head speed associated with large volume, large FB dimension golf club heads.

Just as the embodiments that don't incorporate a post apex attachment promoting region (420) benefit from a relatively high apex ratio of the apex height (AH) to the maximum top edge height (TEH), so to do the embodiments incorporating a post apex attachment promoting region (420). After all, by definition the post apex attachment promoting region (420) is located above the maximum top edge plane (MTEP), which means that if the apex ratio is less than 1 then there can be no post apex attachment promoting region (420). An apex ratio of at least 1.13 provides for the height of the crown apex (410) that enables the incorporation of the post apex attachment promoting region (420) to reduce aerodynamic drag forces. Yet another embodiment further encourages airflow attachment behind the crown apex (410) by incorporating an apex ratio that is at least 1.2, thereby further increasing the available area on the crown section (400) above the maximum top edge height (TEH) suitable for a post apex attachment promoting region (420). The greater the amount of crown section (400) behind the crown apex (410), but above the maximum top edge height (TEH), and having the claimed attributes of the post apex attachment promoting region (420); the more likely the airflow is to remain attached to the club head (100) as it flows past the crown apex (410) and reduce the aerodynamic drag force.

With reference to FIGS. 14-17, in one of many embodiments the attachment promoting region length (422) is at least as great as seventy five percent of the crown apex setback dimension (412). As the attachment promoting region length (422) increases in proportion to the crown apex setback dimension (412), the amount of airflow separation behind the crown apex (410) is reduced. Further, as the attachment promoting region length (422) increases in proportion to the crown apex setback dimension (412), the geometry of the club head (100) is partially defined in that the amount of crown section (400) above the maximum top edge plane (MTEP) is set, thereby establishing the deviation of the crown section (400) from the crown apex (410) in the area behind the crown apex (410). Thus, at least a portion of the crown section (400) behind the crown apex (410) must be relatively flat, or deviate from an apex plane (AP), seen in FIG. 22, by less than twenty degrees thereby reducing the amount of airflow separation behind the crown apex (410).

Figure 15:
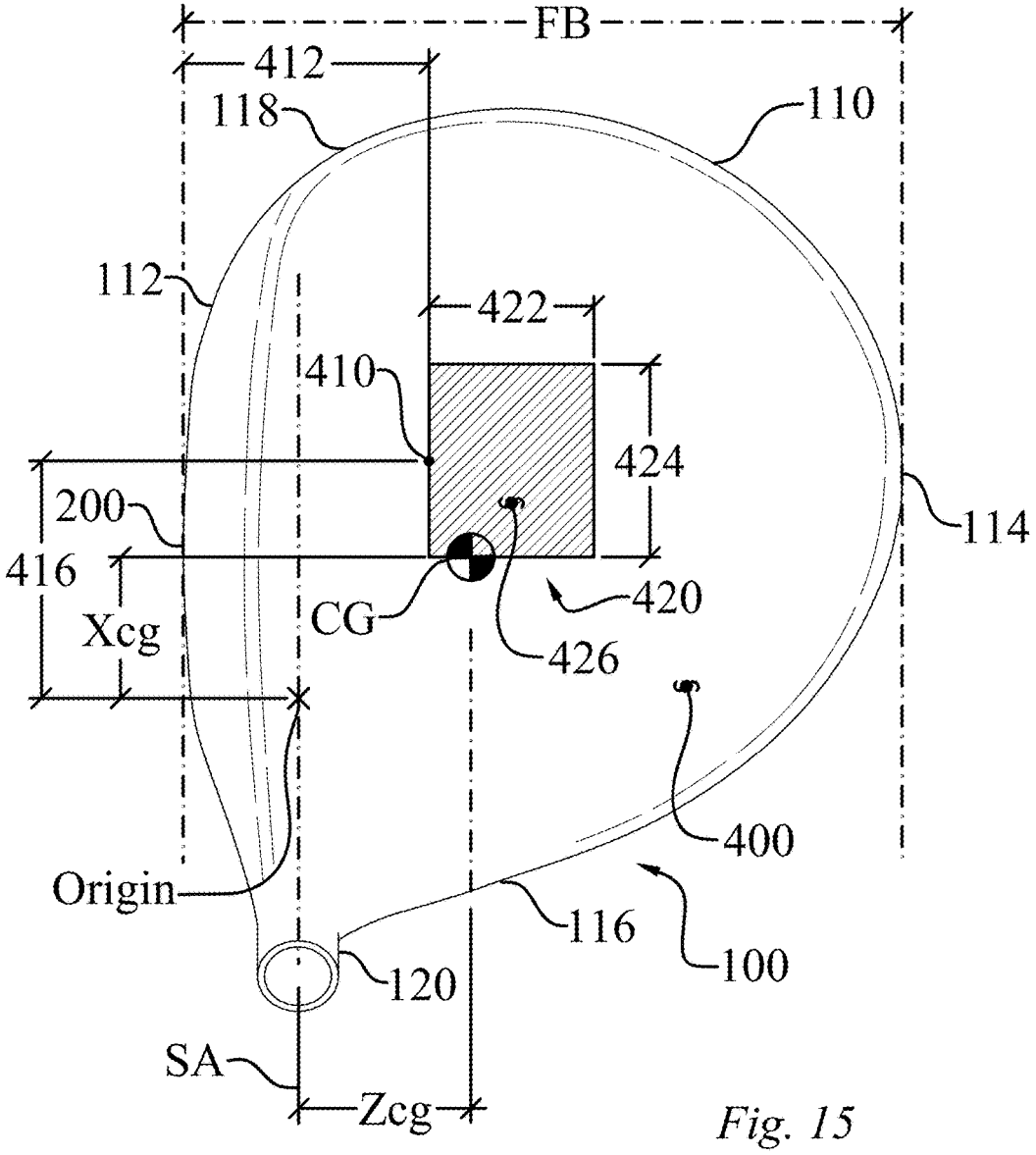
FIG. 15 shows a top plan view of a high volume aerodynamic golf club head having a post apex attachment promoting region, not to scale.

In a further embodiment seen in FIG. 15, the apex promoting region width (424) is at least twice as great as the difference between the crown apex x-dimension (416) and the distance Xcg. As the apex promoting region width (424) increases, more airflow coming over the crown apex (410) is exposed to the post apex attachment promoting region (420) further promoting airflow attachment to the club head (100) behind the crown apex (410) and reducing aerodynamic drag force.

Yet another embodiment focuses not solely on the size of the post apex attachment promoting region (420), but also on the location of it. It is helpful to define a new dimension to further characterize the placement of the post apex attachment promoting region (420); namely, as seen in FIG. 17, the hollow body (110) has a crown apex-to-toe dimension (418) measured from the crown apex (410) to the toewardmost point on the hollow body (110) in a direction parallel to the vertical plane defined by the shaft axis (SA) and parallel to the ground plane (GP). The present embodiment recognizes the significance of having the major portion of the crown section (400) between the crown apex (410) and the toe (118) incorporating a post apex attachment promoting region (420). Thus, in this embodiment, the post apex attachment promoting region width (424) is at least fifty percent of the crown apex-to-toe dimension (418). In a further embodiment, at least fifty percent of the crown apex-to-toe dimension (418) includes a portion of the post apex attachment promoting region (420). Generally it is easier to promote airflow attachment to the club head (100) on the crown section (400) behind the crown apex (410) in the region from the crown apex (410) to the toe (118), when compared to the region from the crown apex (410) to the heel (116), because of the previously explained airflow disruption associated with the hosel of the club head (100).

Another embodiment builds upon the post apex attachment promoting region (420) by having at least 7.5 percent of the club head volume located above the maximum top edge plane (MTEP), illustrated in FIG. 18. Incorporating such a volume above the maximum top edge plane (MTEP) increases the surface area of the club head (100) above the maximum top edge height (TEH) facilitating the post apex attachment promoting region (420) and reducing airflow separation between the crown apex (410) and the back (114) of the club head (100). Another embodiment, seen in FIG. 19, builds upon this relationship by incorporating a club head (100) design characterized by a vertical cross-section taken through the hollow body (110) at a center of the face (200) extending orthogonal to the vertical plane through the shaft axis (SA) has at least 7.5 percent of the cross-sectional area located above the maximum top edge plane (MTEP).

As previously mentioned, in order to facilitate the post apex attachment promoting region (420), at least a portion of the crown section (400) has to be relatively flat and not aggressively sloped from the crown apex (410) toward the ground plane (GP). In fact, in one embodiment, a portion of the post apex attachment promoting region (420) has an apex-to-rear radius of curvature (Ra-r), seen in FIG. 20, that is greater than 5 inches. In yet another embodiment, a portion of the post apex attachment promoting region (420) has an apex-to-rear radius of curvature (Ra-r) that is greater than both the bulge and the roll of the face (200). An even further embodiment has a portion of the post apex attachment promoting region (420) having an apex-to-rear radius of curvature (Ra-r) that is greater than 20 inches. These relatively flat portions of the post apex attachment promoting region (420), which is above the maximum top edge plane (MTEP), promote airflow attachment to the club head (100) behind the crown apex (410).

Further embodiments incorporate a post apex attachment promoting region (420) in which a majority of the cross sections taken from the face (200) to the back (114) of the club head (100), perpendicular to the vertical plane through the shaft axis (SA), which pass through the post apex attachment promoting region (420), have an apex-to-rear radius of curvature (Ra-r) that is greater than 5 inches. In fact, in one particular embodiment, at least seventy five percent of the vertical plane cross sections taken perpendicular to a vertical plane passing through the shaft axis (SA), which pass through the post apex attachment promoting region (420), are characterized by an apex-to-rear radius of curvature (Ra-r) that is greater than 5 inches within the post apex attachment promoting region (420); thereby further promoting airflow attachment between the crown apex (410) and the back (114) of the club head (100).

Another embodiment incorporates features that promote airflow attachment both in front of the crown apex (410) and behind the crown apex (410). In this embodiment, seen in FIG. 20, the previously described vertical plane cross sections taken perpendicular to a vertical plane passing through the shaft axis (SA), which pass through the post apex attachment promoting region (420), also have an apex-to-front radius of curvature (Ra-f) that is less than 3 inches, and wherein at least fifty percent of the vertical plane cross sections taken perpendicular to a vertical plane passing through the shaft axis (SA), which pass through the post apex attachment promoting region (420), are characterized by an apex-to-front radius of curvature (Ra-f) of at least 50% less than the apex-to-rear radius of curvature (Ra-r). This combination of a very curved crown section (400) from the crown apex (410) to the face (200), along with a relatively flat crown section (400) from the crown apex (410) toward the back (114), both being above the maximum top edge plane (MTEP), promotes airflow attachment over the crown section (400) and reduces aerodynamic drag force. Yet another embodiment takes this relationship further and increases the percentage of the vertical plane cross sections taken perpendicular to a vertical plane passing through the shaft axis (SA), previously discussed, to at least seventy five percent of the vertical plane cross sections taken perpendicular to a vertical plane passing through the shaft axis (SA); thus further promoting airflow attachment over the crown section (400) of the club head (100).

The attributes of the claimed crown section (400) tend to keep the crown section (400) distant from the sole section (300). One embodiment, seen in FIGS. 21 and 22, incorporates a skirt (500) connecting a portion of the crown section (400) to the sole section (300). The skirt (500) includes a skirt profile (550) that is concave within a profile region angle (552), seen in FIG. 25, originating at the crown apex (410) wherein the profile region angle (552) is at least 45 degrees. With specific reference to FIG. 21, the concave skirt profile (550) creates a skirt-to-sole transition region (510), also referred to as "SSTR," at the connection to the sole section (300) and the skirt-to-sole transition region (510) has a rearwardmost SSTR point (512) located above the ground plane (GP) at a rearwardmost SSTR point elevation (513). Similarly, a skirt-to-crown transition region (520), also referred to as "SSCR," is present at the connection to the crown section (400) and the skirt-to-crown transition region (520) has a rearwardmost SCTR point (522) located above the ground plane (GP) at a rearwardmost SCTR point elevation (523).

Figure 25:
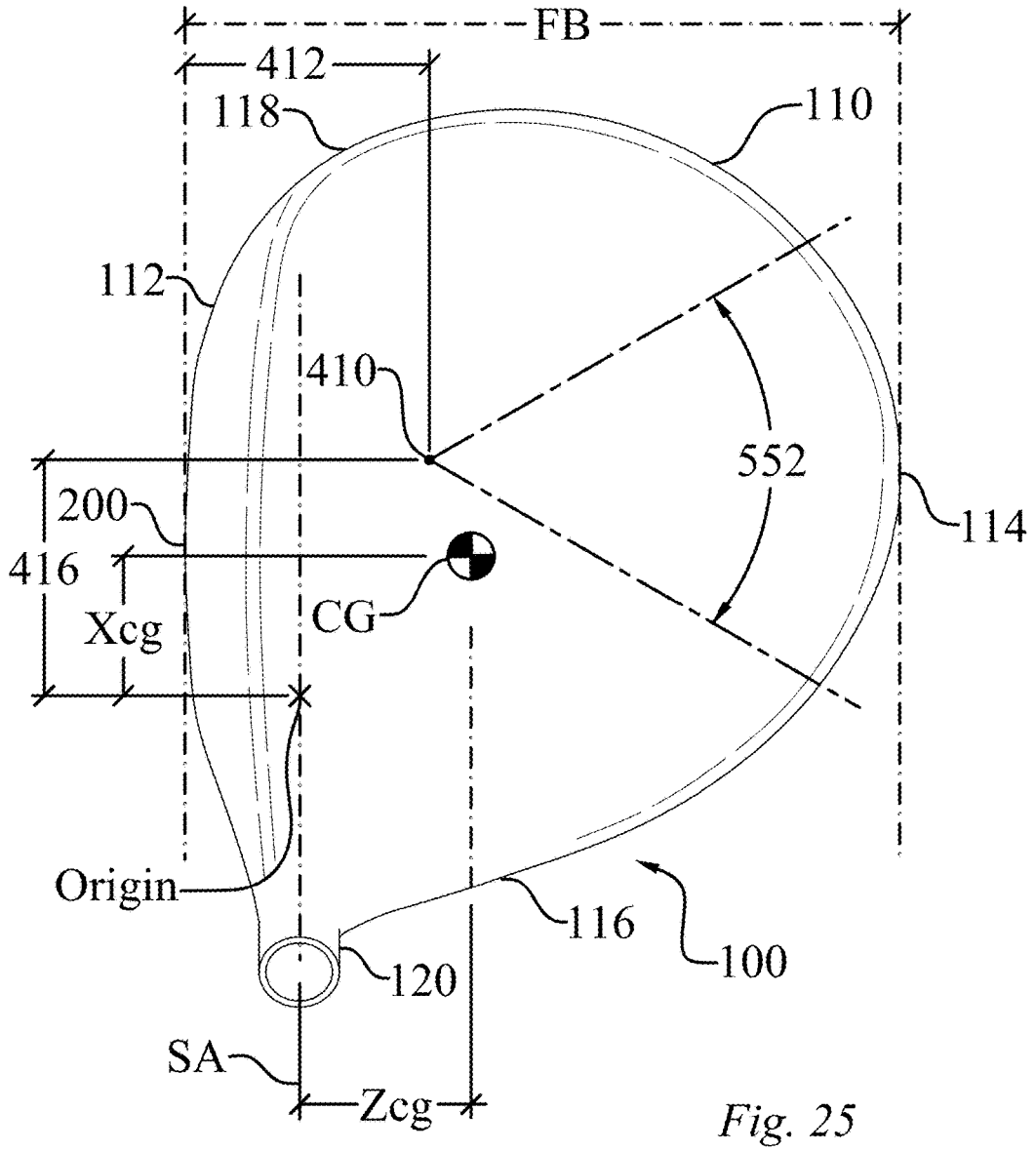
FIG. 25 shows a top plan view of a high volume aerodynamic golf club head having a post apex attachment promoting region, not to scale.

In this particular embodiment the rearwardmost SSTR point (512) and the rearwardmost SCTR point (522) need not be located vertically in-line with one another, however they are both located within the profile region angle (552) of FIG. 25. Referring again to FIG. 21, the rearwardmost SSTR point (512) and the rearwardmost SCTR point (522) are vertically separated by a vertical separation distance (530) that is at least thirty percent of the apex height (AH); while also being horizontally separated in a heel-to-toe direction by a heel-to-toe horizontal separation distance (545), seen in FIG. 23; and horizontally separated in a front-to-back direction by a front-to-back horizontal separation distance (540), seen in FIG. 22. This combination of relationships among the elements of the skirt (500) further promotes airflow attachment in that it establishes the location and elevation of the rear of the crown section (400), and thus a profile of the crown section (400) from the crown apex (410) to the back (114) of the club head (100). Further, another embodiment incorporating a rearwardmost SSTR point elevation (513) that is at least twenty five percent of the rearwardmost SCTR point elevation (523) defines a sole section (300) curvature that promotes airflow attachment on the sole section (300).

Figure 23:
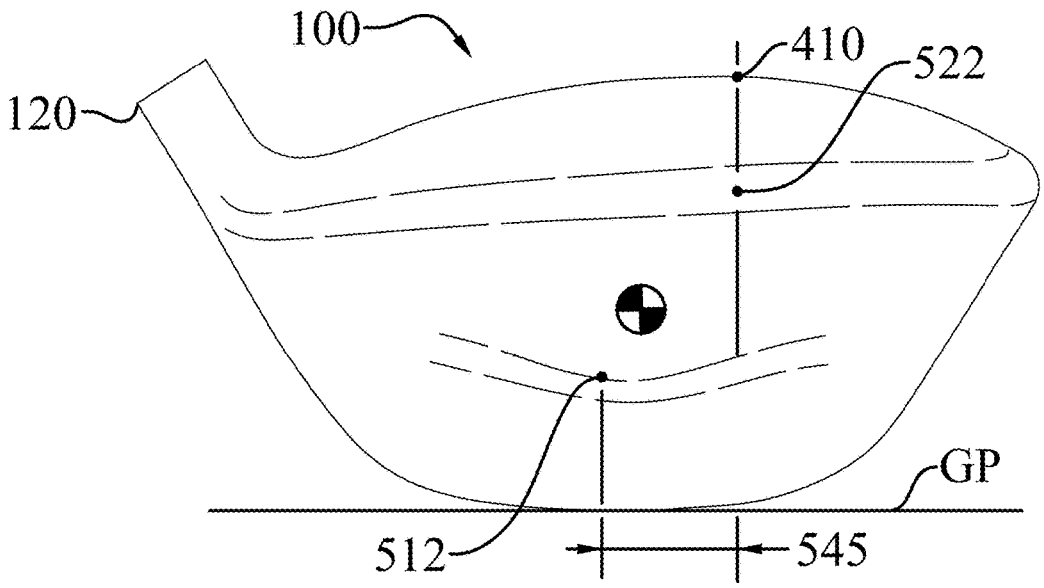
FIG. 23 shows a rear elevation view of a high volume aerodynamic golf club head having a post apex attachment promoting region, not to scale.
Figure 24:
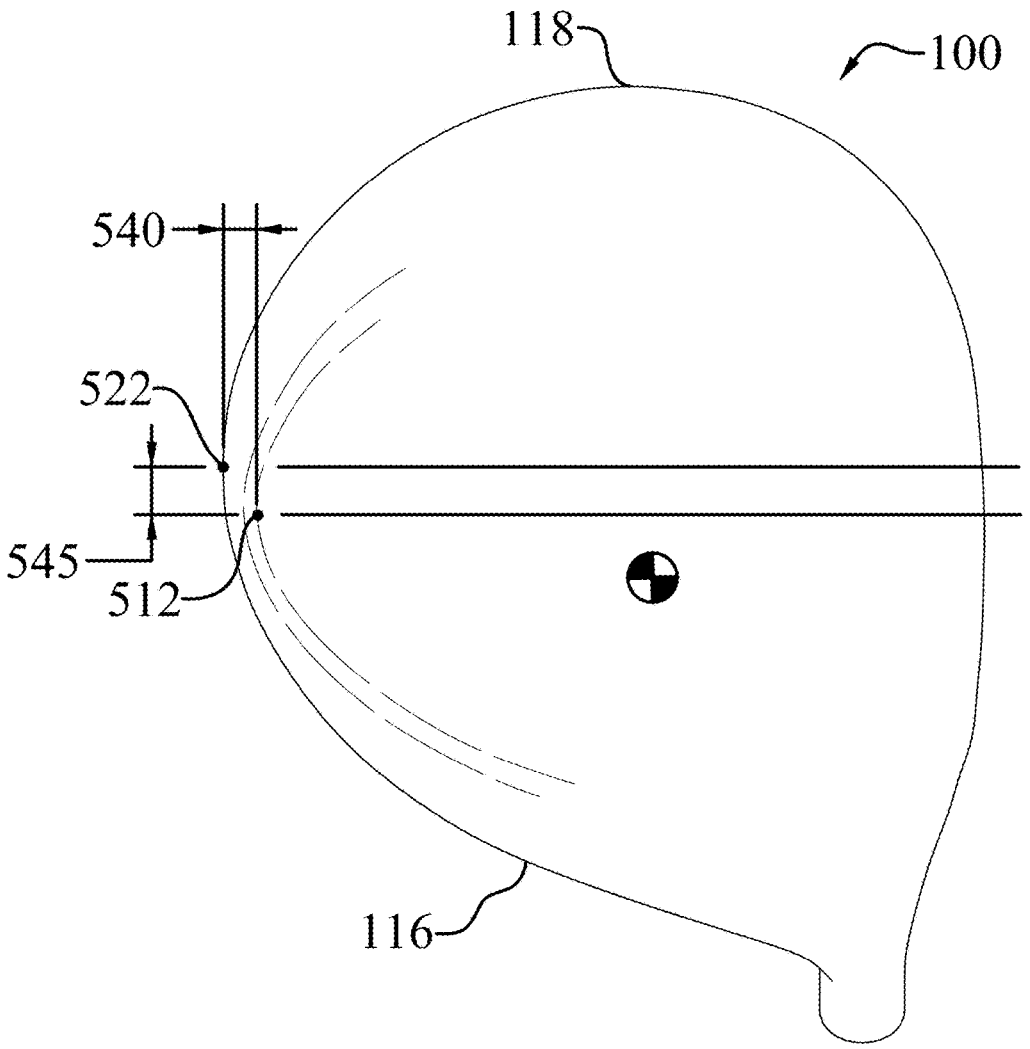
FIG. 24 shows a bottom plan view of a high volume aerodynamic golf club head having a post apex attachment promoting region, not to scale.

In a further embodiment, illustrated best in FIG. 23, the rearwardmost SCTR point (522) is substantially in-line vertically with the crown apex (410) producing the longest airflow path over the crown section (400) along the vertical cross section that passes through the crown apex (410) and thus maximizing the airflow attachment propensity of the crown section (400) design. Another variation incorporates a heel-to-toe horizontal separation distance (545) is at least at great as the difference between the crown apex x-dimension (416) and the distance Xcg. A further embodiment has the front-to-back horizontal separation distance (540) is at least thirty percent of the difference between the apex height (AH) and the maximum top edge height (TEH). These additional relationships further promote airflow attachment to the club head (100) by reducing the interference of other airflow paths with the airflow passing over the post apex attachment promoting region (420).

Another embodiment advancing this principle has the rearwardmost SSTR point (512) is located on the heel (116) side of the center of gravity, and the rearwardmost SCTR point (522) is located on the toe (118) side of the center of gravity, as seen in FIG. 23. An alternative embodiment has both the rearwardmost SSTR point and the rearwardmost SCTR point (522) located on the toe (118) side of the center of gravity, but offset by a heel-to-toe horizontal separation distance (545) that is at least as great as the difference between the apex height (AH) and the maximum top edge height (TEH).

Several more high volume aerodynamic golf club head embodiments, seen in and described by reference to FIGS. 26-40, incorporate a "face portion" having a relatively large projected area of the face portion $A_f$ and having a crown section (400) that defines a relatively large drop contour area (620). In some embodiments, the projected area of the face portion $A_f$ desirably is within the range of 8.3 to 11.25 square inches. More desirably, in some embodiments, $A_f$ is within the range of 8.5 to 10.75 square inches. Even more desirably, in some embodiments, $A_f$ is within the range of 8.75 to 10.75 square inches. In some embodiments, the drop contour area (620) is located at an elevation above a maximum top edge plane (MTEP). As defined below, the drop contour area (CA) is a relatively flat portion of the crown section (400) that surrounds the drop contour crown apex (610) and that aids in keeping airflow attached to the club head (100) once it flows over the crown (400) prior to and past the drop contour crown apex (610).

As discussed above, the present high volume aerodynamic golf club heads have a face (200) that is intended to hit the golf ball. In a transition zone (230) of a club head the face (200) transitions to the external contour of the body (110), as shown in FIGS. 26A-C. The shapes of the face (200) and the transition zone (230) can vary substantially from club-head to club-head and from manufacturer to manufacturer. In view of these differences, it is important to have a standard definition of and method for measuring projected area of the face portion $A_f$. Part of the task of defining projected area of the face portion $A_f$ is dealing with the hosel (120). The hosel (120) is generally not intended as a ball-impact location and thus should not be included in the determination of projected area of the face portion $A_f$. Since the hosel (120) serves only to connect the club-head to the shaft of the golf club, and since a few club heads currently available have so-called "internal hosel" configurations, the manner of determining projected area of the face portion $A_f$ should exclude any contributions by the hosel, regardless of the club-head configuration.

Figure 27:
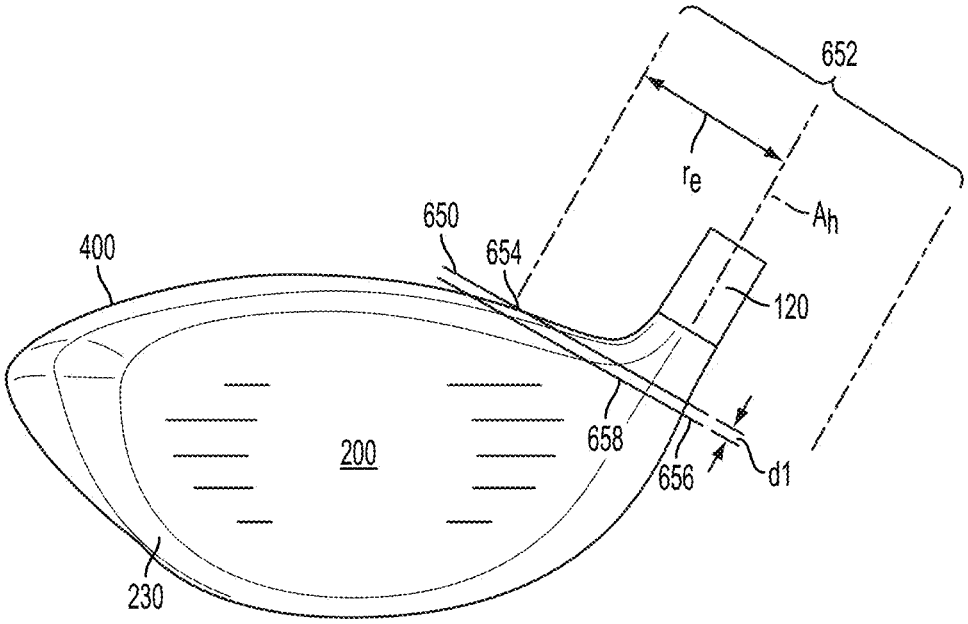
FIG. 27 shows a front elevational view of a high volume aerodynamic golf club head, depicting the manner of defining a first cut plane in the method for obtaining a face portion of the club head for obtaining a standard measurement, as disclosed herein, of projected area of the face portion, not to scale.

For consideration of the high volume aerodynamic golf club heads seen in and described in relation to FIGS. 26-35, the desired manner of determining projected area of the face portion $A_f$ is as follows, described with reference to the club head shown in FIG. 27. The club head includes a body (110), a sole section (300), a face (200) and a hosel (120). The hosel (120) extends along a hosel axis $A_h$. A "hosel-normal" plane (650) is defined that is normal to the hosel axis $A_h$. The hosel axis $A_h$ also is the axis of rotation of a cylinder (652) having a radius $r_e$ of 15 mm. The hosel-normal plane (650) is located on the hosel axis $A_h$ such that the cylinder (652) intersects the hosel-normal plane (650) and touches the surface of the body (110) at the point (654). A first cut plane (656) is defined as being parallel to the hosel-normal plane (650) but displaced 1 mm toward the sole (300). The first cut plane (656) can be denoted by the line (658) that can be scribed on the face (200) and used later as a cut-line for removing the hosel (120) from the club-head.

Figure 28:
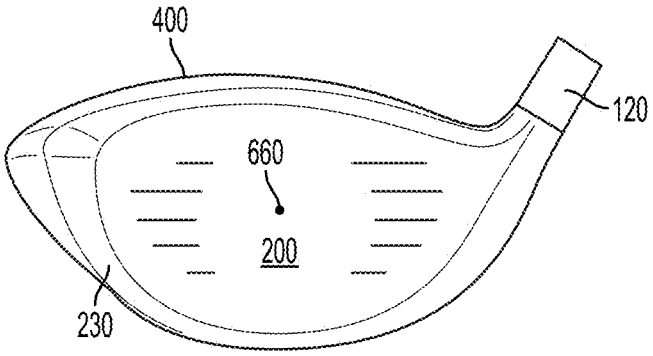
FIG. 28 shows a front elevational view of the club head of FIG. 27, depicting a face on which a face center has been defined as part of the method for obtaining a face portion, not to scale.
Figure 29:
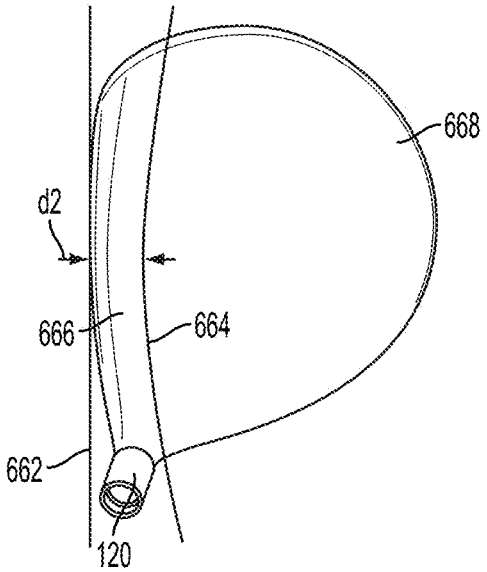
FIG. 29 shows a top view of the club head of FIG. 27, depicting the manner of defining a second cut plane in the method for obtaining a face portion, not to scale.
Figure 30A:
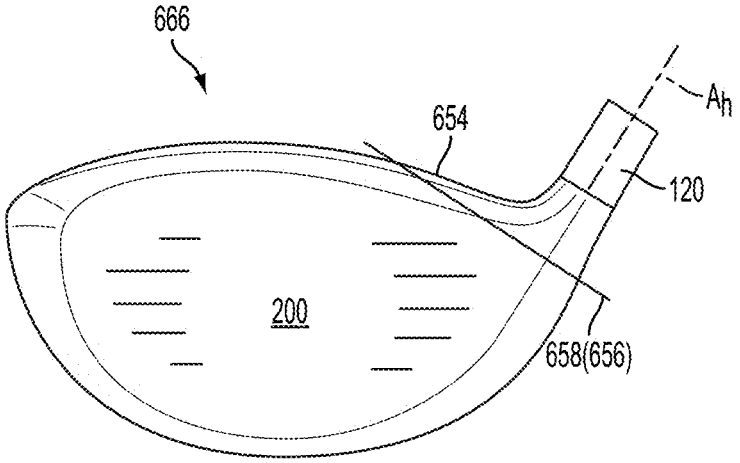
FIG. 30A shows a front elevational view of the club head of FIG. 27, depicting the first cut plane, used in the method for obtaining a face portion, not to scale.
Figure 30B:
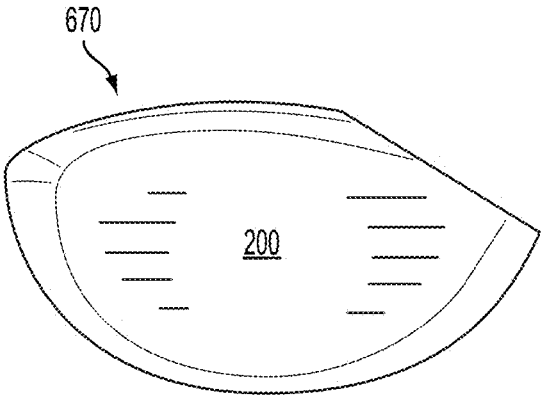
FIG. 30B shows a front elevational view of the face portion produced according to the method, not to scale.

As noted above, the face center (660) of the face (200) is determined in accordance with the USGA "Procedure for Measuring the Flexibility of a Golf Clubhead," Revision 2.0, Mar. 25, 2005, which is incorporated herein by reference. A typical face center (660) is shown in FIG. 28. Turning now to FIG. 29, the club head is rotated such that a normal to the face center (660) is parallel to the ground plane and is oriented in the direction of the target line. A "tangent plane" (662) is defined as being tangent to the face (200) at the face center (660) and normal to the "loft plane" (not shown) of the club head. A best fit bulge radius is then determined within a plane that is parallel to the ground plane and passing through the face center (660), using the face center (660) and two points located at 35 mm on either side of the face center (660). The best fit bulge radius is then extended in a vertical direction (i.e., perpendicular to the ground plane) in both directions (i.e., above and below the face center (660)) and is offset by a distance $d_2$ of 5 mm toward the rear of the club head to define an offset bulge radius cut plane (664).

The club head desirably is cut first along the offset bulge radius cut plane (664) (FIG. 29) to remove the front portion (666) from the rear portion (668). Then, on the front portion (666) (FIG. 30A), a second cut is made along the first cut plane (656), using the line (658) as a guide, to remove the hosel (120). The resulting face portion (670) (FIG. 30B) is used for determining the projected area of the face portion $A_f$ of the club head onto the X-Y plane.

Figure 31:
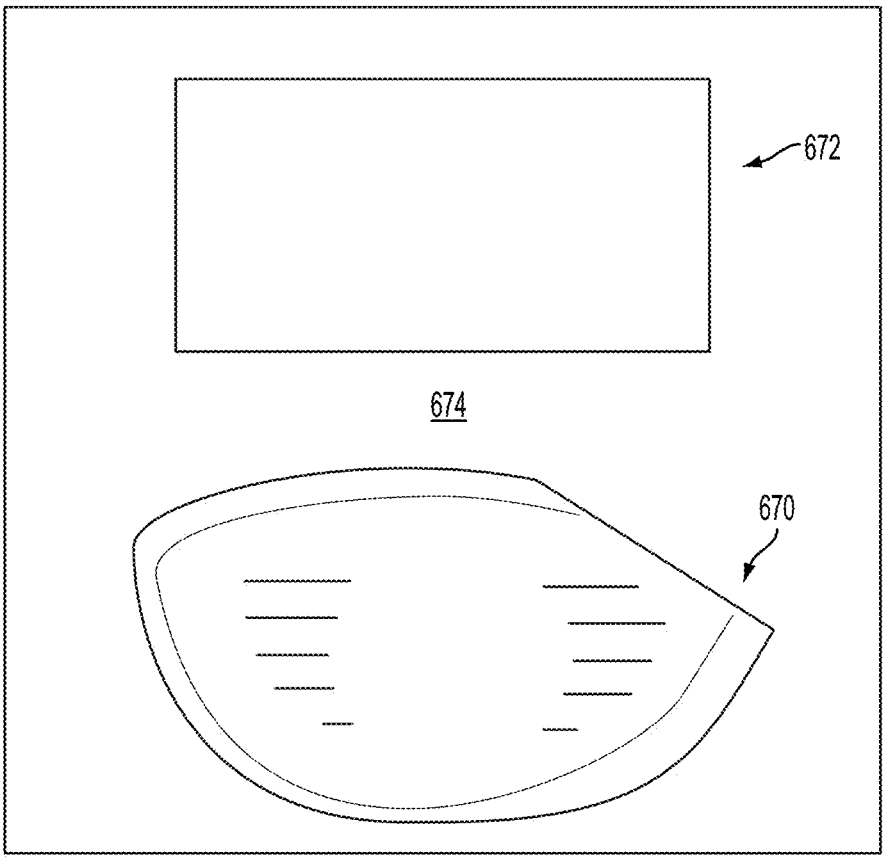
FIG. 31 shows a schematic view of a reference surface (having a precisely known area) and a face portion positioned for obtaining a determination of the projected area of the face portion, not to scale.
Figure 32A:
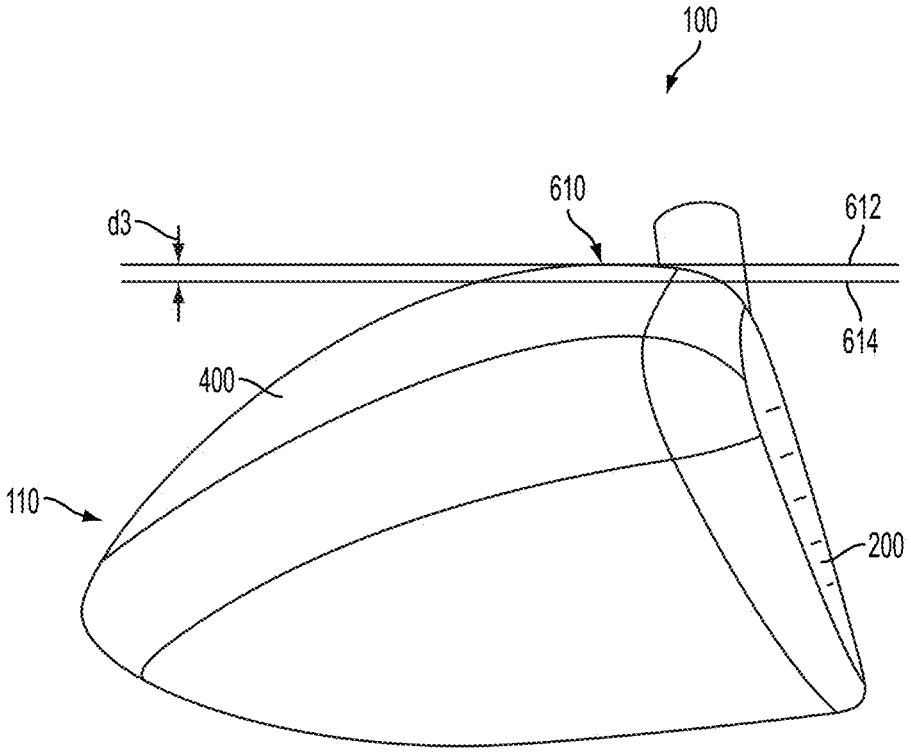
FIG. 32A shows a toe-side elevation view of a high volume aerodynamic golf club head in a 12 degree pitched up orientation, not to scale.
Figure 32B:
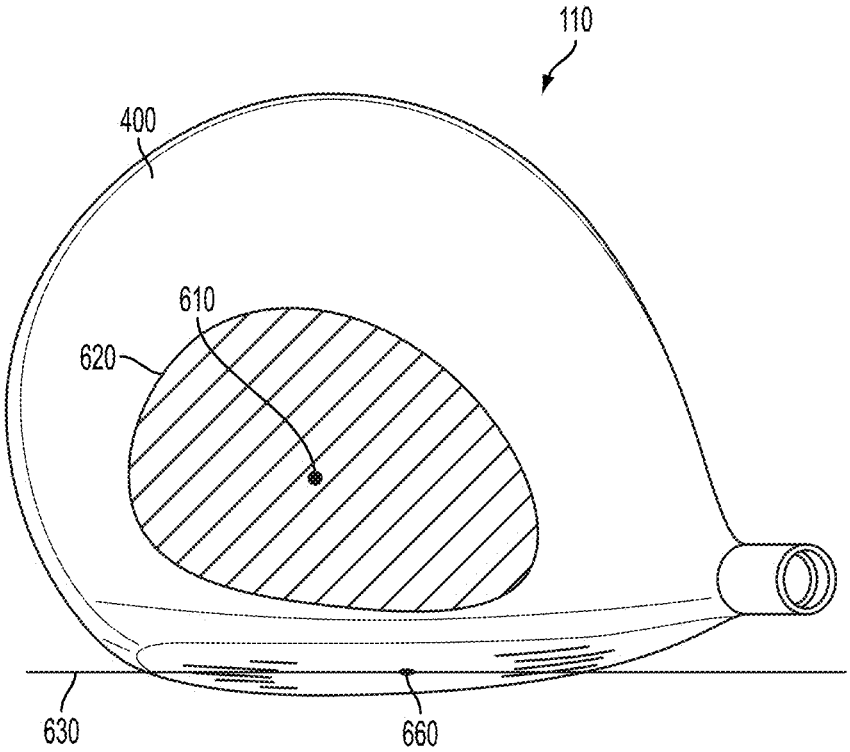
FIG. 32B shows a top plan view of the high volume aerodynamic golf club head of FIG. 32A illustrating an 8 mm drop contour area, not to scale.
Figure 33:
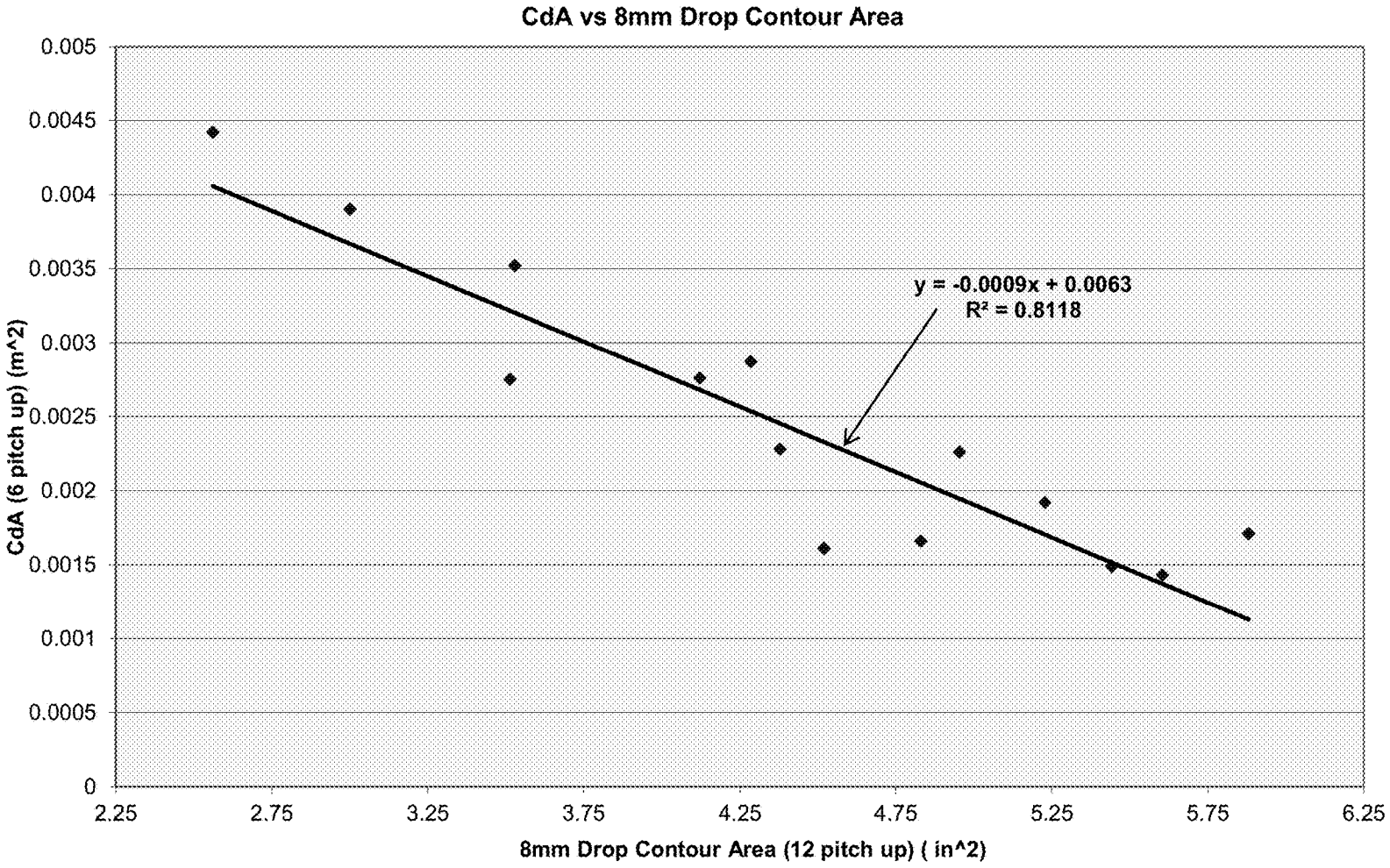
FIG. 33 shows a graph of 8 mm drop contour area (CA) versus the product of the drag coefficient (Cd) and the effective cross-sectional area (A)

To determine the projected area of the face portion $A_f$, and turning now to FIG. 31, the face portion (670) is placed adjacent a reference portion (672) (having a precisely known reference area) on a planar background (674). The face portion (670) and reference portion (672) are imaged (preferably digitally) from a position normal to the planar background (674). Photo-editing software is used to detect the edges of, and the number of pixels inside, the reference portion (672) (in one example 259,150 "black" pixels made up the reference area of 7.77 $in^2$). Similarly, the software is used to detect the edges of, and number of pixels inside, the face portion (670) (in the example 298,890 black pixels made up the area of the face portion (670)). The projected area of the face portion is calculated as follows:

$$A_f = P_f * (A_r / P_r)$$

wherein $A_f$ is the projected area of the face portion, $P_f$ is the pixel count in the face portion (670), $A_r$ is the area of the reference portion (672), and $P_r$ is the pixel count in the reference portion (672). In the example, if $A_r$=7.77 $in^2$, $P_f$=298,890 pixels, and $P_r$=259,150 pixels, then $A_f$=9.14 $in^2$.

It will be understood that the pixel-counting technique described above is an example of a technique capable of measuring area accurately and precisely. Other area-measurement techniques can be employed in alternative methods In various embodiments, the projected area of the face portion $A_f$ is generally greater than 8.3 $in^2$, desirably in the range of 8.3 to 15.5 $in^2$, more desirably in the range of 9.0 to 12.5 $in^2$, and most desirably in the range of 9.5 to 10.5 $in^2$.

The golf club head (100) embodiments shown in and described in relation to FIGS. 26-35 obtain superior aerodynamic performance through the use of unique club head shapes that satisfy a unique relationship between the projected area of the face portion $A_f$ of the club head and the club head drop contour area (CA). Referring now to FIGS. 32A-B, a method for determining the drop contour area of a club head will be described. As shown, a golf club head (100) includes a club head body (110) having a crown section (400) and a face (200). A center face tangent (630) extends parallel to the ground plane and tangent to the face (200) at the location of the face center (660). With the club head oriented at an absolute lie angle of 55 degrees and a square face angle (i.e., a normal to the face (200) at the face center (660) lies within a target plane), the club head body (110) is pitched upward about the centerface tangent (630) to a pitch angle of 12 degrees. This orientation is referred to herein as the 12 degree pitched up orientation. With the club head body (110) positioned in the 12 degree pitched up orientation, the peak height of the crown section relative to the ground plane is located and designated as the 12 degree pitched up crown apex (610). (See FIG. 32A). A crown apex tangent plane (612) is parallel to the ground plane and is tangent to the crown section (400) at the 12 degree pitched up crown apex (610). An 8 mm drop plane (614) is located parallel to and displaced a distance $d_3$ of 8 mm downward (toward the ground plane) from the crown apex tangent plane (612). An area within an intersection of the 8 mm drop contour plane (614) and the crown section (400) is designated as the 8 mm drop contour area (620) of the club head body (110).

Using the foregoing methods for measuring projected area of the face portion ($A_f$) and the 8 mm drop contour area (CA), swing path data was investigated for a number of example golf clubs. For a given golf club head orientation, the drag force of the club head moving through air can be calculated according to the following equation:

$$\text{Drag Force} = 0.5 * \rho * u^2 * Cd * A$$

where ρ is the air density, u is the airspeed of the club head, Cd is the drag coefficient, and A is the projected area of the golf club head. Resolving the equation for the product Cd*A provides the following:

$$Cd * A = \text{Drag Force} / 0.5 * p * u^2$$

Through swing path analysis, it was found that the range along the swing path between 6 degree and 12 degree pitched up orientations of the golf club head were the most important for contributing to club head aerodynamics because it is within this range of club head orientation that the club head aerodynamic performance will have the most impact on club head speed. A drag force for the number of example golf clubs described above was measured experimentally under known conditions of air speed and air density. Values for the product of Cd*A were then determined for the golf club heads. These results were then plotted against the measured 8 mm drop contour area for the golf club heads in the 6 degree pitched up orientation. The results are provided in the graph shown in FIG. 33, and show a high correlation between the 8 mm drop contour area and the aerodynamic performance of the golf club head. Moreover, the results provided in the graph at FIG. 33 demonstrate that a relatively larger 8 mm drop contour area provides a golf club head having improved aerodynamic performance.

Turning next to FIGS. 34-39, a number of prior golf club heads manufactured by the TaylorMade Golf Company ("Comparative Embodiments") and a number of competitor prior golf club heads ("Competitor Club Heads") were analyzed to determine the projected area of the face portion ($A_f$) and 8 mm drop contour area (CA) at a 12 degree pitched up orientation for each of the club heads. These measurements were then compared to measurements of several novel golf club heads described herein ("Novel Club Heads") in the same 12 degree pitched up orientation. The results show that the novel club heads provide a combination of a relatively large projected area of the face portion ($A_f$) while maintaining an aerodynamically preferable large value for the 8 mm drop contour area (CA) in a manner that was not shown by the Comparative Embodiments or the Competitor Club Heads.

Figure 34:
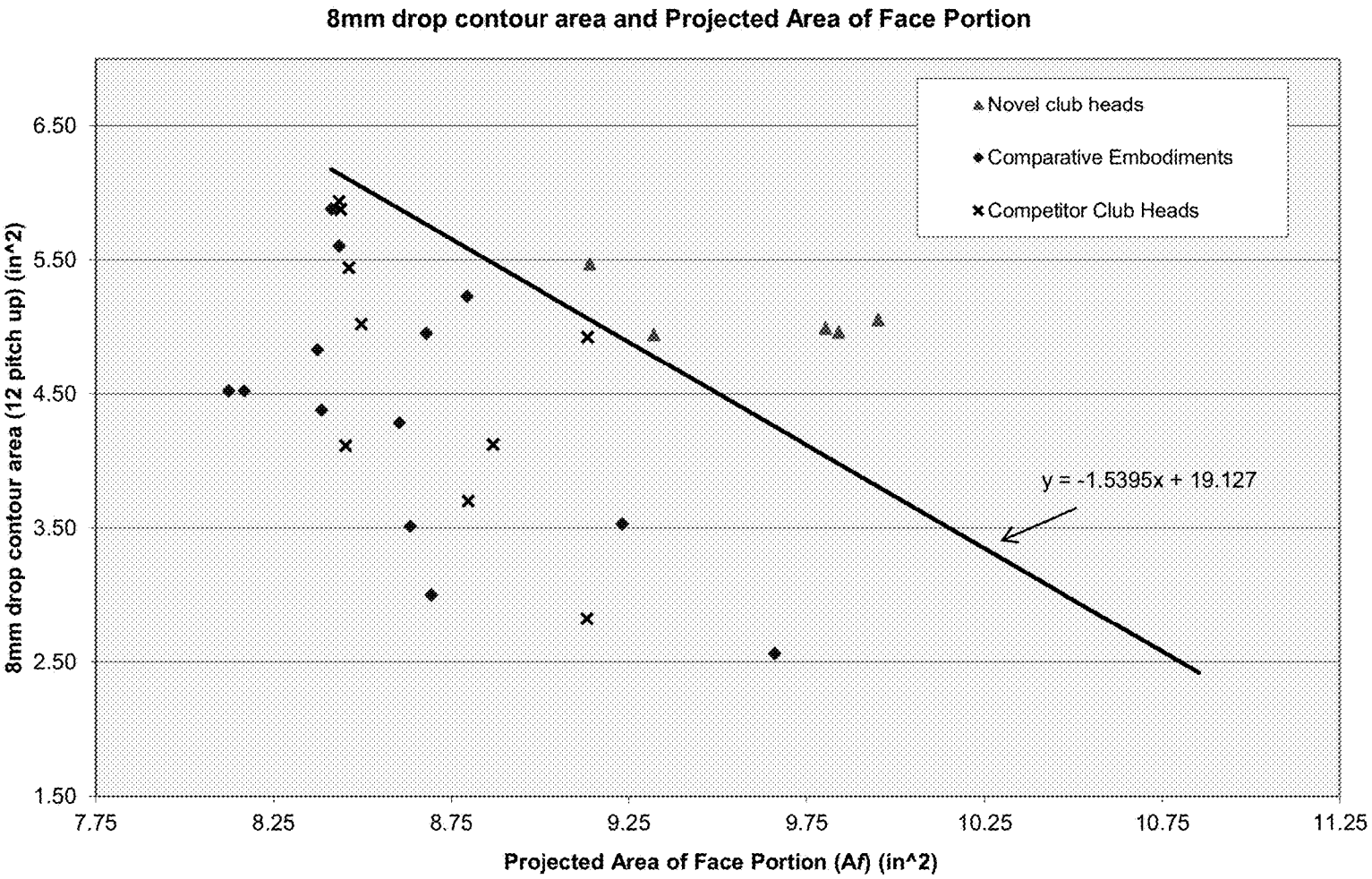
FIGS. 34-39 show graphs of projected area of the face portion (Af) versus 8 mm drop contour area (CA)

In particular, as shown in FIG. 34, the results show that the novel club heads had a relationship between projected area of the face portion ($A_f$) and 8 mm drop contour area (CA) that extends within a region of the graph that is defined in part by the following lower boundary equation:

$$CA=-1.5395*A_f+19.127 \quad \text{Eq. 1}$$

In Equation 1, CA is the 8 mm drop contour area (at the 12 degree pitched orientation), expressed in square inches, and $A_f$ is the projected area of the face portion (as defined hereinabove), also expressed in square inches. The novel club head region extends between a projected area of the face portion ($A_f$) of 8.3 $in^2$ to 11.25 $in^2$ on the x-axis, and extends between about 6.5 $in^2$ down to the boundary of Equation 1 described above on the y-axis. A narrower novel club head region extends between about 6.0 $in^2$ and the boundary of Equation 1 on the y-axis, and has an x-axis limit between a projected area of the face portion ($A_f$) of 8.5 $in^2$ to 10.75 $in^2$, 8.75 $in^2$ to 10.75 $in^2$, 9.0 $in^2$ to 10.5 $in^2$, or 9.0 $in^2$ to 10.25 $in^2$.

Figure 35:
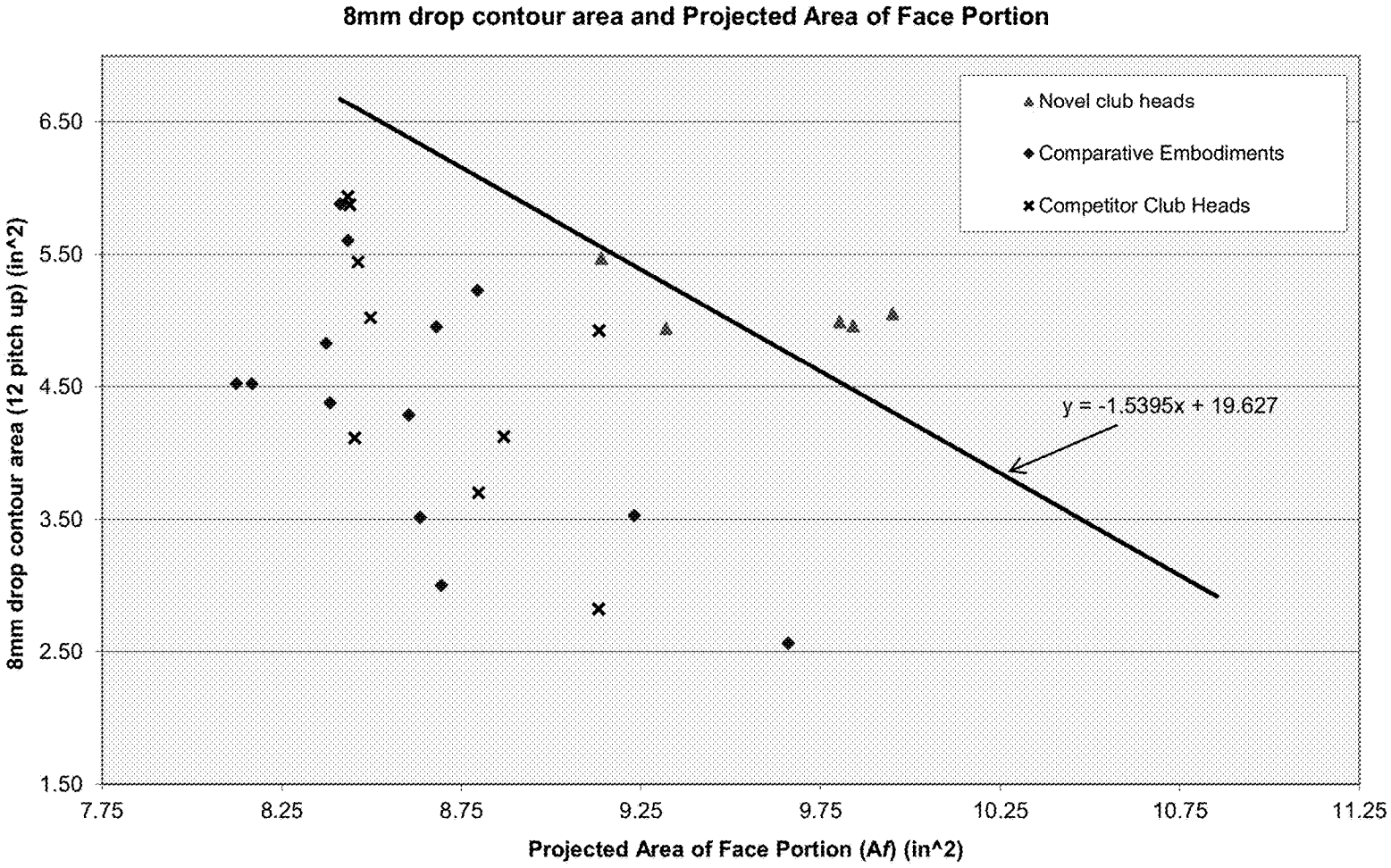

Turning to FIG. 35, an alternative relationship for the novel club heads between projected area of the face portion ($A_f$) and 8 mm drop contour area (CA) extends within a region of the graph that is defined in part by the following lower boundary equation:

$$CA=-1.5395*A_f+19.627 \quad \text{Eq. 2}$$

In Equation 2, CA is the 8 mm drop contour area (at the 12 degree pitched orientation), expressed in square inches, and $A_f$ is the projected area of the face portion (as defined hereinabove), also expressed in square inches. The novel club head region shown in FIG. 35 extends between a projected area of the face portion ($A_f$) of 8.75 $in^2$ to 11.25 $in^2$ on the x-axis, and extends between about 6.5 $in^2$ down to the boundary of Equation 2 described above on the y-axis. A narrower novel club head region extends between about 6.0 $in^2$ and the boundary of Equation 2 on the y-axis, and has an x-axis limit between a projected area of the face portion ($A_f$) of 9.0 $in^2$ to 10.75 $in^2$, 9.0 $in^2$ to 10.75 $in^2$, 9.0 $in^2$ to 10.5 $in^2$, or 9.0 $in^2$ to 10.25 $in^2$.

Figure 36:
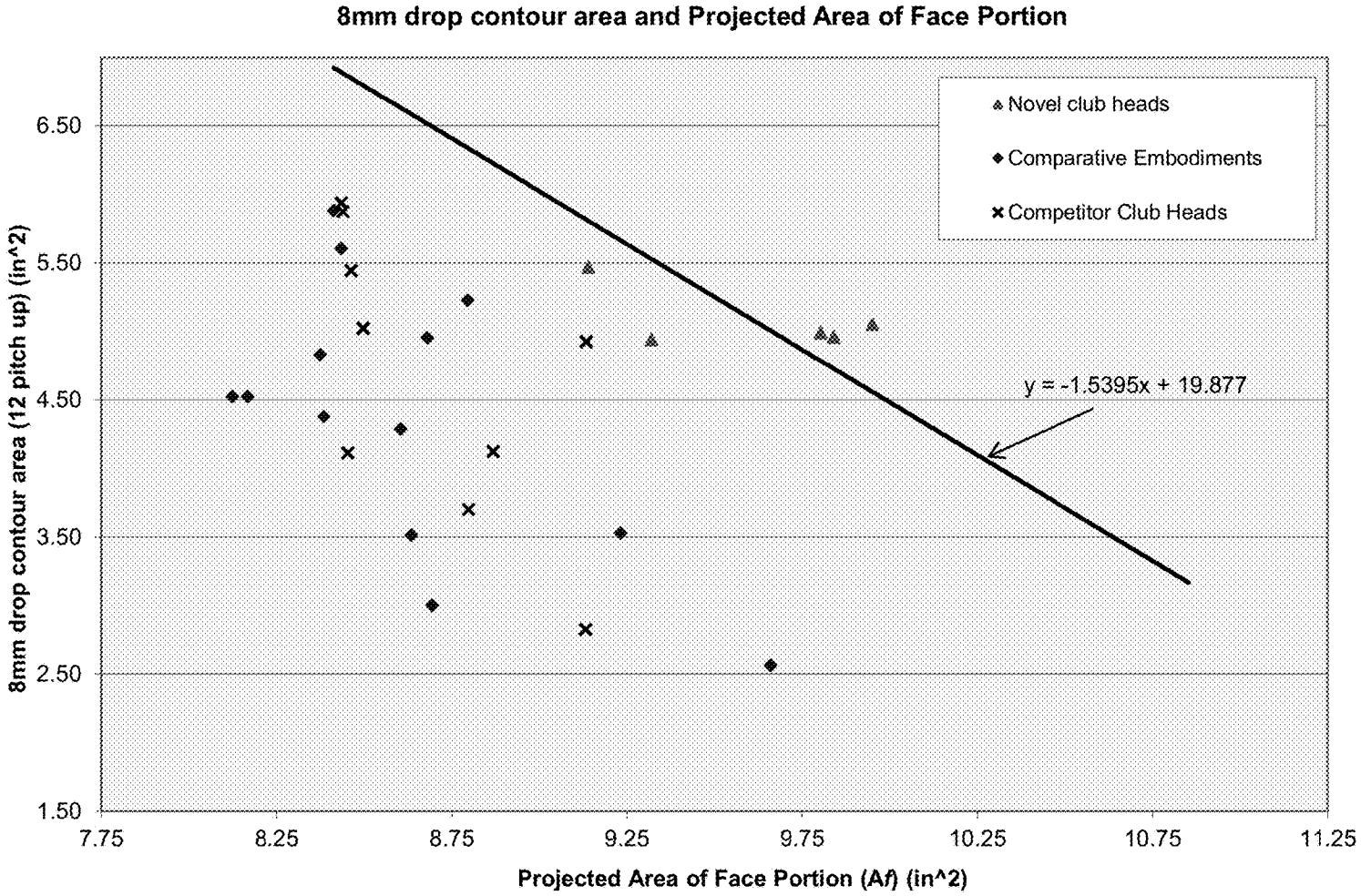

Turning to FIG. 36, another alternative relationship for the novel club heads between projected area of the face portion ($A_f$) and 8 mm drop contour area (CA) extends within a region of the graph that is defined in part by the following lower boundary equation:

$$CA=-1.5395*A_f+19.877 \quad \text{Eq. 3}$$

In Equation 3, CA is the 8 mm drop contour area (at the 12 degree pitched orientation), expressed in square inches, and $A_f$ is the projected area of the face portion (as defined hereinabove), also expressed in square inches. The novel club head region shown in FIG. 36 extends between a projected area of the face portion ($A_f$) of 8.75 $in^2$ to 11.25 $in^2$ on the x-axis, and extends between about 6.5 $in^2$ down to the boundary of Equation 3 described above on the y-axis. A narrower novel club head region extends between about 6.0 $in^2$ and the boundary of Equation 3 on the y-axis, and has an x-axis limit between a projected area of the face portion ($A_f$) of 9.25 $in^2$ to 10.75 $in^2$, 9.25 $in^2$ to 10.75 $in^2$, 9.25 $in^2$ to 10.5 $in^2$, or 9.25 $in^2$ to 10.25 $in^2$.

Figure 37:
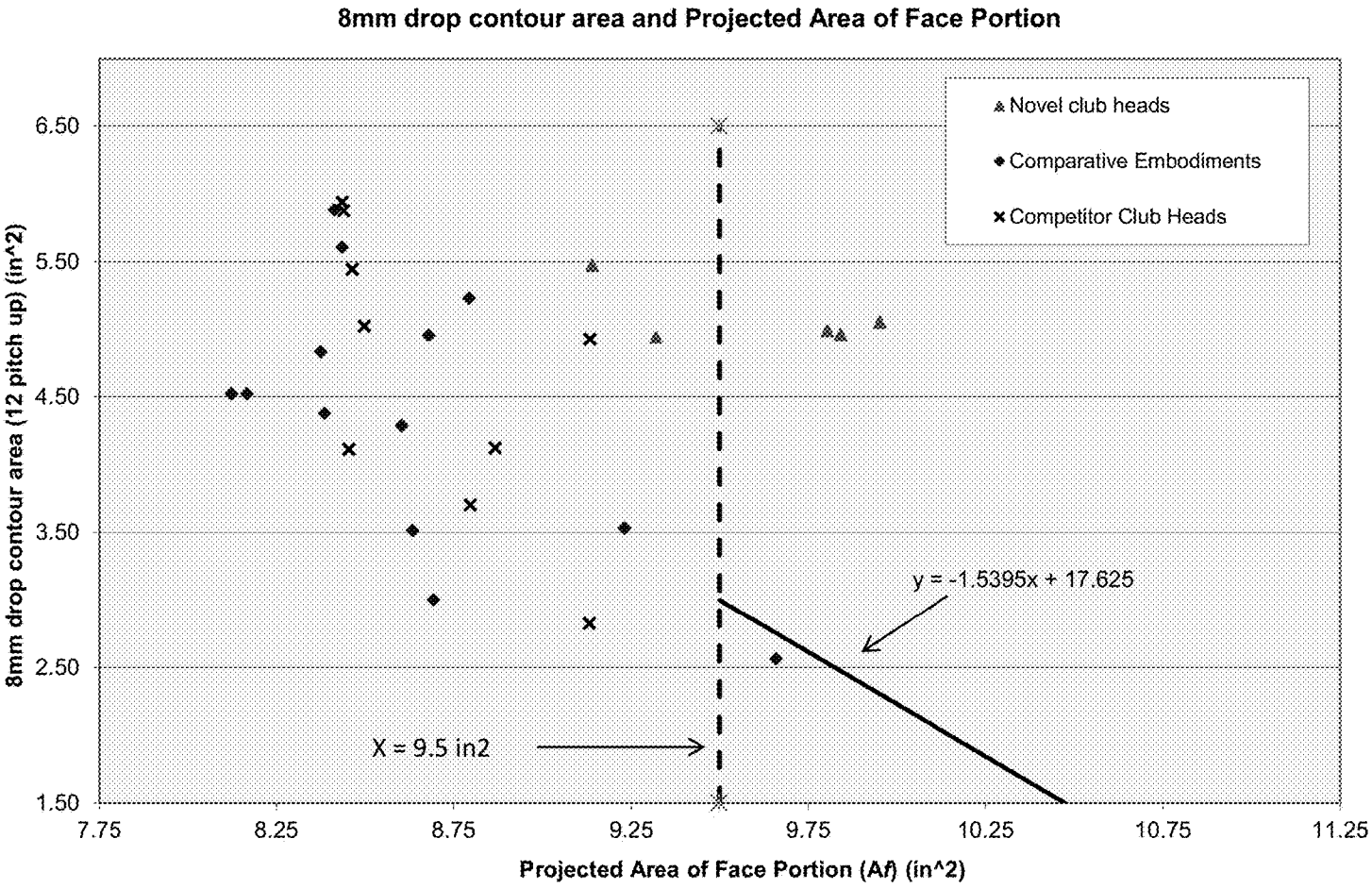

Turning next to FIG. 37, still another alternative relationship between projected area of the face portion ($A_f$) and 8 mm drop contour area (CA) is defined for novel golf club heads having projected area of the face portion ($A_f$) values greater than 9.5 $in^2$. For these novel golf club heads, the relationship between $A_f$ and CA extends within a region of the graph that is defined in part by the following lower boundary equation:

$$CA=-1.5395*A_f+17.625 \quad \text{Eq. 4}$$

In Equation 4, CA is the 8 mm drop contour area (at the 12 degree pitched orientation), expressed in square inches, and $A_f$ is the projected area of the face portion (as defined hereinabove), also expressed in square inches. The novel club head region shown in FIG. 37 extends between a projected area of the face portion ($A_f$) of 9.5 $in^2$ to 11.25 $in^2$ on the x-axis, and extends between about 6.5 $in^2$ down to the boundary of Equation 4 described above on the y-axis. A narrower novel club head region extends between about 6.0 $in^2$ and the boundary of Equation 4 on the y-axis, and has an x-axis limit between a projected area of the face portion ($A_f$) of 9.5 $in^2$ to 10.75 $in^2$, 9.5 $in^2$ to 10.5 $in^2$, 9.5 $in^2$ to 10.25 $in^2$, or 9.75 $in^2$ to 10.25 $in^2$.

Figure 38:
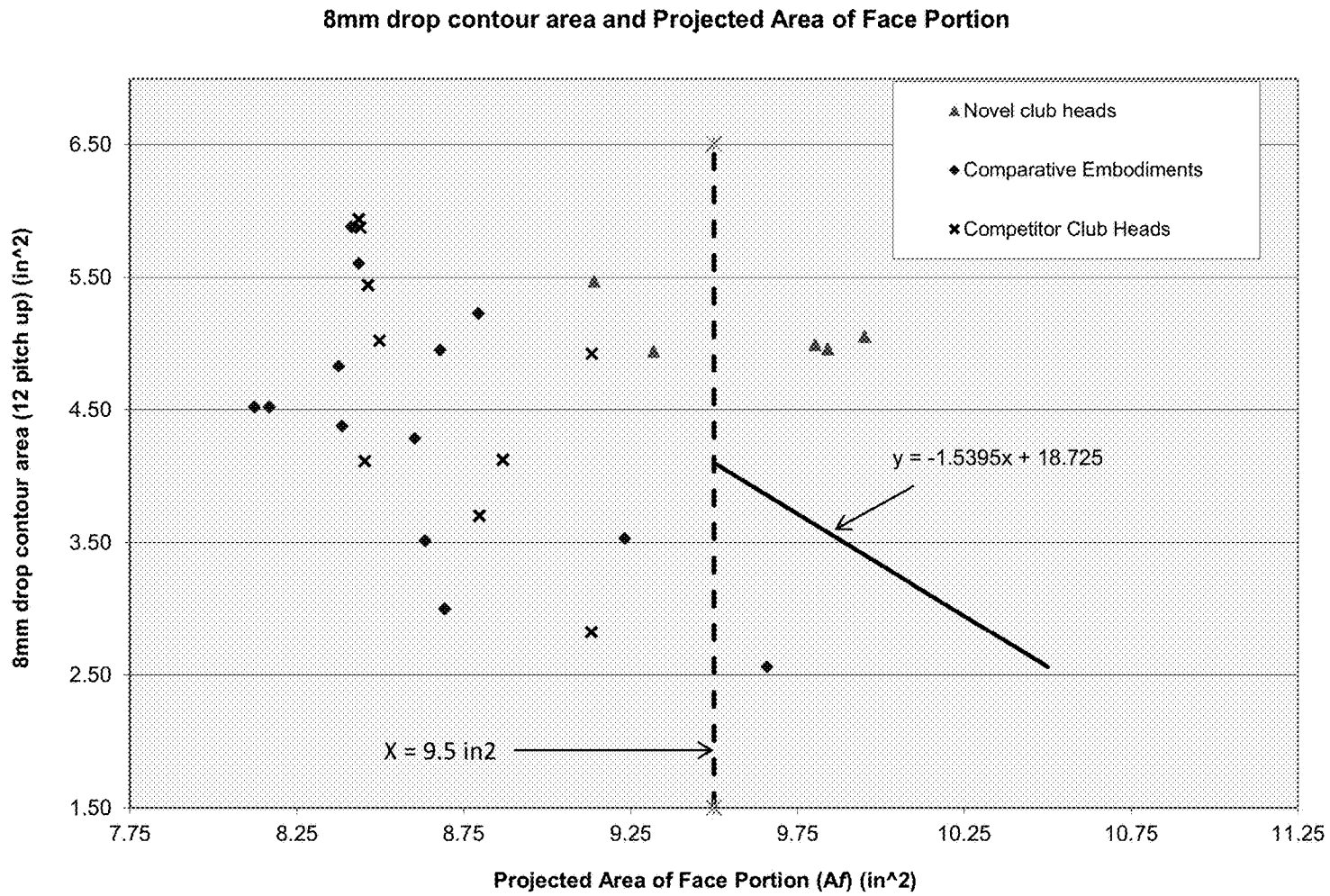
Figure 39:
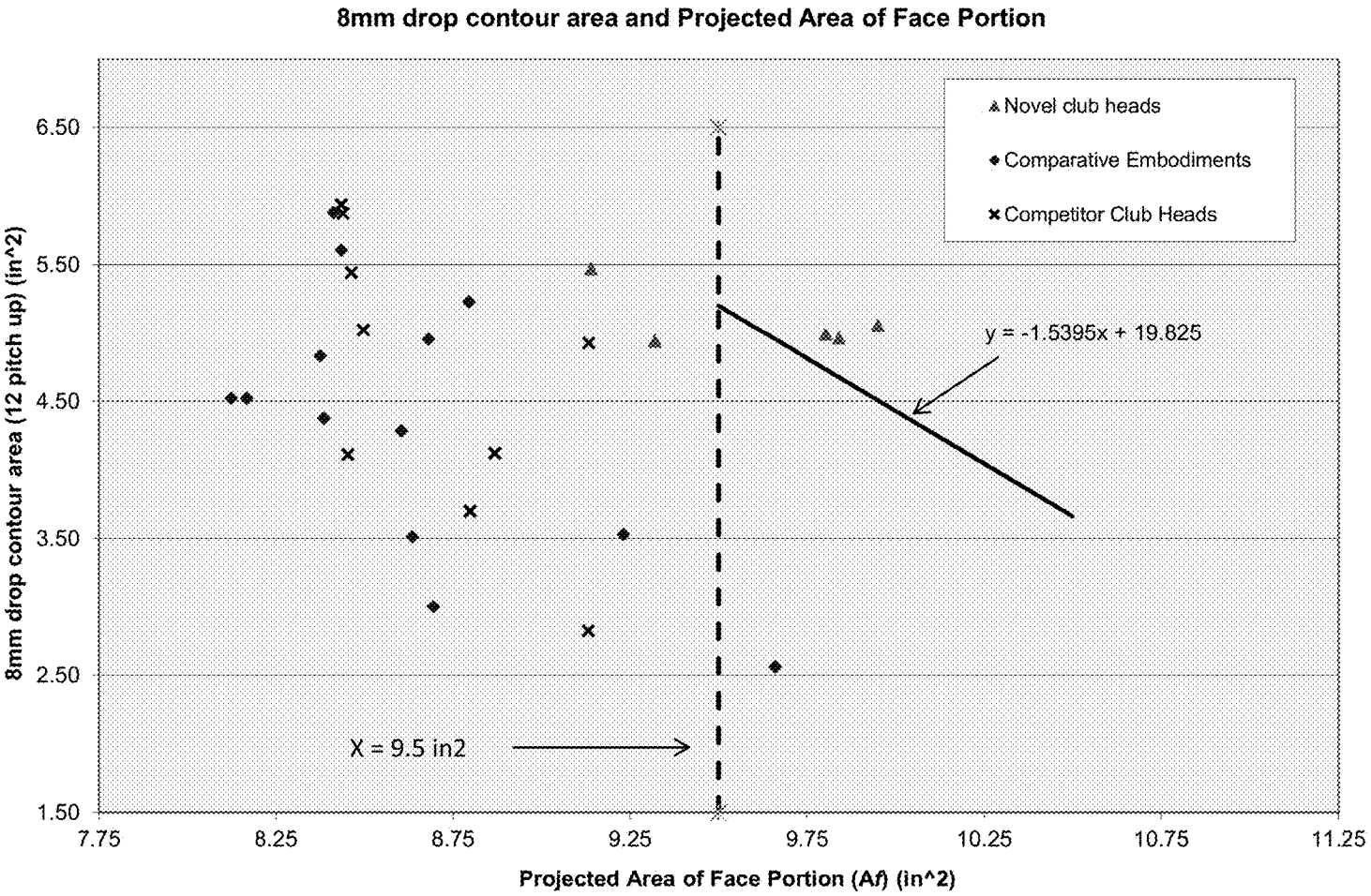

Turning next to FIG. 38, a still further alternative relationship between projected area of the face portion ($A_f$) and 8 mm drop contour area (CA) is defined for novel golf club heads having projected area of the face portion ($A_f$) values greater than 9.5 $in^2$. For these novel golf club heads, the relationship between $A_f$ and CA extends within a region of the graph that is defined in part by the following lower boundary equation:

$$CA=-1.5395*A_f+18.725 \quad \text{Eq. 5}$$

In Equation 5, CA is the 8 mm drop contour area (at the 12 degree pitched orientation), expressed in square inches, and $A_f$ is the projected area of the face portion (as defined hereinabove), also expressed in square inches. The novel club head region shown in FIG. 38 extends between a projected area of the face portion ($A_f$) of 9.5 $in^2$ to 11.25 $in^2$ on the x-axis, and extends between about 6.5 $in^2$ down to the boundary of Equation 5 described above on the y-axis. A narrower novel club head region extends between about 6.0 $in^2$ and the boundary of Equation 5 on the y-axis, and has an x-axis limit between a projected area of the face portion ($A_f$) of 9.5 $in^2$ to 10.75 $in^2$, 9.5 $in^2$ to 10.5 $in^2$, 9.5 $in^2$ to 10.25 $in^2$, or 9.75 $in^2$ to 10.25 $in^2$.

Turning next to FIG. 38, another alternative relationship between projected area of the face portion ($A_f$) and 8 mm drop contour area (CA) is defined for novel golf club heads having projected area of the face portion ($A_f$) values greater than 9.5 $in^2$. For these novel golf club heads, the relationship between $A_f$ and CA extends within a region of the graph that is defined in part by the following lower boundary equation:

$$CA=-1.5395*A_f+19.825 \quad \text{Eq. 6}$$

In Equation 6, CA is the 8 mm drop contour area (at the 12 degree pitched orientation), expressed in square inches, and $A_f$ is the projected area of the face portion (as defined hereinabove), also expressed in square inches. The novel club head region shown in FIG. 39 extends between a projected area of the face portion ($A_f$) of 9.5 $in^2$ to 11.25 $in^2$ on the x-axis, and extends between about 6.5 $in^2$ down to the boundary of Equation 6 described above on the y-axis. A narrower novel club head region extends between about 6.0 $in^2$ and the boundary of Equation 6 on the y-axis, and has an x-axis limit between a projected area of the face portion ($A_f$) of 9.5 $in^2$ to 10.75 $in^2$, 9.5 $in^2$ to 10.5 $in^2$, 9.5 $in^2$ to 10.25 $in^2$, or 9.75 $in^2$ to 10.25 $in^2$.

Figure 40A:
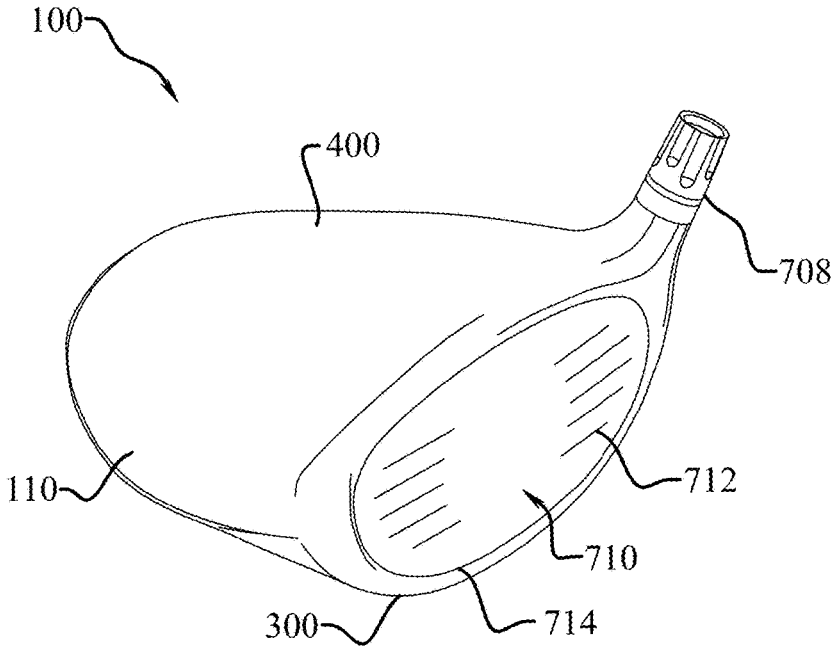
FIG. 40A is an isometric view of a high volume aerodynamic golf club head having a composite face insert, not to scale.

In several embodiments, the larger projected area of the face portion ($A_f$) may be achieved by providing a golf club head (100) that includes one or more parts formed from a lightweight material, including conventional metallic and nonmetallic materials known and used in the art, such as steel (including stainless steel), titanium alloys, magnesium alloys, aluminum alloys, carbon fiber composite materials, glass fiber composite materials, carbon pre-preg materials, polymeric materials, and the like. For example, in some embodiments, the face (200) may be provided as a face insert formed of a composite material. FIG. 40A shows an isometric view of a golf club head (100) including a hollow body (110) having a crown section (400) and a sole section (300). A composite face insert (710) is inserted into a front opening inner wall (714) located in the front portion of the club head body (110). The face insert (710) can include a plurality of score lines (712).

Figure 40B:
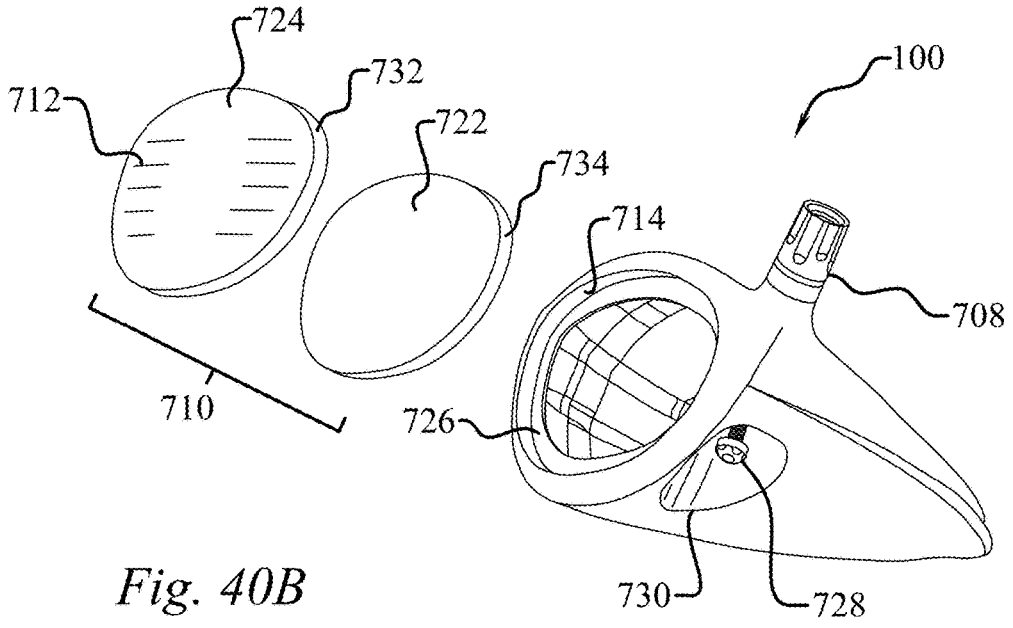
FIG. 40B is an exploded view of the high volume aerodynamic golf club head of FIG. 40A, not to scale.

FIG. 40B illustrates an exploded assembly view of the golf club head (100) and a face insert (710) including a composite face insert (722) and a metallic cap (724). In certain embodiments, the metallic cap (724) is a titanium alloy, such as 6-4 titanium or CP titanium. In some embodiments, the metallic cap (724) includes a rim portion (732) that covers a portion of a side wall (734) of the composite insert (722). In other embodiments, the metallic cap (724) does not have a rim portion (732) but includes an outer peripheral edge that is substantially flush and planar with the side wall (734) of the composite insert (722). A plurality of score lines (712) can be located on the metallic cap (724). The composite face insert (710) has a variable thickness and is adhesively or mechanically attached to the insert ear (726) located within the front opening and connected to the front opening inner wall (714). The insert ear (726) and the composite face insert (710) can be of the type described in, e.g., U.S. patent application Ser. Nos. 11/825,138, 11/960,609, and 11/960,610, and U.S. Pat. Nos. 7,267,620, RE42,544, 7,874,936, 7,874,937, 7,985,146, and 8,096,897 which are incorporated by reference herein in their entirety.

FIG. 40B further shows a heel opening (730) located in the heel region (706) of the club head (100). A fastening member (728) is inserted into the heel opening (730) to secure a sleeve (708) in a locked position as shown. The sleeve (708) is configured to be attached (e.g., by bonding) to the distal end of a shaft, to thereby provide a user-adjustable head-shaft connection assembly. In certain embodiments, the sleeve (708) can have any of several specific design parameters and is capable of providing various face angle and loft angle orientations as described in, for example, U.S. patent application Ser. No. 12/474,973 and U.S. Pat. Nos. 7,887,431 and 8,303,431, which are incorporated by reference herein in their entirety.

According to several additional embodiments, a desired combination of a relatively large projected area of the face portion ($A_f$) and relatively large 8 mm drop contour area (CA) may be obtained by the provision of thin wall construction for one or more parts of the golf club head. Among other advantages, thin wall construction facilitates the redistribution of material from one part of a club head to another part of the club head. Because the redistributed material has a certain mass, the material may be redistributed to locations in the golf club head to enhance performance parameters related to mass distribution, such as CG location and moment of inertia magnitude. Club head material that is capable of being redistributed without affecting the structural integrity of the club head is commonly called discretionary weight. In some embodiments of the presently described high volume aerodynamic golf club head, thin wall construction enables discretionary weight to be removed from one or a combination of the striking plate, crown, skirt, or sole and redistributed in the form of weight ports and corresponding weights.

Thin wall construction can include a thin sole construction, e.g., a sole with a thickness less than about 0.9 mm but greater than about 0.4 mm over at least about 50% of the sole surface area; and/or a thin skirt construction, e.g., a skirt with a thickness less than about 0.8 mm but greater than about 0.4 mm over at least about 50% of the skirt surface area; and/or a thin crown construction, e.g., a crown with a thickness less than about 0.8 mm but greater than about 0.4 mm over at least about 50% of the crown surface area. In one embodiment, the club head is made of titanium and has a thickness less than 0.65 mm over at least 50% of the crown in order to free up enough weight to achieve the desired CG location.

The thin wall construction can be described according to areal weight as defined by the equation below:

$$AW=\rho \cdot t$$

In the above equation, AW is defined as areal weight, p is defined as density, and t is defined as the thickness of the material. In one exemplary embodiment, the golf club head is made of a material having a density, ρ, of about 4.5 $g/cm^3$ or less. In one embodiment, the thickness of a crown or sole portion is between about 0.04 cm and about 0.09 cm. Therefore the areal weight of the crown or sole portion is between about 0.18 $g/cm^2$ and about 0.41 $g/cm^2$. In some embodiments, the areal weight of the crown or sole portion is less than 0.41 $g/cm^2$ over at least about 50% of the crown or sole surface area. In other embodiments, the areal weight of the crown or sole is less than about 0.36 $g/cm^2$ over at least about 50% of the entire crown or sole surface area.

In certain embodiments, the thin wall construction may be implemented according to U.S. patent application Ser. No. 11/870,913 and/or U.S. Pat. No. 7,186,190, which are incorporated by reference herein in their entirety.

Several of the features of the high volume aerodynamic golf club heads described herein—including the provision of a relatively large projected area of the face portion ($A_f$) and relatively large 8 mm drop contour area (CA)—will tend to cause the location of the center of gravity (CG) to be relatively higher (i.e., larger Ycg value) than a comparably constructed golf club head that does not include these features. Through the provision of one or more of the features described above, such as a lightweight face and/or lightweight construction in other parts of the golf club head, along with relocation of discretionary weight to other parts of the club head, several embodiments of the presently described high volume aerodynamic golf club heads may obtain a desirable downward shift in the location of the center of gravity (CG).

As noted above, the hollow body (110) has center of gravity coordinates (Xcg, Ycg, Zcg) that are described with reference to the origin point, seen in FIG. 8. Alternatively, the location of the vertical component of the center of gravity may be designated by reference to a "horizontal center face plane" (HCFP), which is defined herein as a horizontal plane (i.e., a plane parallel to the ground plane) that passes through the center of the face (200) when the club head is positioned in its design orientation. A vertical component of the location of the center of gravity may be expressed as Vcg, which is the distance of the center of gravity (CG) from the horizontal center face plane (HCFP) in a direction orthogonal to the ground plane (GP). Positive values for Vcg indicate a center of gravity (CG) location above the horizontal center face plane (HCFP), while negative values for Vcg indicate a center of gravity (CG) location below the horizontal center face plane (HCFP). Using this alternative designation, in some embodiments, the hollow body (110) of the high volume aerodynamic golf club head is provided with a center of gravity (CG) such that Vcg<0, such as Vcg<−0.08 inch, such as Vcg<−0.16 inch.

Several of the high volume aerodynamic golf club embodiments described above in relation to FIGS. 26-40 may also include one or more of the same club head shape and performance features contained in the embodiments described above in relation to FIGS. 7-13. For example, as with the prior embodiments, several of the embodiments containing the large projected area of the face portion ($A_f$) and large 8 mm drop contour area (CA) may also include a front-to-back dimension (FB) of at least 4.4 inches, such as at least about 4.6 inches, or at least about 4.75 inches. In addition, as with the prior embodiments, several of these embodiments may include a maximum top edge height (TEH) of at least about 2 inches, such as at least about 2.15 inches, and an apex ratio of the apex height (AH) to the maximum top edge height (TEH) of at least 1.13, such as at least 1.2, or at least 1.25.

The high volume aerodynamic golf club head (100) described in relation to FIGS. 26-40 may also have a head volume of at least 400 cc. Further embodiments may incorporate the various features of the above described embodiments and increase the club head volume to at least 440 cc, or even further to the current USGA limit of 460 cc. However, one skilled in the art will appreciate that the specific aerodynamic features are not limited to those club head sizes and will apply to even larger club head volumes.

Moreover, several embodiments of the high volume aerodynamic golf club head (100) described in relation to FIGS. 26-40 may also obtain a first moment of inertia (MOIy) about a vertical axis through a center of gravity (CG) of the golf club head (100) (see FIG. 7) that is at least 4000 g*cm$^2$. Further, several of these embodiments may obtain a second moment of inertia (MOIx) about a horizontal axis through the center of gravity (CG), as seen in FIG. 9, that is at least 2000 g*cm$^2$.

Still other embodiments of the high volume aerodynamic golf club head (100) described in relation to FIGS. 26-40 also have a crown section (400), at least a portion of which between the crown apex (410) and the front (112) may have an apex-to-front radius of curvature (Ra-f) that is less than about 3 inches, such as less than about 2.85 inches. In addition, some embodiments include at least a portion of the crown section between the crown apex (410) and the back (114) of the body that may have an apex-to-rear radius of curvature (Ra-r) that is less than 3.75 inches, and/or at least a portion of which has a heel-to-toe radius of curvature (Rh-t) that may be less than about 4 inches, such as less than about 3.85 inches. Moreover, still other embodiments include an apex-to-front radius of curvature (Ra-f) that may be at least 25% less than the apex-to-rear curvature (Ra-r). Still other embodiments may demonstrate the following relationship between the curvature radii at the following portions of the crown section (400):

$$Ra\text{-}f<Ra\text{-}r<Rh\text{-}t.$$

Still other embodiments of the club head described in relation to FIGS. 26-40 may be constructed such that less than 10%—such as between 5% to 10%—of the club head volume is located above the elevation of the maximum top edge height (MTEH).

Several additional embodiments may include a crown apex setback dimension (412) that is less than 1.75 inches. Still other embodiments may include a crown apex (410) location that results in a crown apex ht dimension (414) that is greater than 30% of the HT dimension and less than 70% of the HT dimension, thereby aiding in reducing the period of airflow separation. In an even further embodiment, the crown apex (410) may be located in the heel-to-toe direction between the center of gravity (CG) and the toe (118).

Moreover, the high volume aerodynamic golf club head embodiments described above in relation to FIGS. 26-40 may also be provided with the post apex attachment promoting region (420) illustrated above in relation to FIGS. 18, 19, and 22, and having the lengths, widths, shapes, and locations described above in relation to FIGS. 14-25. Still further, these embodiments of the high volume aerodynamic golf club head may also be provided with the skirt profiles (550) described above in relation to FIGS. 21-25.

All of the previously described aerodynamic characteristics with respect to the crown section (400) apply equally to the sole section (300) of the high volume aerodynamic golf club head (100). In other words, one skilled in the art will appreciate that just like the crown section (400) has a crown apex (410), the sole section (300) may have a sole apex. Likewise, the three radii of the crown section (400) may just as easily be three radii of the sole section (300). Thus, all of the embodiments described herein with respect to the crown section (400) are incorporated by reference with respect to the sole section (300).

The various parts of the golf club head (100) may be made from any suitable or desired materials without departing from the claimed club head (100), including conventional metallic and nonmetallic materials known and used in the art, such as steel (including stainless steel), titanium alloys, magnesium alloys, aluminum alloys, carbon fiber composite materials, glass fiber composite materials, carbon pre-preg materials, polymeric materials, and the like. The various sections of the club head (100) may be produced in any suitable or desired manner without departing from the claimed club head (100), including in conventional manners known and used in the art, such as by casting, forging, molding (e.g., injection or blow molding), etc. The various sections may be held together as a unitary structure in any suitable or desired manner, including in conventional manners known and used in the art, such as using mechanical connectors, adhesives, cements, welding, brazing, soldering, bonding, and other known material joining techniques. Additionally, the various sections of the golf club head (100) may be constructed from one or more individual pieces, optionally pieces made from different materials having different densities, without departing from the claimed club head (100).

Numerous alterations, modifications, and variations of the preferred embodiments disclosed herein will be apparent to those skilled in the art and they are all anticipated and contemplated to be within the spirit and scope of the instant club head. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present club head are described herein, it is to be understood that the practice of such additional modifications and variations and the equivalents thereof, are within the spirit and scope of the club head as defined in the following claims. The corresponding structures, materials, acts, and equivalents of all means or step plus function elements in the claims below are intended to include any structure, material, or acts for performing the functions in combination with other claimed elements as specifically claimed.

We claim:

1. An aerodynamic golf club head comprising:

A) a hollow body (110) having a club head volume of at least 400 cc, a face (200), a sole section (300), a crown section (400), a front (112), a back (114), a heel (116), a toe (118), and a front-to-back dimension (FB) of at least 4.4 inches, wherein i) the hollow body (110) has a bore having a center that defines a shaft axis (SA) which intersects with a horizontal ground plane (GP) to define an origin point; and ii) the hollow body (110) has a center of gravity (CG) located:

(a) vertically toward the crown section (400) from the origin point a distance Ycg in a direction orthogonal to the ground plane (GP), and vertically toward the crown section (400) from a horizontal center face plane a distance Vcg in a direction orthogonal to the horizontal center face plane, wherein the distance Vcg is less than or equal to 0 inches;

(b) horizontally from the origin point toward the toe (118) a distance Xcg that is parallel to a vertical plane defined by the shaft axis (SA) and parallel to the ground plane (GP); and (c) a distance Zcg from the origin toward the back (114) in a direction orthogonal to the vertical direction used to measure Ycg and orthogonal to the horizontal direction used to measure Xcg;

B) the face (200) having a top edge (210) and a lower edge (220), wherein a top edge height (TEH) is the elevation of the top edge (210) above the ground plane (GP), and a lower edge height (LEH) is the elevation of the lower edge (220) above the ground plane (GP), wherein a portion of the top edge height (TEH) is at least 2 inches; and C) the crown section (400) having a crown apex (410) located an apex height (AH) above the ground plane (GP), wherein;

i) the crown apex (410) is located behind the forward-most point on the face (200) a distance that is a crown apex setback dimension (412) measured in a direction toward the back (114) and orthogonal to the vertical direction used to measure Ycg and orthogonal to the horizontal direction used to measure Xcg;

ii) the crown apex (410) is located a distance from the origin toward the toe (118) a crown apex x-dimension (416) distance that is parallel to the vertical plane defined by the shaft axis (SA) and parallel to the ground plane (GP); and iii) the crown section (400) includes a post apex attachment promoting region (420) on the surface of the crown section (400) at an elevation above a maximum top edge plane (MTEP) wherein the post apex attachment promoting region (420) begins at the crown apex (410) and extends toward the back (114), and the post apex attachment promoting region (420) includes:

(a) an attachment promoting region length (422) measured along the surface of the crown section (400) and orthogonal to the vertical plane defined by the shaft axis (SA);

(b) an apex promoting region width (424) measured along the surface of the crown section (400) in a direction parallel to the vertical plane defined by the shaft axis (SA); and iv) a portion of the crown section (400) at an elevation above the maximum top edge plane (MTEP) is composed of nonmetallic material and has an apex-to-front radius of curvature (Ra-f), an apex-to-rear radius of curvature (Ra-r), and a heel-to-toe radius of curvature (Rh-t), wherein the heel-to-toe radius of curvature (Rh-t) in contact with the crown apex (410) is less than 4 inches.

2. The aerodynamic golf club head of claim 1, wherein less than 10% of the club head volume is located above the maximum top edge plane (MTEP), the attachment promoting region length (422) is at least as great as fifty percent of the crown apex setback dimension (412), and the attachment promoting region width (424) is at least as great as the difference between the crown apex x-dimension (416) and the distance Xcg.

3. The aerodynamic golf club head of claim 2, further having a first moment of inertia (MOIy) about a vertical axis through a center of gravity (CG) of the high volume aerodynamic golf club head (100) that is at least 4000 $g*cm^2$, and a second moment of inertia (MOIx) about a horizontal axis through the center of gravity (CG) that is at least 2000 $g*cm^2$.

4. The aerodynamic golf club head of claim 3, wherein the apex-to-front radius of curvature (Ra-f) in contact with the crown apex (410) is less than a heel-to-toe radius of curvature (Rh-t) in contact with the crown apex (410).

5. The aerodynamic golf club head of claim 4, wherein the apex-to-rear radius of curvature (Ra-r) in contact with the crown apex (410) is less than a heel-to-toe radius of curvature (Rh-t) in contact with the crown apex (410).

6. The aerodynamic golf club head of claim 5, wherein a portion of the heel-to-toe radius of curvature (Rh-t) above the maximum top edge plane (MTEP) is less than 3.85 inches.

7. The aerodynamic golf club head of claim 6, further including an adjustable loft system.

8. The aerodynamic golf club head of claim 7, wherein the crown apex setback dimension (412) is at least 10% of the front-to-back dimension (FB) and less than 1.75 inches.

9. The aerodynamic golf club head of claim 8, wherein than the crown apex setback dimension (412) is less than a distance from a vertical projection of the center of gravity (CG) on the ground plane (GP) to a second vertical projection of the forwardmost point on the face (200) on the ground plane (GP), and the distance Vcg is less than or equal to −0.08 inches.

10. The aerodynamic golf club head of claim 9, wherein the crown section (400) at the crown apex (410) is composed of nonmetallic material, and a portion of the sole section (300) is composed of nonmetallic material.

11. The aerodynamic golf club head of claim 7, wherein the apex-to-front radius of curvature (Ra-f) in contact with the crown apex (410) is at least 25% less than a maximum apex-to-rear radius of curvature (Ra-r) located above the top edge height (TEH).

12. The aerodynamic golf club head of claim 7, wherein the apex-to-rear radius of curvature (Ra-r) of a portion of the crown section (400) above the top edge height (TEH) is less than 3.75 inches.

13. The aerodynamic golf club head of claim 7, wherein a portion of the top edge height (TEH) is at least 2.15 inches, and the front-to-back dimension (FB) is at least 4.6 inches.

14. The aerodynamic golf club head of claim 7, wherein an apex ratio of the apex height (AH) to the maximum top edge height (TEH) is at least 1.13.

15. The aerodynamic golf club head of claim 7, wherein the distance Vcg is less than or equal to −0.16 inches.

16. An aerodynamic golf club head comprising:

A) a hollow body (110) having a club head volume of at least 400 cc, a face (200), a sole section (300), a crown section (400), a front (112), a back (114), a heel (116), a toe (118), and a front-to-back dimension (FB) of at least 4.4 inches, wherein i) the hollow body (110) has a bore having a center that defines a shaft axis (SA) which intersects with a horizontal ground plane (GP) to define an origin point; and ii) the hollow body (110) has a center of gravity (CG) located:

(a) vertically toward the crown section (400) from the origin point a distance Ycg in a direction orthogonal to the ground plane (GP), and vertically toward the crown section (400) from a horizontal center face plane a distance Vcg in a direction orthogonal to the horizontal center face plane, wherein the distance Vcg is less than or equal to 0 inches;

(b) horizontally from the origin point toward the toe (118) a distance Xcg that is parallel to a vertical plane defined by the shaft axis (SA) and parallel to the ground plane (GP); and (c) a distance Zcg from the origin toward the back (114) in a direction orthogonal to the vertical direction used to measure Ycg and orthogonal to the horizontal direction used to measure Xcg;

B) the face (200) having a top edge (210) and a lower edge (220), wherein a top edge height (TEH) is the elevation of the top edge (210) above the ground plane (GP), and a lower edge height (LEH) is the elevation of the lower edge (220) above the ground plane (GP), wherein a portion of the top edge height (TEH) is at least 2 inches; and C) the crown section (400) having a crown apex (410) located an apex height (AH) above the ground plane (GP), wherein;

i) the crown apex (410) is located behind the forwardmost point on the face (200) a distance that is a crown apex setback dimension (412) measured in a direction toward the back (114) and orthogonal to the vertical direction used to measure Ycg and orthogonal to the horizontal direction used to measure Xcg, and the crown apex setback dimension (412) is at least 10% of the front-to-back dimension (FB) and less than 1.75 inches;

ii) the crown apex (410) is located a distance from the origin toward the toe (118) a crown apex x-dimension (416) distance that is parallel to the vertical plane defined by the shaft axis (SA) and parallel to the ground plane (GP); and iii) the crown section (400) includes a post apex attachment promoting region (420) on the surface of the crown section (400) at an elevation above a maximum top edge plane (MTEP) wherein the post apex attachment promoting region (420) begins at the crown apex (410) and extends toward the back (114)), and the post apex attachment promoting region (420) includes:

(a) an attachment promoting region length (422) measured along the surface of the crown section (400) and orthogonal to the vertical plane defined by the shaft axis (SA);

(b) an apex promoting region width (424) measured along the surface of the crown section (400) in a direction parallel to the vertical plane defined by the shaft axis (SA); and (c) the attachment promoting region length (422) is at least as great as fifty percent of the crown apex setback dimension (412), and the attachment promoting region width (424) is at least as great as the difference between the crown apex x-dimension (416) and the distance Xcg;

iv) a portion of the crown section (400) at an elevation above the maximum top edge plane (MTEP) has an apex-to-front radius of curvature (Ra-f), an apex-to-rear radius of curvature (Ra-r), and a heel-to-toe radius of curvature (Rh-t), wherein the heel-to-toe radius of curvature (Rh-t) in contact with the crown apex (410) is less than 4 inches, and the apex-to-front radius of curvature (Ra-f) in contact with the crown apex (410) is less than a heel-to-toe radius of curvature (Rh-t) in contact with the crown apex (410); and D) less than 10% of the club head volume is located above the maximum top edge plane (MTEP) and the club head has a second moment of inertia (MOIx) about a horizontal axis through the center of gravity (CG) that is at least 2000 g*cm$^2$.

17. The aerodynamic golf club head of claim 16, wherein the apex-to-rear radius of curvature (Ra-r) in contact with the crown apex (410) is less than a heel-to-toe radius of curvature (Rh-t) in contact with the crown apex (410).

18. The aerodynamic golf club head of claim 16, further including an adjustable loft system, at least one weight port located in the sole, and at least one removable weight cooperatively receivable in the at least one weight port.

19. The aerodynamic golf club head of claim 16, wherein the distance Vcg is less than or equal to −0.08 inches, and a first moment of inertia (MOIy) about a vertical axis through a center of gravity (CG) of the high volume aerodynamic golf club head (100) that is at least 4000 g*cm$^2$.

20. The aerodynamic golf club head of claim 16, wherein the apex-to-front radius of curvature (Ra-f) in contact with the crown apex (410) is at least 25% less than a maximum apex-to-rear radius of curvature (Ra-r) located above the top edge height (TEH).

* * * * *